US006457816B1

(12) United States Patent
Ishinaga et al.

(10) Patent No.: US 6,457,816 B1
(45) **Date of Patent: *Oct. 1, 2002**

(54) LIQUID DISCHARGING METHOD AND A LIQUID JET HEAD, AND A HEAD CARTRIDGE USING SUCH JET HEAD, AND A LIQUID JET APPARATUS

(75) Inventors: Hiroyuki Ishinaga, Tokyo; Hiroyuki Sugiyama, Sagamihara; Toshio Kashino, Chigasaki; Sadayuki Sugama, Tsukuba, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/890,647

(22) Filed: Jul. 9, 1997

(30) Foreign Application Priority Data

| | | |
|---|---|---|
| Jul. 12, 1996 | (JP) | 8-183747 |
| Jul. 12, 1996 | (JP) | 8-183749 |
| Jul. 12, 1996 | (JP) | 8-183852 |
| Jul. 12, 1996 | (JP) | 8-183854 |
| Jul. 4, 1997 | (JP) | 9-179996 |

(51) Int. Cl.[7] ..... B41J 2/05

(52) U.S. Cl. ..... 347/65

(58) Field of Search ..... 347/63, 65, 67, 347/68, 56, 58

(56) References Cited

U.S. PATENT DOCUMENTS

| | | | |
|---|---|---|---|
| 4,480,259 A | 10/1984 | Kruger et al. | 347/63 |
| 4,496,960 A | 1/1985 | Fischbeck | 347/68 |
| 4,509,063 A | 4/1985 | Sugitani et al. | 347/65 |
| 4,558,333 A | 12/1985 | Sugitani et al. | 347/65 |
| 4,568,953 A | 2/1986 | Aoki et al. | 347/65 |

(List continued on next page.)

FOREIGN PATENT DOCUMENTS

| | | |
|---|---|---|
| EP | 0436047 | 7/1991 |
| EP | 0443798 | 8/1991 |
| EP | 0496533 | 7/1992 |
| EP | 0538147 | 4/1993 |
| JP | 61-59914 | 2/1980 |
| JP | 55-81172 | 6/1980 |
| JP | 61-69467 | 4/1986 |
| JP | 61-110557 | 5/1986 |
| JP | 62-156969 | 7/1987 |
| JP | 62-48585 | 10/1987 |
| JP | 63-197652 | 8/1988 |
| JP | 63-199972 | 8/1988 |
| JP | 2-113950 | 4/1990 |
| JP | 3-81155 | 4/1991 |
| JP | 5-124189 | 5/1993 |
| JP | 6-31918 | 2/1994 |
| JP | 6-87214 | 3/1994 |
| JP | 7-256347 | 10/1995 |
| JP | 8-40553 | 2/1996 |

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharging method for discharging liquid by displacing a movable member by means of air bubble created on the air bubble generating area, which the free end of the movable member faces, comprises the step of promoting the movement of the free end of the movable member by means for promoting the displacement of the free end thereof. With the adoption of this method, the pressure of the air bubble that acts upon the free end of the movable member enables the movable member to form an appropriate displacing configuration to lead the pressure exerted at the time of foaming and the development of the air bubble in the discharging direction efficiently. At the same time, the displacement of the movable member is performed smoothly, thus contributing to enhancing the durability of the movable member.

64 Claims, 39 Drawing Sheets

U.S. PATENT DOCUMENTS

| | | | | |
|---|---|---|---|---|
| 4,611,219 | A | | 9/1986 | Sugitani et al. ..... 347/40 |
| 4,698,645 | A | | 10/1987 | Inamoto ..... 347/65 |
| 4,723,129 | A | | 2/1988 | Endo et al. ..... 347/65 |
| 4,723,136 | A | | 2/1988 | Suzumura ..... 347/65 |
| 4,994,825 | A | | 2/1991 | Saito et al. ..... 347/63 |
| 5,175,565 | A | | 12/1992 | Ishinaga et al. ..... 347/67 |
| 5,208,604 | A | | 5/1993 | Watanabe et al. ..... 347/47 |
| 5,262,802 | A | | 11/1993 | Karita et al. ..... 347/87 |
| 5,278,585 | A | * | 1/1994 | Karz et al. ..... 347/65 |
| 5,296,875 | A | | 3/1994 | Suda ..... 347/93 |
| 5,389,957 | A | | 2/1995 | Kimura et al. ..... 347/20 |
| 5,479,196 | A | * | 12/1995 | Inada ..... 347/92 |
| 5,485,184 | A | | 1/1996 | Nakagomi et al. ..... 347/63 |
| 5,589,858 | A | | 12/1996 | Kadowaki et al. ..... 347/14 |
| 5,602,576 | A | | 2/1997 | Murooka et al. ..... 347/59 |
| 5,821,962 | A | * | 10/1998 | Kudo et al. ..... 347/65 |

* cited by examiner

LIQUID DISCHARGING METHOD AND A LIQUID JET HEAD, AND A HEAD CARTRIDGE USING SUCH JET HEAD, AND A LIQUID JET APPARATUS

BACKGROUND OF THE INVENTION

1. Field of the Invention

The present invention relates to a liquid jet head for discharging a desired liquid by causing thermal energy to act upon liquid for the creation of air bubbles, a head cartridge using such liquid jet head, a liquid jet apparatus, a method for manufacturing liquid jet heads, a liquid discharging method, a recording method, and recorded objects obtained by utilizing such liquid discharging method.

More particularly, the present invention relates to a liquid jet head provided with movable members displaceable by the utilization of the creation of air bubbles, a head cartridge using such liquid jet head, and a liquid jet apparatus or the invention relates to a liquid discharging method for discharging liquid by displacing. movable members by the utilization of the creation of air bubbles, and a recording method.

The present invention is also applicable to a printer for recording on a recording medium, such as paper, thread, fabric, cloth, leather, plastic, glass, wood, or ceramics, and to a copying machine, a facsimile equipment provided with communication systems, a word processor and other apparatuses having a printing unit therefor. Further, the present invention is applicable to a recording system for industrial use, which is complexly combined with various processing apparatuses.

Here, the term "recording" in the description of the present invention means not only the provision of images having characters, graphics, or other meaningful representation, but also, the provision of those images that do not present any particular meaning, such as patterns.

2. Related Background Art

There has been known the so-called bubble jet recording method, which is an ink jet recording method whereby to form images on a recording medium by discharging ink from discharge ports using acting force exerted by the change of states of ink brought about by the abrupt voluminal changes (creation of air bubbles) when thermal energy or the like is applied to ink in accordance with recording signals. For the recording apparatus that uses the bubble jet recording method, it is generally practiced to provide, as disclosed in the specifications of U.S. Pat. No. 4,723,129 and others, the discharge ports that discharge ink, the ink paths conductively connected to the discharge ports, and electrothermal transducing elements arranged in each of the ink paths as means for generating energy for discharging ink.

In accordance with such recording method, it is possible to record high quality images at high speeds with a lesser amount of noises. At the same time, the head that executes this recording method makes it possible to arrange the discharge ports for discharging ink in high density, with the excellent advantage, among many others, that images are made recordable in high resolution, and that color images are easily obtainable by use of a smaller apparatus. In recent years, therefore, the bubble jet recording method is widely adopted for many kinds of office equipment, such as a printer, a copying machine, a facsimile equipment. Further, this recording method is utilized even for industrial systems, such as a textile printing, among others.

Along the wider utilization of bubble jet technologies and techniques for various products in many different fields, there have been increasingly more demands in recent years as given below.

For example, as to the demand on the improvement of discharging efficiency, the adjustment of the thickness of protection film has been studied to optimize the performance of heat generating elements. A study of the kind has produced effects on the enhancement of transfer efficiency of generated heat to liquids.

Also, in order to obtain high quality images, there has been proposed a driving condition under which a liquid discharging method or the like is arranged to be able to execute good ink discharges at higher ink discharging speeds with more stabilized creation of air bubbles. Also, from the viewpoint of a high-speed recording, there has been proposed the improved configuration of liquid flow paths that makes it possible to obtain a liquid jet head capable of refilling liquid to the liquid flow paths at higher speeds in order to make up the liquid that has been discharged.

Of the various configurations of liquid flow paths thus proposed, the structure of liquid flow paths is disclosed in the specification of Japanese Patent Application Laid-Open No. 63-199972 as shown in FIGS. 47A and 47B. The structure of the liquid flow paths and the method for manufacturing disclosed in the specification thereof are the inventions devised with attention given to the back waves (the pressure directed opposite to the direction toward the discharge ports, that is, pressure exerted in the direction toward the liquid chamber). The back waves are known as energy loss because such energy is not exerted in the discharging direction.

The invention represented in FIGS. 47A and 47B discloses a valve 55, which is arranged away from the air bubble generating area formed by the heat generating element 2, and which is positioned on the side opposite to the discharge port 18 with respect to the heat generating element 2.

As shown in FIG. 47B, this valve 55 is set at the initial position thereof such as adhesively bonded to the ceiling of the liquid flow path 10 by method of manufacture utilizing a plate material or the like. In the disclosure, the valve is described as such to be caused to hang down in the liquid flow path 10 along the creation of air bubble. It is also referred to in the disclosure that the invention is designed to control the aforesaid back waves partly by the provision of the valve 55 in order to suppress the energy loss.

However, with respect to the structure thus disclosed, it is clearly understandable that the partial suppression of the back waves by means of the valve 55 is not practical for liquid discharge when studies are made on the condition under which the air bubbles are created in the liquid flow path that retains the discharging liquid in it.

Fundamentally, the back waves themselves are not related directly with discharging as described above. Of the pressures exerted by the air bubble, those directly related with discharging have already acted upon liquid so that the liquid is in the state of being discharged from the liquid flow path the moment the back waves are generated in the flow path as shown in FIG. 47B. Therefore, even if the back waves are suppressed, it is clear that no significant influence is exerted on the liquid discharge, not to mention the partial suppression of the back waves.

Also, in the specification of Japanese Patent Application Laid-Open No. 63-199972, an invention of the head is disclosed. This head is made excellent in the frequency response by improving the refilling of recording liquid. In accordance with such invention, a sub-flow path is arranged, and this path is connected with the corresponding nozzle in the vicinity of the heater. At the time of refilling, ink is also supplied from this sub-flow path, thus attempting to make the refilling period shorter.

However, with the head thus structured, part of the discharging power generated at the time of bubble generation escapes to the sub-flow path, and there is a fear that the discharging efficiency is lowered inevitably. On the other hand, for the bubble jet recording method, each of the heat generating elements repeats heating, while being in contact with ink. As a result, deposit is accumulated on the surface of each heat generating element due to burning of ink. Depending on the kinds of ink, such deposit is made in a considerable quantity, and results in the instabilized creation of air bubbles, hence making it difficult to perform ink discharges in good condition. Also, it is desired to provide a method for performing discharges in good condition without changing the quality of discharging liquid even when the liquid used has the nature such as to be easily deteriorated by the heat application or such as to make sufficient bubble generation difficult.

Here, with this in view, there has been proposed a method for discharging liquid by transferring pressure exerted by bubble generation to discharging liquid, while arranging means for separating the liquid used to create air bubbles by the application of head (bubbling liquid) and the liquid for use of discharges (discharging liquid) as different liquids, such as disclosed in the specifications of Japanese Patent Application Laid-Open No. 61-69467, Japanese Patent Application Laid-Open No. 55-81172, U.S. Pat. No. 4,480,259, among some others. In accordance with these disclosures, the structure is arranged to completely separate ink serving as discharging liquid, and bubbling liquid by use of silicon rubber or some other flexible film so as not to allow the discharging liquid to be directly in contact with the heat generating elements, and at the same time, to transfer pressure exerted by foaming of the bubbling liquid to the discharging liquid by means of the deformation of the flexible film. With a structure of the kind, it is attained to prevent the deposit from being accumulated on the surface of each heat generating element, the improvement of selection range of discharging liquids, or the like.

However, the structure that completely separates discharging liquid and bubbling liquid as described above is the one whereby to transfer pressure exerted at the time of bubble generation to discharging liquid by means of the deformation of the flexible film brought about by its expansion and contraction. Therefore, the pressure exerted by the deforming thereof is absorbed by the flexible film to a considerable extent. Also, the amount of deformation of the flexible film is not large. As a result, although it is possible to obtain effect that discharging liquid and bubbling liquid are made separable, there is a fear that discharging efficiency and discharging power are lowered after all.

SUMMARY OF THE INVENTION

The subject of the present invention is to enhance the fundamental discharging characteristics of the conventional method for discharging liquid by the creation of air bubbles (particularly, air bubbles following film boiling) in each of the liquid flow paths to such a high level that has never been anticipated conventionally from the viewpoint that has not been given any light in the conventional art.

Some of the inventors hereof have returned to the principle of liquid droplet discharging, and carried out researches and developments assiduously on a new method for discharging liquid droplets by the utilization of air bubbles, which has never been attempted, as well as on the provision of a head and others usable for such method. At that time, it has been executed to make a first technical analysis of the principle of mechanism of the movable member in the flow path, starting with the operation of the movable member in the liquid flow path; a second technical analysis based upon the principle of the liquid droplet discharging by means of air bubbles; and a third technical analysis based upon the air bubble generating area of each heat generating element for use of the air bubble creation.

These technical analyses have led to the establishment of a completely new technique that the air bubbles are positively controlled by arranging a positional relationship between the fulcrum and free end of the movable member so that the free end thereof is positioned on the discharge port side effectively, namely, on the downstream side, and also, positively controlled by arranging the movable member to face the heat generating element of the air bubble generating area appropriately.

Then, it has been known that in consideration of the energy that each air bubble itself gives to the discharge amount, the greatest factor that contributes to the significant enhancement of the discharging characteristics is the developing component of the air bubble on the downstream side, and that attention should be given to this developing component. In other words, it is the prerequisite for the enhancement of the discharging efficiency and discharging speed that the developing component of the air bubble on the downstream side is converted efficiently to be the one directed toward discharging. Based on such knowledge thus obtained, some of the inventors hereof have acquired a technique of an extremely high standard as compared with the conventional technical standard that the developing component of the air bubble on the downstream side is allowed to shift to the free end side of the movable member positively.

Further, it has been found preferable to consider the heat generating area for the creation of air bubbles, which is on the downstream side of the center line that passes the area center of each electrothermal transducing element in the flow direction of liquid, for example, or to consider the structural elements of the movable member with respect to the development of each air bubble on the downstream side of the area center in order to promote foaming or the like.

In accordance with the knowledge obtained by the researches and developments described above, and also, from the overall point of view, some of the inventors hereof and the present applicant have already filed an application for a patent on an excellent principle of liquid discharging. The inventor et al. hereof have acquired a more preferable concept on the premise of such invention.

In other words, with respect to the structure that enable the movable member to face the air bubble generating area, there are some cases where slight variation takes place depending on the conditions of design set for remarkably enhancing the discharging characteristics and discharging stability as compared with the conventional structure where no movable member is provided. It has been found that the important factor for the discharging condition to be brought to a higher level is the state in which the movable member leads air bubble in the direction of discharge port, that is, how fast the movable member is brought to the ideal configuration of its displacement.

Based upon this finding, the applicant hereof has applied for a patent by Japanese Patent Application No. 8-40553, which is intended to provide a changing point with respect to the thickness of the movable member itself for the quick displacement of the movable member as given below.

"A liquid jet head for discharging liquid by the creation of air bubbles, comprising the discharge ports for discharging liquid, liquid flow paths conductively connected with the discharge ports, air bubble generating areas for causing liquid to create air bubbles, and movable members arranged on the air bubble generating areas, each having the fulcrum point and the free end positioned relatively on the discharge port side with respect to the fulcrum point, the movable member having a curbed portion for changing the relative displacements of the movable portion on the free end side and the movable portion of the fulcrum side."

On the related background art described above, the present invention is designed for the quick and reliable movement of the free end of the movable member displaceable by the creation of air bubble, and also, for the provision of a method of solution devised differently from the previous invention in which attention is given only to the movable member itself.

In other words, the principle objective of the present invention is as follows:

It is a first object of the invention to provide a method for promoting displacement and means therefor with respect to the movable member, except for the thickness changes of the movable member on the free end side, by giving attention to the load conditions or the structural relations for promoting the movement of the free end of the movable member.

It is a second object of the invention to provide a liquid discharging method and a liquid jet head whereby to attain the quicker displacement of the free end of the movable member at the early stage of the air bubble creation, thus obtaining a state where the air bubble is led to the discharge port in a shorter period of time.

It is a third object of the invention to provide a liquid discharging method and a head using such method in order to enhance the durability of the movable member.

It is a fourth object of the invention to provide a liquid jet head capable of making the time required for the maximum displacement of the free end of the movable member shorter in order to enhance the printing speeds.

It is a fifth object of the invention to provide a liquid jet head capable of reducing the deformation of the movable member brought about by the resistance taking place in the liquid flow path when the valve mechanism of the movable member operates by the creation of air bubble, thus enhancing the discharging efficiency of the head.

It is a sixth object of the invention to provide a liquid jet head capable of suppressing more quickly the inertial force acting in the direction opposite to the direction of liquid supply due to the generation of back waves, and at the same time, capable of making the printing speeds higher by reducing the regressive amount of meniscus by use of the valve mechanism of the movable member to enhance the refilling frequency.

It is a seventh object of the invention to provide a liquid jet head and a liquid discharging method capable of leading air bubble in the discharging direction by bringing the discharging configuration of the movable member to its ideal status by means of the characteristics provided for the movable member, thus enhancing the discharging efficiency and discharging stability.

It is an eighth object of the invention to provide a liquid jet head and a liquid discharging method whereby to materialize the structure of the movable member capable of utilizing the function to positively shift the developing component of the air bubble on the downstream side to the free end side of the movable member, hence attempting the further enhancement of discharging efficiency and discharging pressure for the implementation of more stable liquid discharging.

It is a ninth object of the invention to provide a head cartridge and a liquid jet apparatus using the liquid jet head of the present invention.

In order to solve the problems described above, the present invention provides means for intensively arranging the air bubble generating area on the free end side of the movable member given below with the exception of the thickness changes of the free end side of the movable member; means for making the characteristic frequency of vibration of the movable member larger than the driving frequency (preferably, the maximum driving frequency) for use of air bubble creation, and means for promoting displacement to promote the movement of the free end of the movable member.

(a) Means for intensively arranging the air bubble generating area on the free end side of the movable member.

(1) For a liquid jet head for discharging liquid by displacing the movable member provided with the free end facing the air bubble generating area by means of air bubble, the pressure of air bubble is added to the ½ area from the free end side of the movable member or preferably, ⅖ area from the free end side thereof, thus enabling the displacement of the free end to be in the displacing configuration that makes it maximum.

(2) For a liquid jet head for discharging liquid by displacing the movable member provided with the free end facing the air bubble generating area by means of air bubble, the pressure of the air bubble acting upon the side nearer to the free end of the movable member is enhanced relatively more than the pressure acting upon the side nearer to the fulcrum in order to make the displacement of the free end higher than any other parts of the movable member.

(b) Means for making the characteristic frequency of vibration of the movable member larger than the driving frequency for use of air bubble creation, and means for promoting displacement (3) For a liquid jet head for discharging liquid by displacing the movable member provided with the free end facing the air bubble generating area by means of air bubble, the characteristic frequency of vibration of the movable member is made larger than the inverse number of cycle from the creation of air bubble to the extinction thereof.

(c) Means for promoting displacement to promote the movement of the free end of the movable member (4) For a liquid jet head for discharging liquid by displacing the movable member provided with the free end facing the air bubble generating area by means of air bubble, the free end side of the movable member is arranged to be a first displacement area, and the fulcrum side is arranged to be a second displacement area having a stronger rigidity that the first displacement area in the displacing direction of the movable member, and the developing component of the air bubble on the downstream side is positively shifted to the free end side of the movable member.

(Modes Embodying the Present Invention)

Now, the description will be made of the modes embodying the present invention.

In accordance with the present invention, a liquid discharging method for discharging liquid by displacing a movable member having the free end thereof facing an air bubble generating area by means of air bubble comprises the step of promoting the movement of the free end by means for promoting the displacement of the free end of the movable member.

In accordance with the present invention, a liquid jet head for discharging liquid by displacing a movable member having the free end thereof facing an air bubble generating area by means of air bubble comprises means for promoting displacement to promote the displacement of the free end of the movable member.

In accordance with the present invention, means for promoting displacement of the present invention includes means for intensively arranging the air bubble generating on the free end side of the movable member with the exception of the thickness changes of the free end side of the movable member; means for making the characteristic frequency of vibration of the movable member larger than the driving frequency (preferably, the maximum driving frequency) for use of air bubble creation; means for promoting the movement of the free end of the movable member, or the like.

(a) Means for intensively arranging the air bubble generating area on the free end side of the movable member.

In accordance with the present invention, a liquid discharging method is to add the pressure of air bubble to a ½ area from the free end side of the movable member for the provision of a displacing configuration to maximize the displacement of the free end.

In accordance with the present invention, a liquid discharging method is to add the pressure of air bubble to a ⅖ area from the free end side of the movable member for the provision of a displacing configuration to maximize the displacement of the free end.

In accordance with the present invention, a liquid jet head is structured to arrange the end of the air bubble generating area on the side opposite to the discharge port on the free end side of the center of the movable member.

In accordance with the present invention, a liquid jet head is to arrange the air bubble generating area on the side opposite to the discharge port on the free end side of the point dividing the movable member by 2:3 from the free end thereof.

In accordance with the present invention, a liquid discharging method is to enhance the pressure of the air bubble acting upon the side nearer to the free end relatively more than the pressure acting upon the side nearer to the fulcrum, among pressures acting upon the movable member, in order to make the displacement of the free end higher than any other parts of the movable member.

In accordance with the present invention, a liquid discharging method uses a head provided with discharge ports for discharging liquid, air bubble generating areas for causing liquid to create air bubbles, and movable members arranged to face the air bubble generating areas, each being displaceable between a first position and a second position further away from the air bubble generating area than the first position, this movable member being displaced from the first position to the second position by pressure exerted by the creation of air bubble on the air bubble generating area, at the same time, the air bubble being caused to be expanded by the displacement of the movable member larger on the downstream than on the upstream in the direction toward the discharge port for discharging liquid, and then, the pressure of the air bubble acting upon the side nearer to the free end being enhanced relatively more than the pressure acting upon the side nearer to the fulcrum, among pressures of the air bubble acting upon the movable member, in order to make the displacement of the free end higher than any other parts of the movable member.

In accordance with the present invention, a liquid jet head is to enhance the pressure of air bubble acting upon the movable member on the side nearer to the free end side more than the pressure acting upon the side nearer to the fulcrum side, among pressures of the air bubble acting upon the movable member, in order to make the displacement of the free end higher than any other part of the movable member.

In accordance with the present invention, a liquid jet head is provided with discharge ports for discharging liquid, air bubble generating areas for causing liquid to create air bubbles, and movable members arranged to face the air bubble generating areas, each being displaceable between a first position and a second position further away from the air bubble generating area than the first position, and this movable member being displaced from the first position to the second position by pressure exerted by the creation of air bubble on the air bubble generating area, at the same time, the air bubble being caused to be expanded by the displacement of the movable member larger on the downstream than on the upstream in the direction toward the discharge port for discharging liquid, and then, the pressure acting upon the side nearer to the free end is enhanced relatively more than the pressure acting upon the side nearer to the fulcrum, among pressures acting upon the movable member, in order to make the displacement of the free end higher than any other parts of the movable member.

(b) Means for making the characteristic frequency of vibration of the movable member larger than the driving frequency for use of air bubble creation.

In accordance with the present invention, a liquid jet head is to make the characteristic frequency of vibration of the movable member larger than the inverse number of cycle from the creation of air bubble to the extinction thereof.

In accordance with the present invention, a liquid jet head is to make the speed of wave transfer of the movable member faster than the developing speed of air bubble.

In accordance with the present invention, a liquid discharging method is to use such liquid jet head described above.

(c) Means for promoting displacement to promote the movement of the free end of the movable member.

In accordance with the present invention, a liquid jet head comprises discharge ports for discharging liquid, air bubble generating areas for creating air bubbles for discharging liquid from the discharge ports, and at least one movable member arranged to face the air bubble generating area to be made displaceable between a first position and a second position further away from the air bubble generating area than the first position, this movable member being provided with the fulcrum on the upstream side, and the free end on the downstream side in the flow of liquid directed to the discharge port, and provided with a first displacement area on the free end side, and a second displacement area on the fulcrum side, having stronger rigidity than the first displacement area with respect to the displacing direction of the movable member, and being displaced from the first position to the second position by pressure exerted by the creation of air bubble to lead the pressure in the direction of the discharge port for discharging liquid from the discharge port.

In accordance with the present invention, a liquid discharging method comprises the step of arranging movable members, each having the fulcrum on the upstream side and the free end on the downstream side in the flow of liquid directed toward the discharge port, and a first displacement area on the free end side and a second displacement area on the fulcrum side provided with a stronger rigidity than the first displacement area with respect to the displacing direction, to face the air bubble generating area for creating the air bubble; and the step of leading pressure in the direction of the discharge port for discharging liquid from the discharge port by displacing the movable member from a first position to a second position further away from the air bubble generating area than the first position by the pressure exerted by the creation of air bubble on the air bubble generating area for discharging liquid from the discharge port.

In accordance with the present invention, a head cartridge is provided with the liquid jet head described above, and a liquid container for retaining liquid to be supplied to the liquid jet head.

Also, in accordance with the present invention, a liquid jet apparatus is provided with the liquid jet head described above, and a carriage mounting the liquid jet head, and being capable of reciprocating in the sub-operational direction for recording on a recording medium.

In this respect, the terms "upstream" and "downstream" are related with the direction of liquid flow from the supply source of liquid to the discharge port through the air bubble generating area (or the movable member) or these terms are often used to express the structural direction thereof.

Also, the term "downstream side" of the air bubble itself represents the portion of the air bubble on the discharge port side, which mainly acts upon the discharge droplets directly. More specifically, it means the downstream side with respect to the center of the air bubble in the flow direction or the structural direction described above or the air bubble created in the area on the downstream side of the area center of the heat generating element.

Also, the term "essentially closed" used in the description of the present invention means a state where the air bubble does not escape from the gap (slit) on the circumference of the movable member before the movable member is displaced at the time of the air bubble being developed.

Also, the term "separation wall" referred to in the present invention means a wall (that may include the movable member) that resides to partition the air bubble generating area and the discharge port in a broader way, and also, means the partition between the flow path including the air bubble generating area and the liquid flow path conductively connected with the discharge port directly, in a narrower way, so as to prevent liquid in each of the areas from being mixed.

Also, the term "the pressure of air bubble caused to act upon the movable member" referred to in the description of the present invention includes at least either one of the pressure wave propagated from the air bubble to the movable member along the creation of air bubble and the development thereof, and the force that acts upon the movable member, which is exerted by the shifting of liquid residing between the air bubble and the movable member following the pressure of air bubble.

Also, the term "the center of the movable member" referred to in the description of the present invention means the portion of the movable member intersecting the vertical surface that bisects the length from the free end to the fulcrum of the movable member with respect to the upstream and downstream directions of ink flow.

BRIEF DESCRIPTION OF THE DRAWINGS

FIG. 17A is a perspective view thereof; and FIG. 17B is a cross sectional view, taken along line 17B—17B in FIG. 17A.

FIG. 18A is a schematic view which shows the liquid discharging when the heat generating element is small; and FIG. 18B is a schematic view which shows the liquid discharging when the heat generating element is large.

DETAILED DESCRIPTION OF THE PREFERRED EMBODIMENTS (Description of Principle)

Hereinafter, with reference to the accompanying drawings, the description will be made of the discharging principle applicable to the present invention.

Figure 29A:
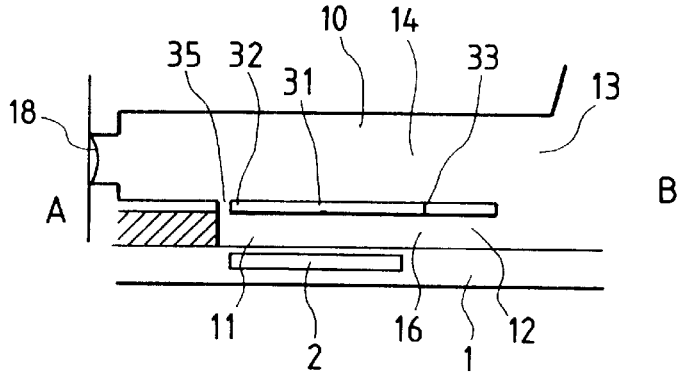
FIGS. 29A, 29B, 29C and 29D are cross-sectional views which schematically illustrate one example of a liquid jet head in accordance with the present invention.
Figure 29B:
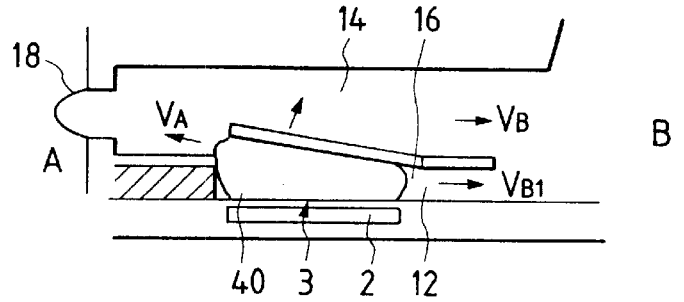

FIGS. 29A to 29D are cross-sectional views which schematically illustrate a liquid jet head, taken in the liquid flow path direction. FIG. 30 is a partially broken perspective view which shows such liquid jet head.

For the liquid jet head shown in FIGS. 29A to 29D, the heat generating element 2 that causes thermal energy to act upon liquid (in a form of heat generating resistor of 40 $\mu$m×105 $\mu$m in accordance with the present embodiment) is arranged on an elemental substrate 1 as discharge energy generating element for discharging liquid, and on this elemental substrate, a liquid flow path 10 is arranged corresponding to the heat generating element 2. The liquid flow path is conductively connected with the discharge port 18, and at the same time, connected with a common liquid chamber 13 conductively, thus receiving liquid from this common liquid chamber 13 in an amount corresponding to the liquid that has been discharged from the discharge port 18.

In the liquid flow path 10 on the elemental substrate, a plate type movable member 31 having a flat portion is arranged in a cantilever fashion, which is formed by a material having elasticity such as metal, and structured to face the heat generating element 2 described above. One end of this movable member 31 is fixed to a base (a supporting member) 34 or the like formed by patterning photosensitive resin on the wall of the liquid flow path and the elemental substrate. In this way, the movable member is supported. At the same time, a fulcrum (fulcrum portion) 33 is structured.

This movable member 31 is arranged in a position facing the heat generating element 2 away from the heat generating element by approximately 15 $\mu$m to cover it so that the movable member has the fulcrum (fulcrum portion; fixed end) 33 on the upstream side of a large flow running from the common liquid chamber 13 to the discharge port side through the movable member by means of the discharging operation of liquid, and that it has the free end (free edge portion) 32 on the downstream side with respect to this fulcrum 33. Between the heat generating element 2 and the movable member 31 becomes an air bubble generating area. In this respect, the kinds, configurations, and arrangements of the heat generating elements and movable members are not necessarily limited to those which have been described. As described later, it should be good enough if only these elements and members are in a configuration and arrangement that enable them to control the development of air bubbles and the propagation of pressure as well. Here, the description will be made of the liquid flow path described above by dividing into two areas; while defining the movable member 31 as boundary, the portion that conductively connected with the discharge port 18 directly is defined as the first liquid flow path, and the portion having the air bubble generating area 11 and liquid supply path 12 is defined as the second liquid flow path 16 in order to describe the flow of liquid that will be taken up later.

The heat generating element 2 is energized to heat liquid in the air bubble generating area 11 between the movable member 31 and the heat generating element 2. Then, an air bubble is created in the liquid in accordance with the film boiling phenomenon as disclosed in the specification of U.S. Pat. No. 4,723,129. Pressure exerted by the creation of the air bubble, and the air bubble as well, act upon the movable member 31 priorly. The movable member 31 is displaced to be open largely to the discharge port side centering on the fulcrum 33 as shown in FIGS. 29A and 29B or FIG. 30. Due to the displacement or the state of the displacement of the movable member 31, the propagation of pressure exerted by the creation of the air bubble and the development of the air bubble itself are led to the discharge port side.

Here, the description will be made of one of the fundamental discharging principles applicable to the present invention. One of the most important principles with respect to the present invention is that each of the movable members arranged to face an air bubble is displaced from the first position where it resides stationarily to the second position that is the position after displacement by the pressure exerted by the air bubble or the air bubble itself, and that the pressure exerted by the creation of the air bubble or the air bubble itself brought about by the displacement of the movable member 31 is led to the downstream side where the discharge port 18 is arranged.

In comparison of FIG. 31 which schematically shows the conventional structure of liquid flow path without using movable member and FIG. 32 for the present invention, this principle will be described further in detail. Here, in this respect, the propagating direction of pressure in the direction of the discharge port is indicated as $V_A$, and the propagating direction of pressure to the upstream side is indicated as $V_B$.

Figure 31:
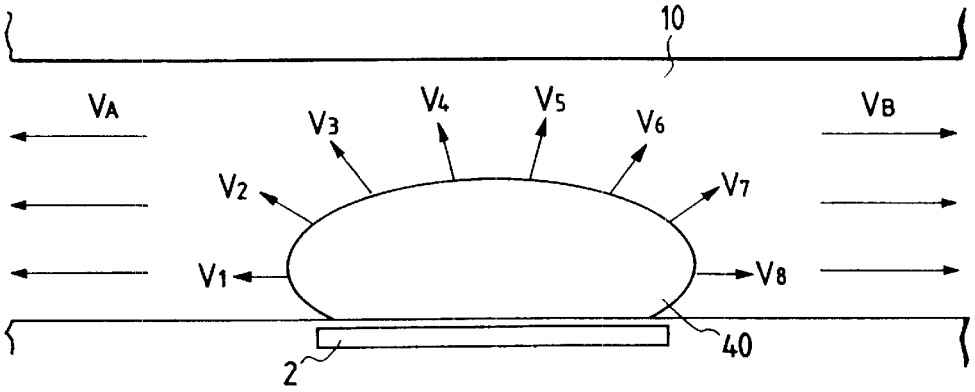
FIG. 31 PRIOR ART
FIG. 31 is a view which schematically shows the pressure propagation from an air bubble in accordance with the conventional head.

As shown in FIG. 31, there is no structure for the conventional head that regulates the propagating direction of pressure exerted by the creation of the air bubble. As a result, the pressure propagating directions of the air bubble 40 are brought in the direction of vertical line of the surface of the air bubble as indicated by the reference marks $V_1$ to $V_8$. Of pressures thus directed, those having influence most on the liquid discharge, in particular, are the components in the pressure propagating direction toward $V_A$, that is, those designated by reference marks $V_1$ to $V_4$, which reside in the pressure propagating directions closer to the discharge port portion from the position almost in a half of the air bubble. These are important components that directly contribute to the condition of liquid discharge efficiency, liquid discharging power, discharging speeds, and others. Further, the $V_1$ functions better because it is closest to the discharge port side $V_A$. On the contrary, the $V_4$ has a comparatively smeller component working in the direction toward the discharge port $V_A$.

Figure 32:
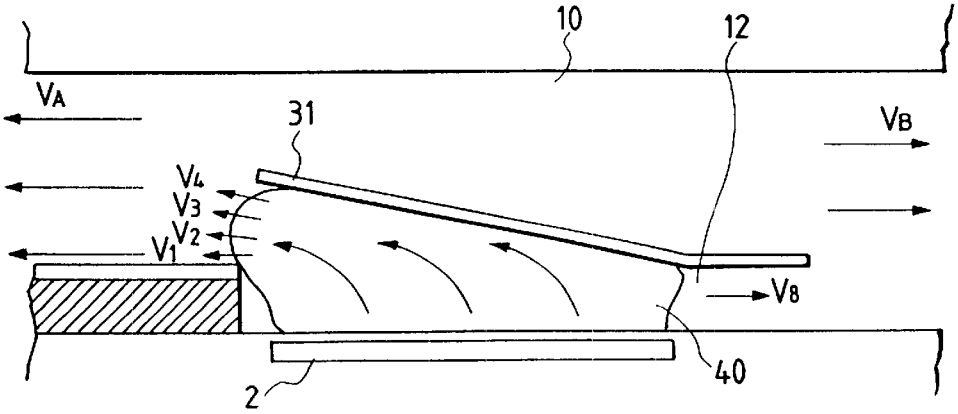
FIG. 32 is a view which schematically shows the pressure propagation from an air bubble in accordance with the head in accordance with the present invention.

In contrast, the present invention as represented in FIG. 32 makes it possible to operate the movable member 31 so that the propagating directions of pressure exerted by the creation of the air bubble, which are directed variously at $V_1$ to $V_4$ in the case shown in FIG. 31, are led to the downstream side (discharge port side) to change them to be in the pressure propagating direction toward $V_A$. In this way, the pressure exerted by the creation of the air bubble 40 is made to contribute to discharging directly and efficiently. Then, the developing direction of the air bubble itself is also led to the downstream side as in the pressure propagating directions $V_1$ to $V_4$, thus enabling it to be developed larger in the downstream side than in the upstream side. In this way, the developing direction of the air bubble itself is controlled by means of the movable member to control the pressure propagating direction of the air bubble, thus making it possible to attain the fundamental enhancement of the discharging efficiency, discharging power, discharging speeds, and others.

Now, reverting to FIGS. 29A to 29D, the discharging operation of the liquid jet head of the present embodiment will be described in detail.

FIG. 29A shows the state before electric energy or the like is applied to the heat generating element 2, which is a state before the heat generating element generates heat. Here, what is important is that the movable member 31 is located in a position to face at least the downstream side portion of the air bubble with respect to the air bubble that has been created by the head of the heat generating element. In other words, the movable member 31 is arranged up to the position on the downstream at least from the area center 3 of the heat generating element in the structural arrangement of the liquid flow path (that is, the downstream form the line passing the area center 3 of the heat generating element, which is orthogonal to the longitudinal direction of the liquid flow path).

FIG. 29B shows a state that electric energy or the like is applied to the heat generating element 2 to heat it. Thus, liquid filled in the air bubble generating area 11 is partly heated to create the air bubble following film boiling.

At this juncture, the movable member 31 is displaced from the first position to the second position by means of pressure exerted by the creation of the air bubble 40, thus leading the pressure propagating direction of the air bubble to the discharge port side. Here, what is important is that, as referred to earlier, the free end 32 of the movable member 31 is arranged in the downstream side (discharge port side), while the fulcrum 33 is arranged in the upstream side (common liquid chamber side) so that at least a part of the movable member is allowed to face the downstream portion of the heat generating element, that is, the downstream portion of the air bubble.

Figure 29C:
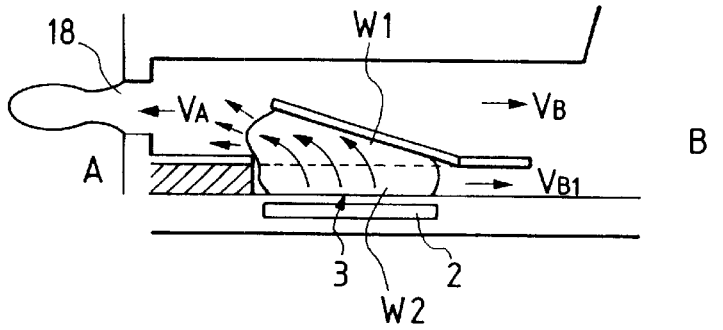
Figure 30:
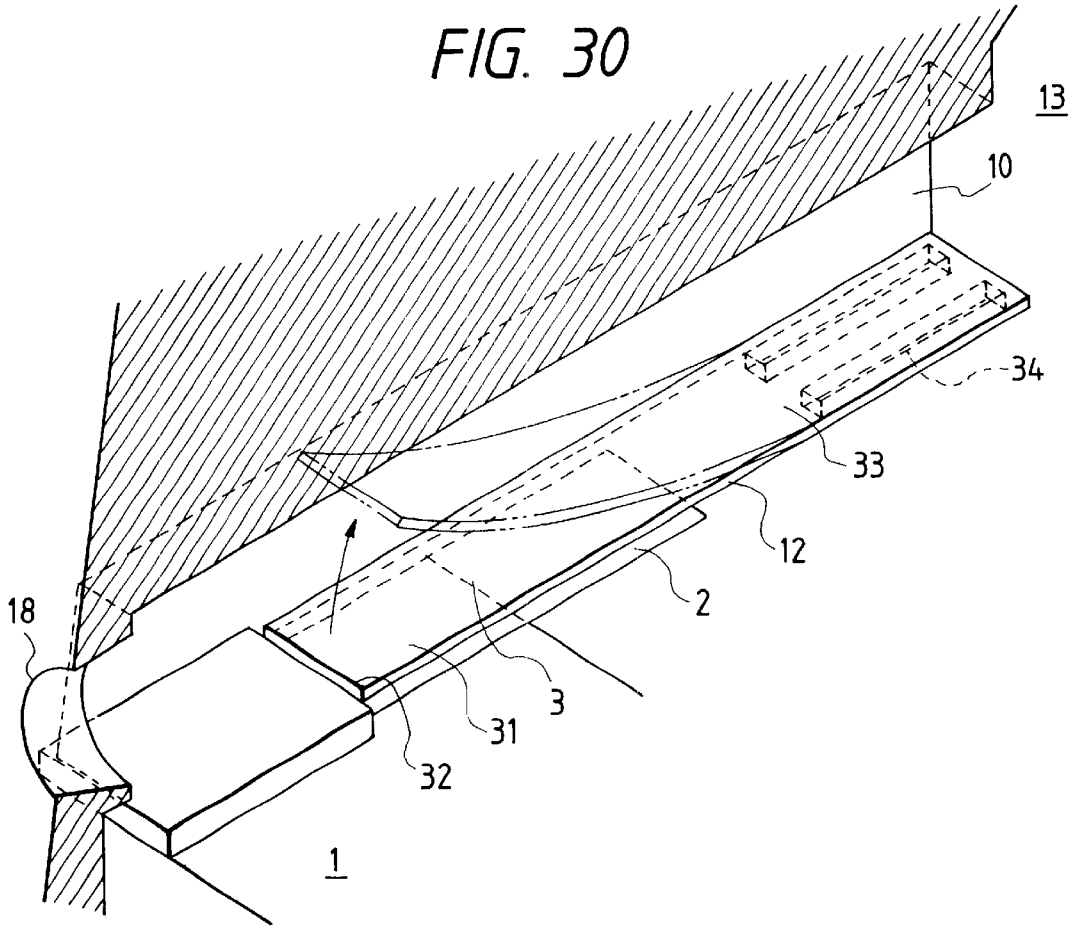
FIG. 30 is a partially broken perspective view which shows a liquid jet head in accordance with the present invention.

FIG. 29C shows a state that the air bubble 40 is further developed. Here, in accordance with the pressure following the creation of the air bubble 40, the movable member 31 is further displaced. The air bubble 40 thus created is developed larger on the downstream than the upstream, and at the same time, it is developed larger still beyond the first position of the movable member 31 (the position indicated by a dotted line). In this way, as the air bubble 40 is being developed, the movable member 31 is gradually displaced. Thus, it becomes possible to lead the developing direction of the air bubble toward the direction in which the pressure propagating direction of the air bubble 40 and its voluminal shift are easily effectuated. In other words, the developing direction of the air bubble toward the free end side is directed to the discharge port 18 evenly. This is considered to be a factor that contributes to the enhancement of the discharging efficiency. The movable member 31 presents almost no obstacle in propagating the pressure waves in the direction of the discharge port following the air bubble creation or foaming pressure. The propagating direction of the pressure and the developing direction of the air bubble is then controlled efficiently corresponding to the magnitude of the pressure to be propagated.

Figure 29D:
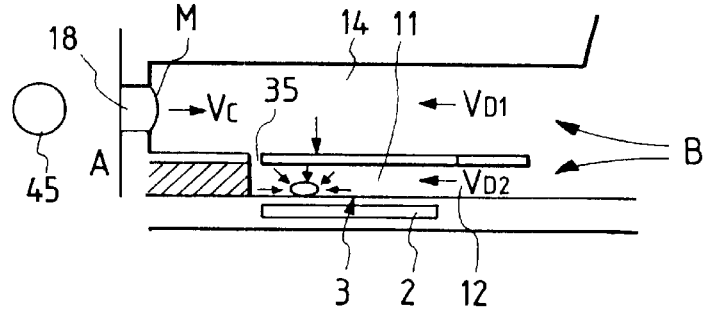

FIG. 29D shows a state that the air bubble 40 is contracted due to the reduction of the pressure in the air bubble subsequent to the film boiling described above. In this state, the air bubble disappears.

The movable member 31, which is displaced to the second position, is returned to the initial position shown in FIG. 29A (the first position) by means of the negative pressure exerted by the contraction of the air bubble and the restoring force provided by the elasticity of the movable member 31 itself as well. Also, when the air bubble disappears, liquid is caused to flow in from the upstream side (B), that is, from the common liquid chamber side as the flows of liquid designated by reference marks $V_{D1}$ and $V_{D2}$, and also, from the discharge port side as designated by $V_C$, in order to make up the contracted volume of the air bubble on the air bubble generating area 11, and also, to make up as the voluminal portion of liquid that has been discharged.

Now, the description has been made of the operation of the movable member following the creation of air bubble, and of the liquid discharging operation as well. Hereinafter, the description will be made of the liquid refilling for the liquid jet head in detail.

Following the state shown in FIG. 29C, the air bubble 40 enters the defoaming process after its volume becomes the greatest. At this juncture, liquid that makes up the volume that has been reduced due to defoaming is caused to flow in the air bubble generating area 11 from the discharge port 18 side of a first liquid flow path 14, and also, flows in from the common liquid chamber 13 side of a second liquid flow path 16. For the conventional liquid flow structure that does not contain any movable member 31, the amount of liquid flowing in the disappearance position from the discharge port side and the liquid amount flowing in from the common liquid chamber are determined by the magnitude of flow resistance between the portion nearer to the discharge port than to the air bubble generating area, and the portion nearer to the common liquid chamber (that is, determined by the flow resistance and the inertia of liquid).

Therefore, if the flow resistance is smaller on the side near to the discharge port, a large amount of liquid flows in the disappearance position where the bubbles disappear from the discharge port side, which makes the regressive amount of meniscus greater. Particularly when the flow resistance on the side nearer to the discharge port is made smaller in order to enhance the discharging efficiency, the regressive amount of meniscus M becomes greater at the time of defoaming. As a result, it takes more time to execute refilling, which hinders a higher speed printing.

In contrast, since the movable member 31 is provided for this structure, the regression of the meniscus comes to a stop when the movable member 31 returns to the original position when defoaming, provided that the upper side of the volume W of the air bubble is given as $W_1$, and the air bubble generating area 11 side as $W_2$, while the first position being defined as boundary. After that, the voluminal portion of the liquid supply for the remaining $W_2$ is made up by the liquid supply from the flow $V_{D2}$, which is mainly from the second liquid flow path. In this way, whereas the regressive amount of the meniscus becomes as large as almost a half of the volume of the air bubble W conventionally, it is possible to suppress the regressive amount of the meniscus to almost a half of the $W_1$, which is already smaller than the conventional regressive amount of the meniscus.

Further, the liquid supply for the voluminal portion $W_2$ can be executed compulsorily mainly from the upstream side ($V_{D2}$) of the second liquid flow path along the surface of the movable member 31 on the heat generating side. As a result, the implementation of faster refilling is attained.

Here, characteristically, when refilling is executed using the pressure exerted at the time of deforming for the conventional head, the vibration of meniscus becomes great, leading to the degrading of image quality. However, with the high-speed refilling described above, it is possible to suppress and make the vibration of the meniscus extremely small, because the liquid flow is suppressed on the area of the first liquid flow path 14 on the discharge port side and the air bubble generating area 11 on the discharge port side as well.

Thus, with the structure arranged in accordance with the present invention, it is possible to attain the compulsory refilling to the air bubble generating area 11 through the second liquid flow path 16 of the liquid supply path 12, and also, attain a high-speed refilling by suppressing the regression and vibration of the meniscus. Therefore, the implementation of the stabilized discharges and a high-speed repetition of discharges becomes executable. Also, when applying it to the field of recording, the quality of recorded images are enhanced at a higher speed recording. The structure arranged in accordance with the present invention is dually provided with the effective functions given below. In other words, it is possible to suppress the propagation of pressure exerted by the creation of the air bubble to the upstream side (back waves). Of the pressure exerted in an air bubble created on a heat generating element, most of the pressure exerted thereby on the common liquid chamber side (upstream side) becomes a force that pushes back liquid toward the upstream side (back waves). The back waves bring about not only the pressure on the upstream side, but also, the shifting amount of liquid caused thereby, and the inertial force following such shifting of liquid. This event results in the unfavorable performance of liquid refilling in the liquid flow paths, leading also to the hindrance of high-speed driving. In accordance with the present invention, such action working upon the upstream side is suppressed at first by means of the movable member 31, thus making the further enhancement of refilling supply performance possible.

Now, more characteristic structures and effects will be described hereunder.

The second liquid flow path 16 is provided with a liquid supply path 12 having the inner wall (the surface of the heat generating element does not fall remarkably) which is essentially connected with the heat generating element 2 flatly on the upstream of the heat generating element 2. In this case, the liquid supply to the air bubble generating area 11 and to the surface of the heat generating element 2 is executed as indicated by the reference mark $V_{D2}$ along the surface on the side nearer to the air bubble generating area 11 of the movable member 31. As a result, the stagnation of liquid on the surface of the heat generating element 2 is suppressed to make it possible to easily remove the deposition of gas remaining in liquid, as well as the so-called remaining bubbles yet to be defoamed. Also, there is no possibility that the heat accumulation on liquid becomes too high. Therefore, it is possible to perform more stabilized creation of bubbles repeatedly at high speeds. In this respect, the description has been made of the liquid supply path 12 having an inner wall, which is essentially flat, but the present invention is not necessarily limited to it. It should be good enough if only the liquid supply path has a smooth inner wall connected with the surface of the heat generating element smoothly, and is configured so that there is no possibility that liquid is stagnated on each of the heat generating elements and that any large disturbance of flow takes place in supplying liquid.

Also, the liquid supply to the air bubble generating area is executed from the $V_{D1}$ through the side portion (slit 35) of the movable member. However, in order to lead the pressure toward the discharge port more effectively when each of the air bubbles is created, a large movable member is adopted to cover the entire area of the air bubble generating area (to cover the surface of the heat generating element totally) as shown in FIGS. 29A to 29D. In this case, the liquid flow from the $V_{D1}$ to the air bubble generating area 11 may be blocked if the mode is such that the flow resistance between the air bubble generating area 11 and the area near to the discharge port on the first liquid flow path 14 becomes larger when the movable member 31 returns to the first position. With the head structure described above, there is provided the flow $V_{D2}$ for liquid supply to the air bubble generating area. As a result, the liquid supply performance becomes extremely high, and there is no possibility that the liquid supply performance is lowered even if the structure is arranged so as to allow the removable member 31 to cover the air bubble generating area 11 for the enhancement of discharging efficiency.

Figure 33:
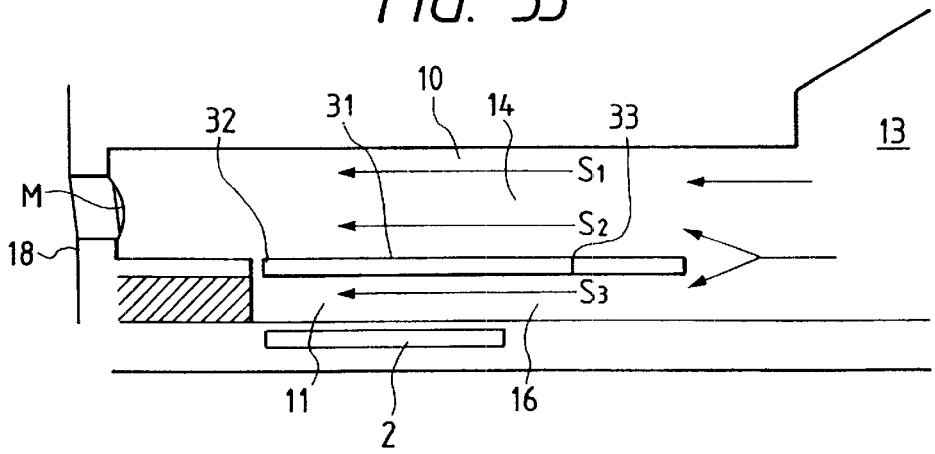
FIG. 33 is a view which schematically illustrates the flow liquid in accordance with the present invention.

Now, as to the positions of the free end 32 and the fulcrum 33 of the movable member 31, it is arranged that the free end is relatively on the downstream side than the fulcrum as shown in FIG. 33. Since the structure is arranged in this way, it becomes possible to implement the function to lead the pressure propagating direction and developing direction of the air bubble toward the discharge port side effectively at the time of foaming as described earlier. Further, with this positional relationship, it is made possible to produce not only favorable effects on the discharging functions, but also, make the flow resistance smaller for liquid running in the liquid flow path 10 when liquid is supplied, thus obtaining the effect that refilling is possible at higher speeds. This is because, as shown in FIG. 33, the free end and the fulcrum 33 are arranged not to present resistance to the flows S1, S2, and S3 running in the liquid flow path 10 (including the first liquid flow path 14 and the second liquid flow path 16) when the meniscus M, which has once regressed due to discharging, returns to the discharge port 18 by means of capillary force or when liquid is supplied subsequent to defoaming.

To supplement this, as shown in FIGS. 29A to 29D, the free end 32 of the movable member 31 extends over the heat generating element 2 to face the downstream side of the area center 3 (that is the line orthogonal to the longitudinal direction of the liquid flow path, passing the area center (central portion) of the heat generating element), which divides the heat generating element 2 into the upstream side and the downstream side. In this way, the pressure generated on the downstream side of the central position 3 of the heat generating element, which contributes greatly to liquid discharging, or the air bubble, is received by the movable member 31. Thus, such pressure and air bubble are led to the discharge port side for the fundamental enhancement of the discharging efficiency and discharging power.

Further, the upstream side of the air bubble is also utilized to produce many favorable effects.

Also, with the structure described above, the free end of the movable member 31 effectuates a mechanical displacement instantaneously. This function is also considered to contribute effectively to discharging liquid.

Figure 34:
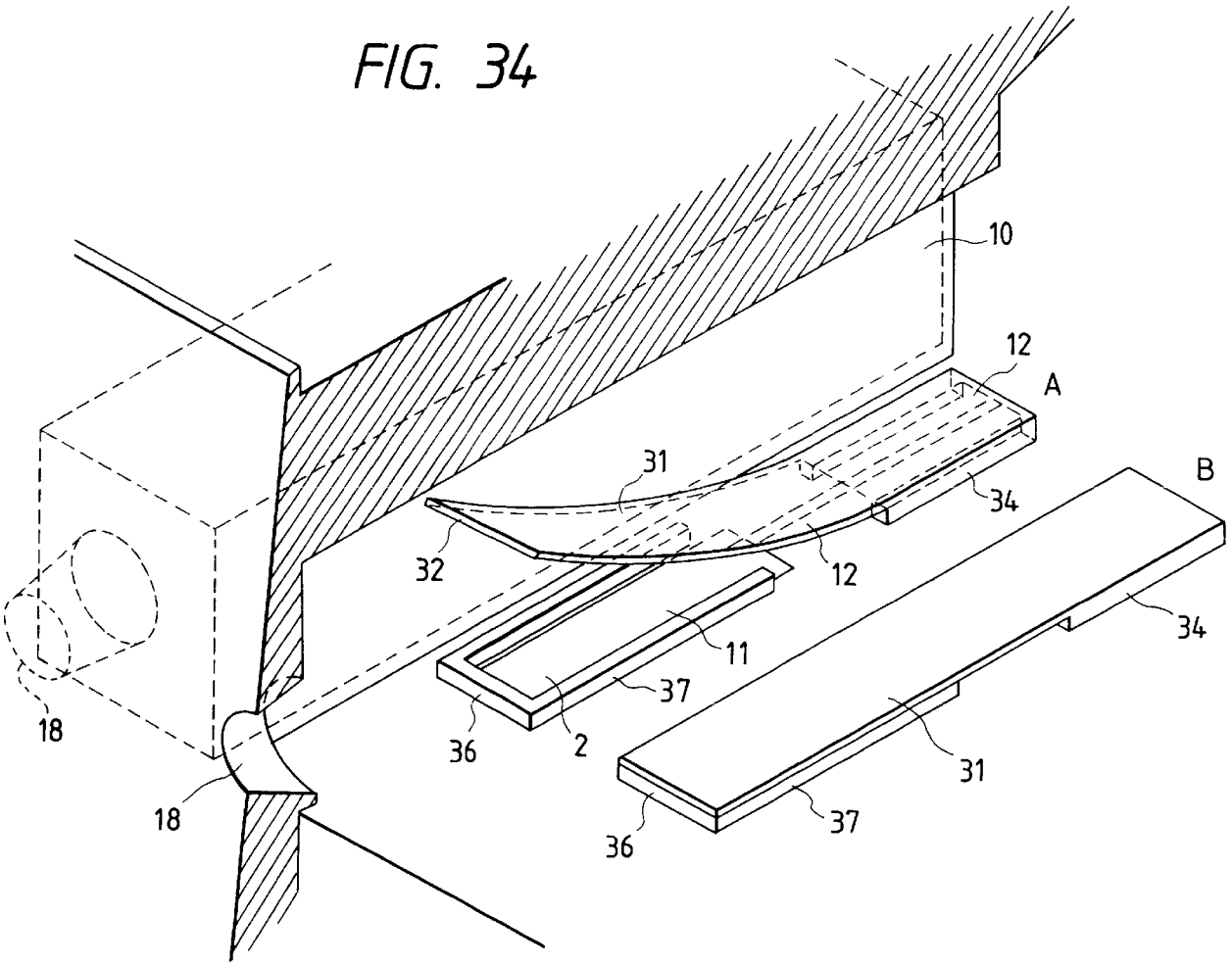
FIG. 34 is a partially broken perspective view which shows a liquid jet head in accordance with the present invention.

FIG. 34 is a partially broken perspective view which shows an ink jet head of another embodiment. In FIG. 34, a reference mark A indicates the state that the movable member is displaced (the air bubble is not shown); B indicated the initial position of the movable member (the first position). In this state at B, it is assumed that the air bubble discharging area 11 is essentially closed. (Here, although not shown, there is a liquid flow wall between A and B to separate one flow path from the other.)

For the movable member 31 shown in FIG. 34, the base 34 is arranged for each of the side ends, and between these two bases, the liquid supply path 12 is provided. Thus, liquid supply becomes possible along the surface of the movable member on the heat generating element side, and also, from the liquid supply path having the surface connected with the surface of the heat generating element substantially flatly or smoothly.

Here, the movable member 31 is closely placed or closely in contact with the downstream wall 36 and side wall 37 of the heat generating element arranged on the downstream side and in the width direction thereof, when the movable member 31 is in the initial position (the first position). Thus, the movable member is essentially closed on the discharge port 18 side of the air bubble generating area 11. Therefore, the pressure exerted by the air bubble at the time of foaming, particularly the pressure on the downstream side of the air bubble, is caused to act upon the free end side of the movable member intensively without allowing it to escape.

Also, at the time of defoaming, the movable member 31 returns to the first position, and the liquid supply to the heat generating element then makes it possible to keep the discharge port side of the air bubble generating area 11 closely closed essentially. As a result, it is possible to suppress the regression of the meniscus and various other effects described in the previous embodiment. Also, for the refilling performance, the same functions and effects are obtainable as in the previous embodiment.

Also, for the present embodiment, the bases 34 that support and fix the movable member 31 as shown in FIG. 30 and FIG. 34 are arranged on the upstream away from the heat generating element 2. At the same time, each width of the bases 34 is made narrower than the liquid flow path 10. Then, the liquid supply is performed to the liquid supply path 12 as described above. Also, the configuration of each base 34 is not necessarily limited to the one shown in this embodiment. It should be good enough if only the bases are configured to make the smooth refilling possible.

In this respect, the gap between the movable member 31 and the heat generating element 2 is set at approximately 15 $\mu$m for the present embodiment, but it should be good enough if only the gap is set in a range that enables the pressure exerted by the creation of the bubble to be transferred to the movable member sufficiently.

Figure 35:
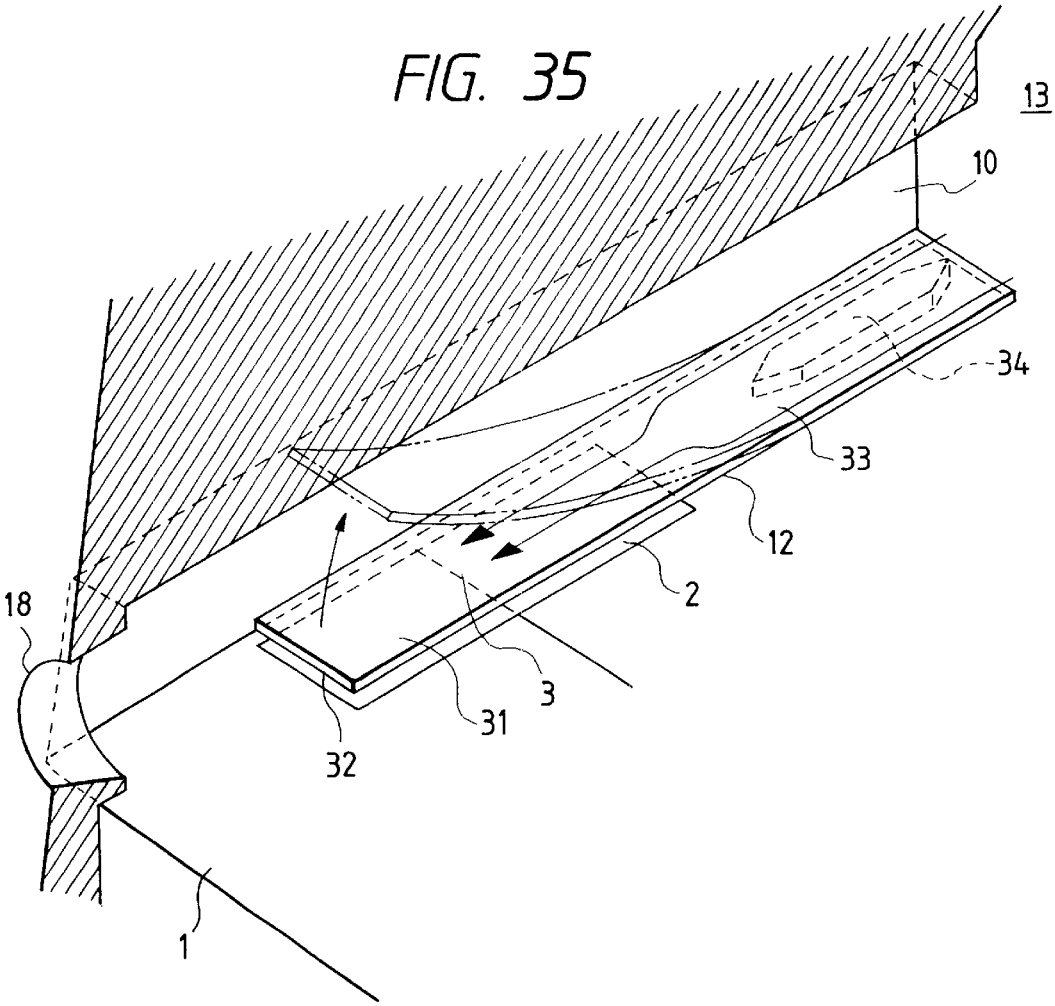
FIG. 35 is a partially broken perspective view which shows a liquid jet head in accordance with the present invention.

FIG. 35 is a partially broken perspective view which shows a liquid jet head in accordance with another embodiment, which represents one of the fundamental concepts of the present invention. FIG. 35 illustrates the positional relationship between the air bubble generating area, the air bubble created therein, and the movable member in one of the liquid flow paths, and at the same time, it shows the liquid discharging method and the refilling method of the present invention for easier understanding.

For many of the embodiments described above, the pressure of the created air bubble is concentrated on the free end of the movable member to attain the concentration of the rapid movement of the movable member and the shift of the air bubble on the discharge port side simultaneously. In contrast, for the present embodiment, the portion of the air bubble on downstream side is regulated by the free end side of the movable member 31, which resides on the discharge port side of the air bubble that directly acts upon the droplet discharge, while giving the degree of freedom to the air bubble to be created.

To describe this embodiment in accordance with the structure shown in FIG. 35 in comparison with the one shown in FIG. 30, there is no provision of the extrusion (portion indicated by slanted lines in FIG. 30) serving as a barrier, which is positioned on the downstream end of the air bubble generating area arranged on the elemental substrate shown in FIG. 30. In other words, the area of the free end and the area of the both side ends of the movable member 31 do not close the air bubble generating area essentially but allow it to open to the discharge port area. This structure represents the present embodiment.

The present embodiment admits of the development of the air bubble at the leading end portion on the downstream side among those on the downstream side acting upon the droplet discharge effectuated by each of the air bubbles. Therefore, the pressure component thereof is effectively utilized for discharging. In addition, the side portions of the free end of the movable member 31 act upon at least the pressure directed above the downstream side portion (components of $V_B$, $V_B$, and $V_B$ in FIG. 31) to enable them to be added to the air bubble development of the leading end portion on the downstream side. Therefore, the discharging efficiency is enhanced as in the previous embodiment described above. The present embodiment is superior to the previous one in the response to the driving of each heat generating element.

Also, the present embodiment has a simpler structure, leading to advantages on the aspect of manufacture.

The fulcrum of the movable member 31 of the present embodiment is fixed on one base 34 having a smaller width with respect to the surface portion of the movable member. Consequently, at the time of defoaming, liquid is supplied to the air bubble area 11 through both sides of this base 34 (see arrows in FIG. 35). This base may be structured in anyway if only it is made possible to secure a good supply capability.

For the present embodiment, the liquid flows in from above the air bubble generating area along the air bubble being defoamed when refilling is performed at the time of liquid supply. However this flow is controlled by the presence of the movable member 31. Therefore, this structure is superior to the conventional structure of the air bubble creation, which is formed only by the heat generating elements. It is of course possible to reduce the regressive amount of meniscus also by the structure thus arranged in accordance with the present embodiment.

As a variational embodiment of the present one, it should be preferably arranged to form the structure so that only both side portions (or either one of them will do) of the free end of the movable member essentially close the air bubble generating area 11. With such structural arrangement, the pressure directed to the side ends of the movable member 31 is converted into the pressure applicable to the development of the air bubble on the discharge port side as described earlier, thus enhancing the discharging efficiency still more.

Now, the discharging principle applicable to the present invention has been described in accordance with the liquid jet head having each of single flow paths using the same liquid as for the liquid that foams and the liquid that is caused to be discharged by the application of heat. Subsequently, the description will be made in conjunction with a two-flow path liquid jet head. For this head, the main principle of liquid discharge applicable thereto is the same, but liquid for foaming by the application of heat (foaming liquid) and liquid for use of discharge (discharging liquid) are separated.

Figure 36:
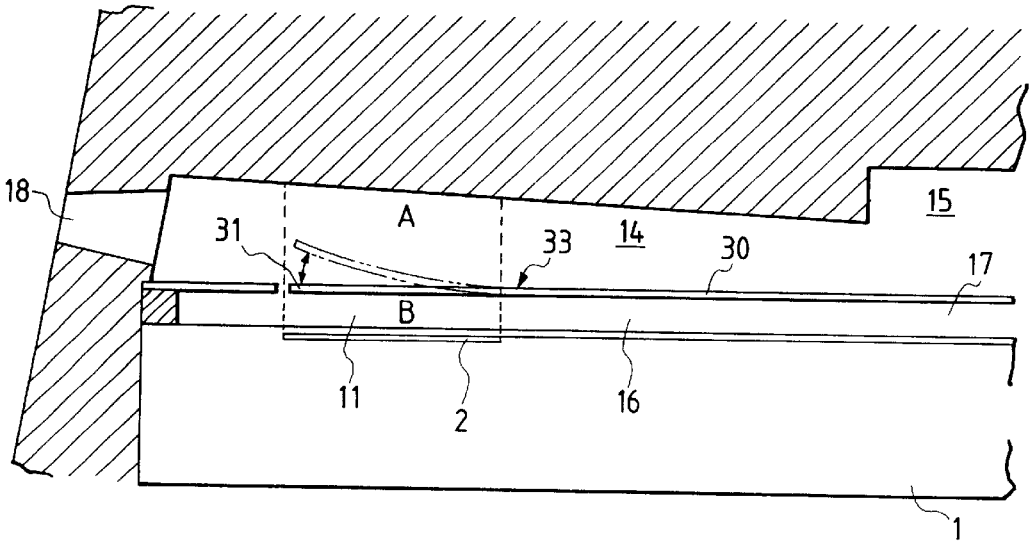
FIG. 36 is a cross-sectional view schematically showing a liquid jet head (two-flow path structure) in accordance with the present invention.
Figure 37:
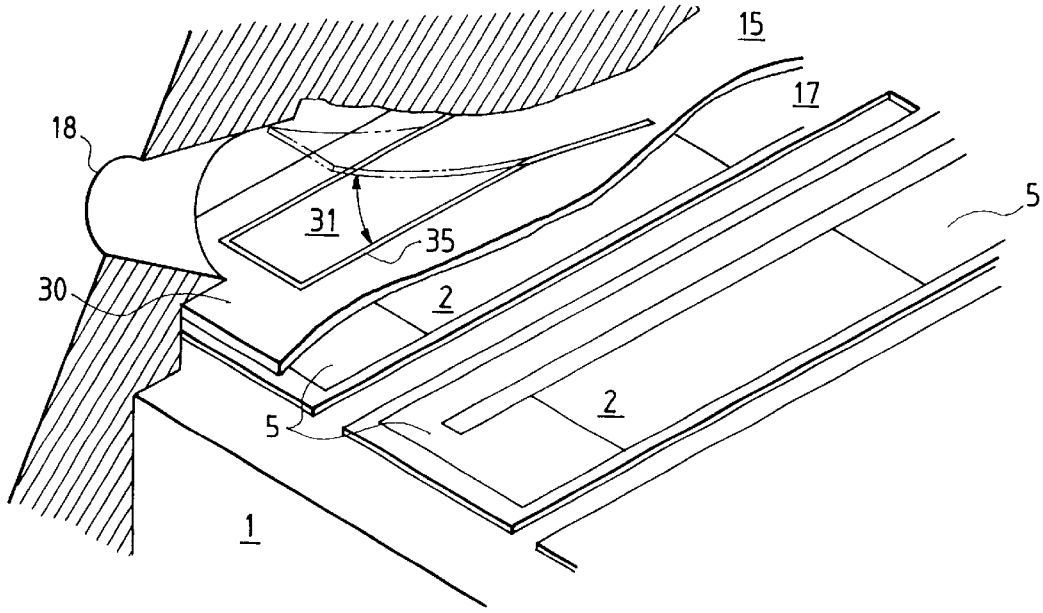
FIG. 37 is a partially broken perspective view which shows a liquid jet head (two-flow structure) in accordance with the present invention.

FIG. 36 is a cross-sectional view schematically showing the liquid jet head using two flow paths. FIG. 37 is a partially broken perspective view which shows the liquid jet head represented in FIG. 37.

For the two-flow path liquid jet head, each of the second liquid flow paths 16 for use of foaming is arranged on the elemental substrate 1 having the heat generating elements 2 arranged on it to apply thermal energy to liquid for the creation of air bubbles, and on this liquid flow path, each of the first liquid flow paths 14 for use of discharging liquid is arranged, which is directly and conductively connected with each of the discharge ports 18.

The upstream side of the first liquid flow path is conductively connected with the first common liquid chamber 15 for supplying liquid to a plurality of first liquid flow paths. The upstream side of the second liquid flow path is conductively connected with the second common liquid chamber 17 for supplying bubbling liquid to a plurality of second liquid flow paths.

However, if the same liquid is used as bubbling liquid and discharging liquid, it may be possible to arrange one common liquid chamber for sharable use.

Between the first and second liquid flow paths, a separation wall 30, which is formed by elastic metal or the like, is arranged to partition the first liquid flow path and the second liquid flow path. In this respect, when bubbling liquid and discharging liquid should not be mixed as far as the circumstances permit, it is preferable to separate the distributions of liquid completely for the first liquid flow path 14 and the second liquid flow path 16 as much as possible. However, if there is no problem even if bubbling liquid and discharging liquid are mixed to a certain extent, it may be unnecessary to provide the separation wall with such function as to separate them completely.

The portion of the separation wall, which is positioned in the projection space formed upward in the surface direction of the heat generating element (hereinafter referred to as discharge pressure generating area; the area at A and the air bubble generating area 11 at B in FIG. 36), is arranged to be in the form of a movable member 31 held in a cantilever fashion having its free end on the discharge port side (on the downstream side of the liquid flow) by means of a slit 35, and its fulcrum 33 on the common liquid chambers (15 and 17) side. Since the movable member 31 is arranged to face the air bubble generating area 11 (at B in FIG. 36), it operates to be open toward the discharge port side of the first liquid flow path side by foaming of the bubbling liquid (that is, in the directions indicated by arrows in FIG. 36).

In FIG. 37, too, on the elemental substrate 1, which is provided with the heat generating resistors (electrothermal transducing elements) serving as heat generating elements 2, and wire electrodes 5 to apply electric signals to each of the heat generating resistors, the separation wall 30 is arranged through the space that constitutes the second liquid flow path.

The relationship between the arrangement of the fulcrum 33 and free end 32 of the movable member 31, and that of the heat generating element are made equal to those described in conjunction with the one-flow path head. Also, the description is made for the structural relationship between the liquid supply path 12 and the heat generating element 2 for the one-flow path head. For the two-flow head, too, the same structural relationship is adopted between the second liquid flow path 16 and the heat generating element 2.

Now, in conjunction with FIGS. 38A and 38B, the description will be made of the operation of the two-flow path liquid jet head.

To drive the head, the same water ink is used as discharging liquid to be supplied to the first liquid flow path 14, and as bubbling liquid to be supplied to the second liquid flow path 16.

When heat is generated by the heat generating element 2 to act upon bubbling liquid residing in the air bubble generating area 11 of the second liquid flow path 16, the air bubble 40 is created by means of the film boiling phenomenon brought about in foaming liquid, such as disclosed in the specification of U.S. Pat. No. 4,723,129.

Figure 38A:
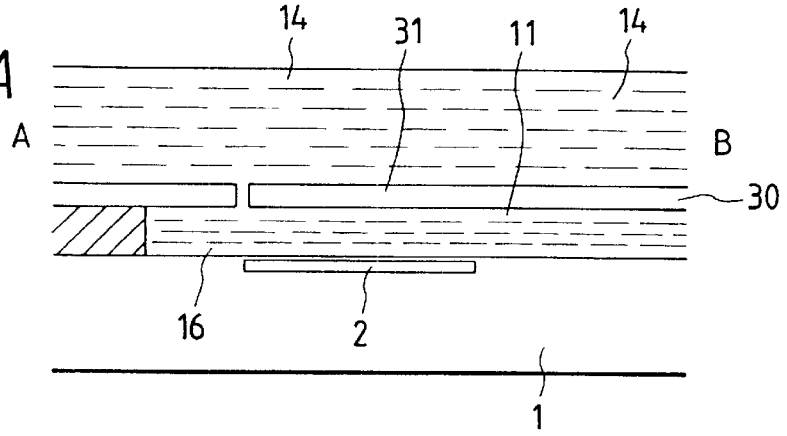
FIGS. 38A and 38B are views which illustrate the operation of a movable member.
Figure 38B:
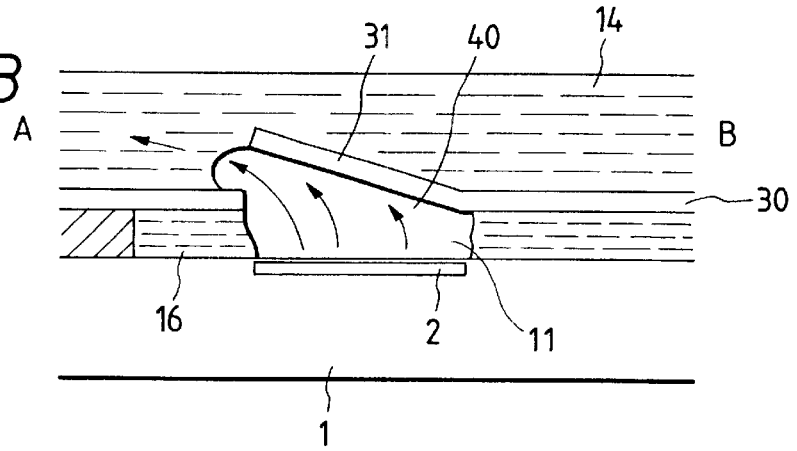

In accordance with the two-flow head, since no foaming pressure escapes from three directions with the exception of the upstream side of the air bubble generating area, the pressure exerted by this air bubble creation is propagated intensively on the movable member 31 side arranged on the discharge pressure generating area, thus the movable member 31 is displaced from the state shown in FIG. 38A to the first liquid flow path side as shown in FIG. 38B. By this operation of the movable member 31, the first liquid flow path 14 and the second liquid flow path 16 are conductively connected largely, and the pressure exerted by the air bubble creation is transferred mainly to the discharge port side of the first liquid flow path in direction of the discharge port side (direction A). With this propagation of pressure and the mechanical displacement of the movable member 31 as described above, liquid is discharged from each of the discharge ports.

Now, along the contraction of the air bubble, the movable member 31 returns to the position shown in FIG. 38A. Then, discharging liquid is supplied in the first liquid flow path 14 from the upstream side in an amount corresponding to the amount of discharge liquid that has been discharged. For the two-flow path head, too, since the supply of the discharging liquid is made in the direction of the movable member 31 being closed as in the previous example described earlier, there is no possibility that the refilling of discharging liquid is hindered by the presence of the movable member 31.

The functions and effects of the principal part of the two-flow head are the same as those of the one-flow head with respect to the propagation of foaming pressure following the displacement of the movable member 31, the developing direction of the air bubble, the prevention of back waves, and the like. However, with the adoption of the two-flow structure, the advantages are further obtainable as given below.

In other words, with the two-flow structure, it is possible to discharge the discharging liquid by pressure exerted by the foaming of the foaming liquid, while using the discharging liquid and bubbling liquid as different liquids. Therefore, liquid having high viscosity, such as polyethylene glycol whose discharging power is insufficient to make sufficient foaming difficult even by the application of heat, is also discharged in good condition by supplying the liquid, which effectuates good foaming in bubbling liquid (such as a mixture of ethanol: water=4:6 of approximately 1 to 2 cp) or the liquid, which presents a low boiling point, to the second liquid flow path, while supplying such highly viscous liquid to the first liquid flow path.

Also, as foaming liquid, it is possible to select liquid that does not produce burning or other deposits on the surface of the heat generating elements when receiving heat, thus stabilizing foaming for discharging in good condition.

Further, with the head having the two-flow structure, it is possible to obtain such effects as described with respect to the one-flow head. As a result, the adoption of the two-flow structure contributes to obtaining further enhancement of the discharging efficiency and discharging power when discharging such liquid as having a higher viscosity or the like.

Also, even when using a liquid whose properties are weak against the application of heat, it is possible to discharge it with high discharging efficiency and high discharging power without giving any thermal damage to such liquid by supplying it to the first liquid flow path as discharging liquid, while supplying the liquid, which is capable of being foamed in good condition without changing its properties thermally, to the second liquid flow path.

Now, with reference to the accompanying drawings, the description will be made of the embodiments in accordance with the present invention.

For the embodiments which will be described hereinafter, the principle applicable to discharging main liquid is the same as the one described as above. Here, the following embodiments will be described using the aforesaid two-flow path liquid jet head. However, the present invention is not necessarily limited to it. The invention is equally applicable to the one-flow path liquid jet head.

At first, in accordance with the embodiment 1 to embodiment 7, the description will be made of means for arranging the air bubble generating area intensively on the free end side of the movable member.

(Embodiment 1)

Figure 1:
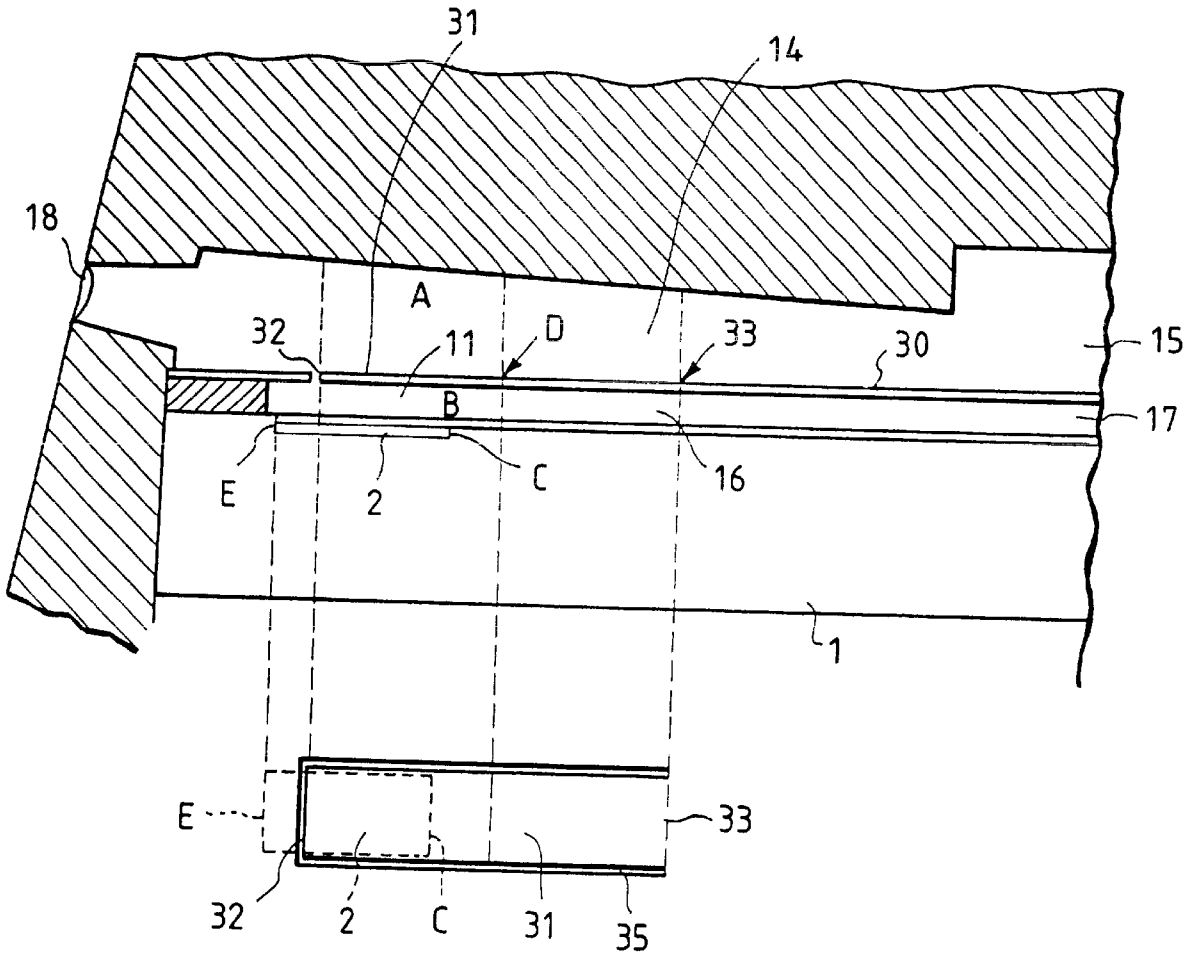
FIG. 1 is a cross-sectional view schematically showing the case where the end of the heat generating element of the liquid jet head of the first embodiment on the discharge port side is positioned nearer to the discharge port than the free end of the movable member.
Figure 2:
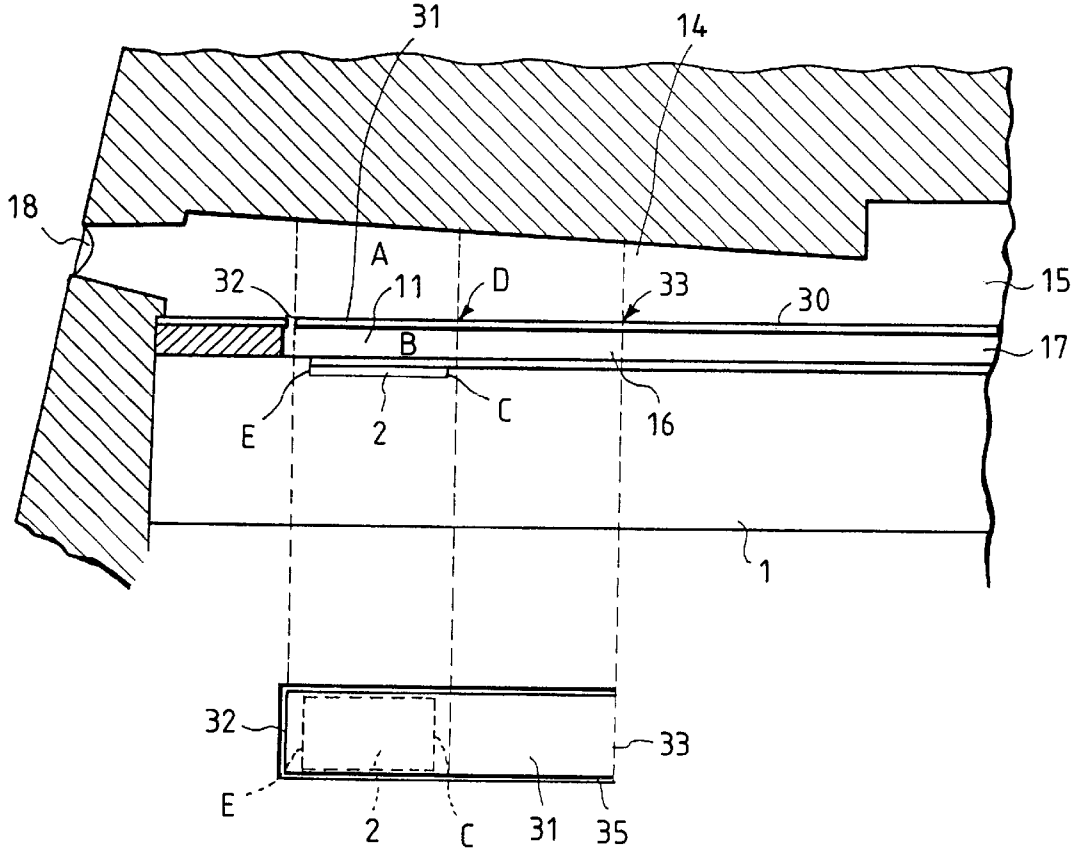
FIG. 2 is a cross-sectional view schematically showing the case where the end of the heat generating element of the liquid jet head of the first embodiment on the discharge port side is positioned farther from the discharge port than the free end of the movable member.
Figure 3:
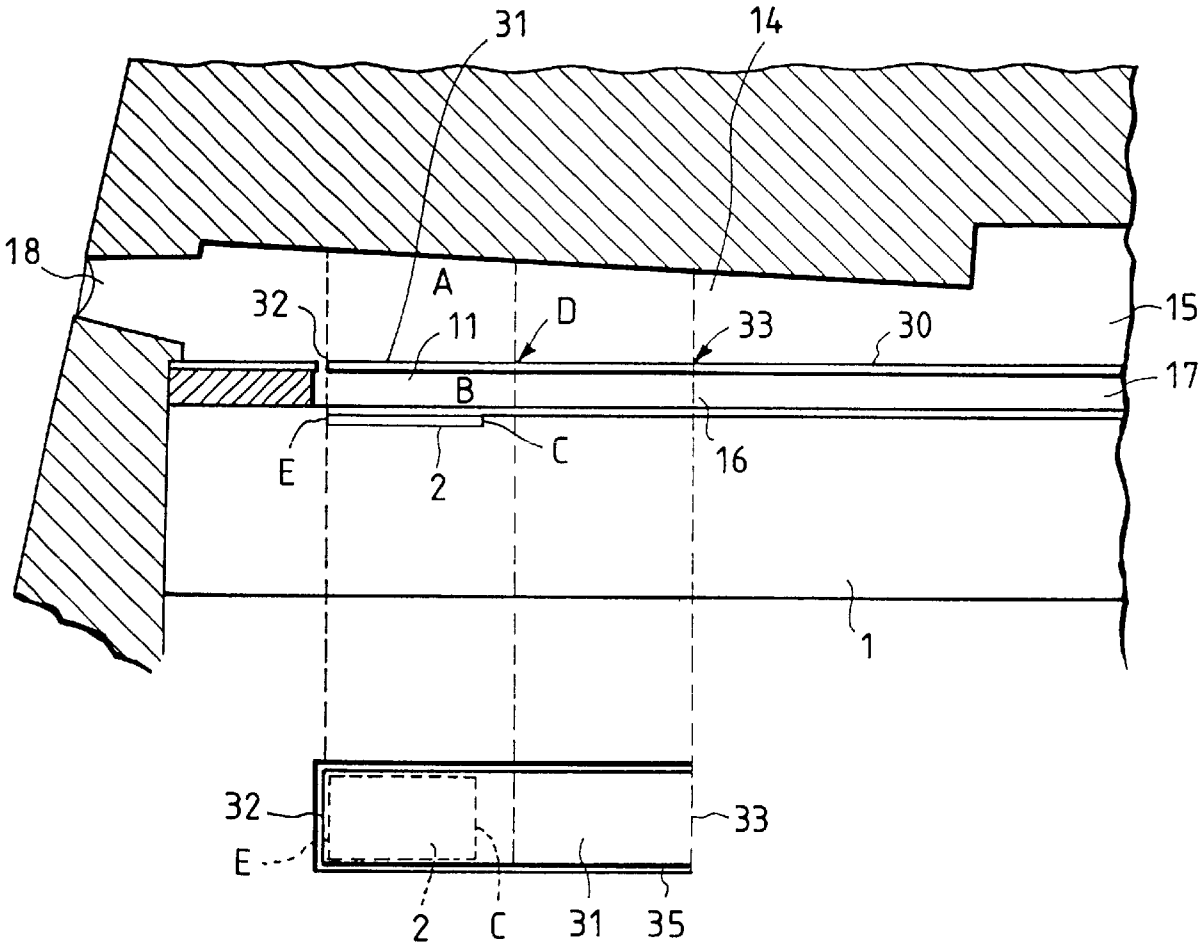
FIG. 3 is a cross-sectional view schematically showing the case where the end of the heat generating element of the liquid jet head of the first embodiment on the discharge port side is positioned equal to the free end of the movable member.

FIG. 1 to FIG. 3 are cross-sectional views which schematically illustrate the liquid jet head of the present embodiment, taken in the direction of the flow path thereof, which represents the relationship between the arrangements of the movable member and heat generating element. Here, in the description of principle as above, the structure of the liquid jet head of the present embodiment has already been referred to in detail. Therefore, the description thereof will be omitted.

For the liquid jet head of the present embodiment, there is arranged each of the second liquid flow paths 12 on the elemental substrate 1 having heat generating elements 2 (each in a size of 40×105 $\mu$m) on it to provide thermal energy for the creation of air bubbles. On the second liquid flow path, the first liquid flow path 14, which is conductively connected with the discharge port 18, is arranged.

The size of the movable member 31 is 53×220 $\mu$m, which is formed by Ni plate of 5 $\mu$m thick.

The first liquid flow path 14 is conductively connected with the first common liquid chamber 15. The second liquid flow path 16 is conductively connected with the second common liquid chamber 17.

In this respect, if the bubbling liquid and the discharging liquid are the same, one common liquid chamber may be arranged for sharable use.

For the present embodiment, the end C of the heat generating element 2 on the side opposite to the discharge port 18 is arranged on the free end side of the center D of the movable member 31 in the flow path direction. Here, the movable member 31 is a cantilever type flat plate formed on the separation wall 30, and the end of such movable member on the discharge port side is arranged to be the free end 32, and the end thereof on the common liquid chambers 15 and 17 sides is arranged to be the fulcrum 33 by the provision of the slit 35. The center D of the movable member 31 in the flow path direction means the central position between the free end 32 and the fulcrum 33.

Also, as shown in FIG. 1, the arrangement of the heat generating element 2 is such that if the end E of the heat generating element 2 on the discharge port side is arranged to be nearer to the discharge port side than the free end 32 of the movable member 32, the free end is displaced efficiently, because the pressure of the air bubble is concentrated on the free end side. On the contrary, as shown in FIG. 2, the free end 32 of the movable member 31 may be arranged to be on the discharge port side. Further, as shown in FIG. 3, if the end E of the heat generating element on the discharge port side is arranged to be directly beneath the free end 32 of the movable member 31, the air bubble itself is led in the discharging direction efficiently, while the pressure of the air bubble is being caused to act upon the leading end portion of the free end. Also, in FIG. 1 to FIG. 3, the end C of the heat generating element 2 on the side opposite to the discharge port 18 resides on the free end side of the center D of the movable member 31. However, it may be possible to position this end in agreement with the position of the center D. In other words, for the present invention, the free end side of the center D of the movable member 31 means the free end side including the position of the center D.

Now, in conjunction with FIGS. 4A and 4B, the operation of the two-flow path liquid jet head of the present embodiment will be described.

Figure 4A:
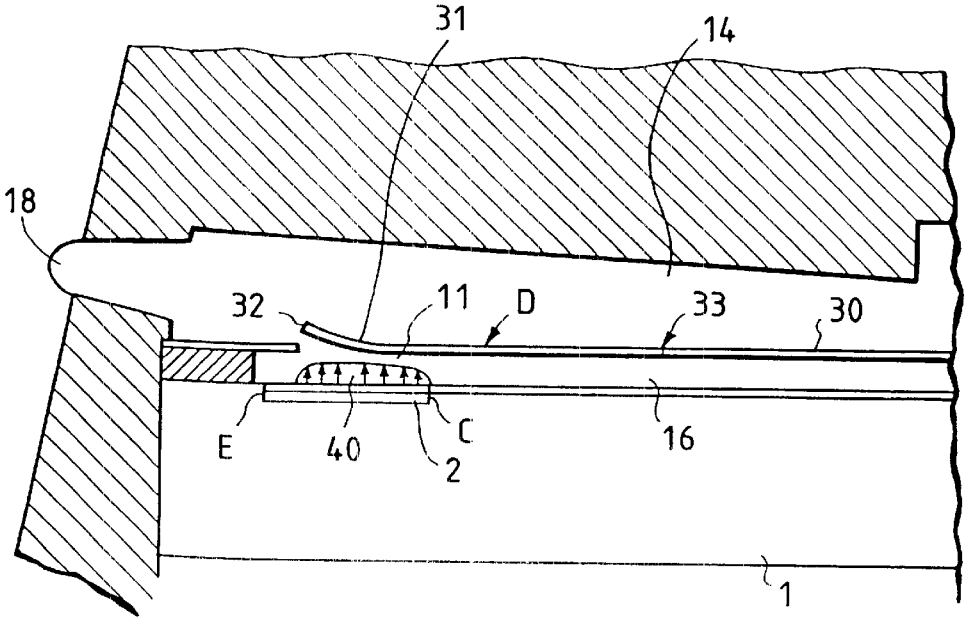
FIGS. 4A and 4B are views which illustrate the operation of the movable member.
Figure 4B:
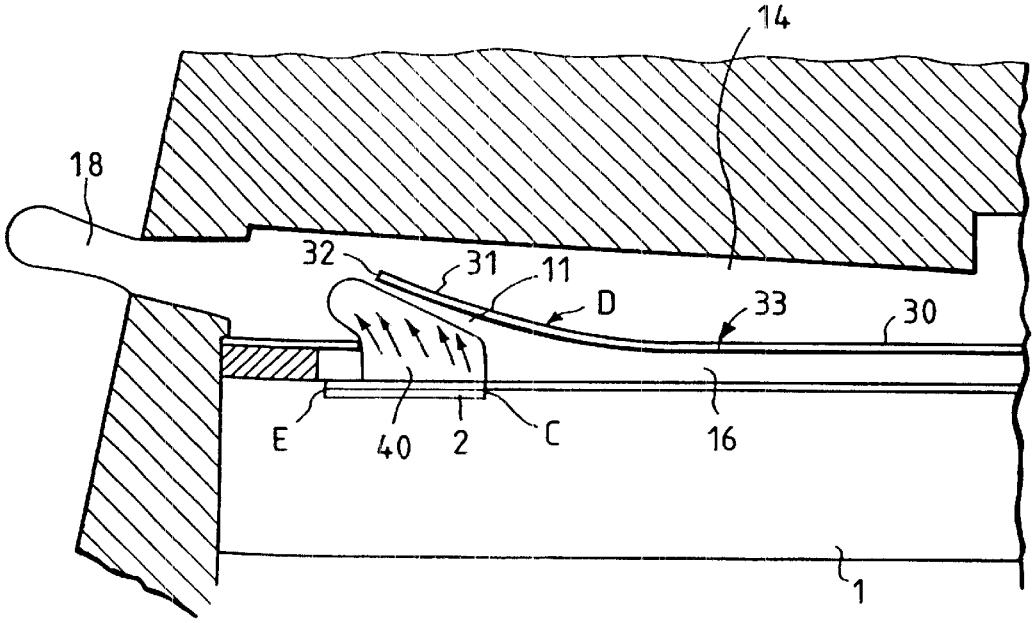

FIG. 4A shows the state of the moment voltage is applied to the heat generating element 2, and heat thus generated is transferred to liquid on the air bubble generating area 11 on the second flow path 16, hence the air bubble 40 being created in the liquid. Here, since the end C of the heat generating element 2 on the side opposite to the discharge port 18 is arranged to be on the free end 32 side of the center D of the movable member 31, the pressure of the air bubble 40 is added to the area on the free end side of the center D of the movable member 31. Consequently, the balance of pressure exerted on the movable member 31 as a whole becomes larger on the free end side, which enables the free end area to be displaced at the beginning. FIG. 4B shows the states subsequent to the state shown in FIG. 4A. The air bubble 40 is further developed. Along such development of the air bubble, the movable member 31 is further displaced. The air bubble 40 is developed in the discharging direction along the displacing configuration of the movable member 31, thus enhancing the discharging power and discharging efficiency stably. Particularly, in accordance with the present embodiment, the displacement is promoted by adding the pressure of the air bubble 40 to the ½ area of the movable member from the free end side thereof. As a result, the free end 32 of the movable member 31 is displaced largely as shown in FIG. 4B to enable the air bubble 40 to reach the discharge port 18 in good condition quickly and efficiently. At the same time, such good condition is maintained for the displacement as a whole to enhance the discharging efficiency stably. Also, the displacement of the movable member 31 can be performed smoothly to make it possible to enhance the durability of the movable member 31.

(Embodiment 2)

Figure 5:
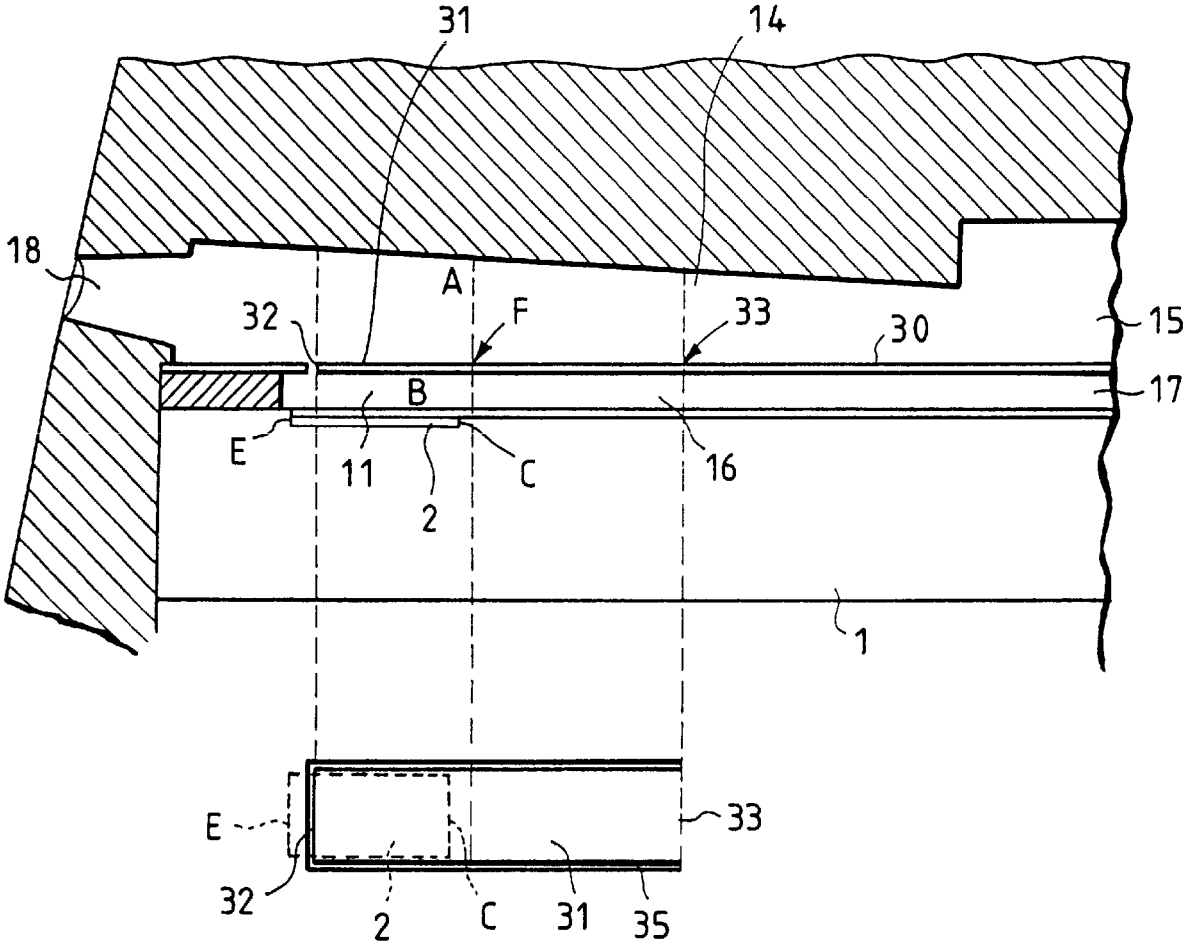
FIG. 5 is a cross-sectional view schematically showing the case where the end of the heat generating element of the liquid jet head of the second embodiment on the discharge port side is positioned nearer to the discharge port than the free end of the movable member.
Figure 6:
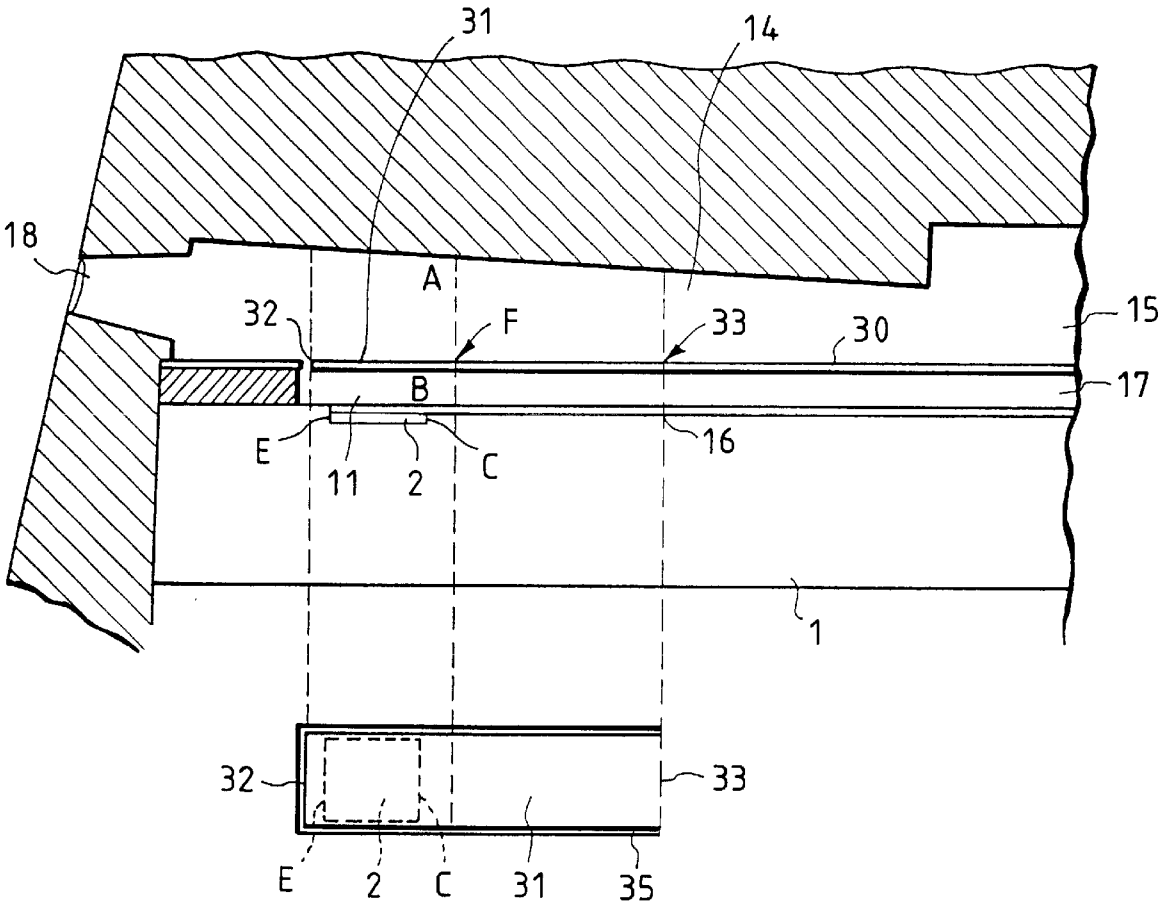
FIG. 6 is a cross-sectional view schematically showing the case where the end of the heat generating element of the liquid jet head of the second embodiment on the discharge port side is positioned farther from the discharge port than the free end of the movable member.
Figure 7:
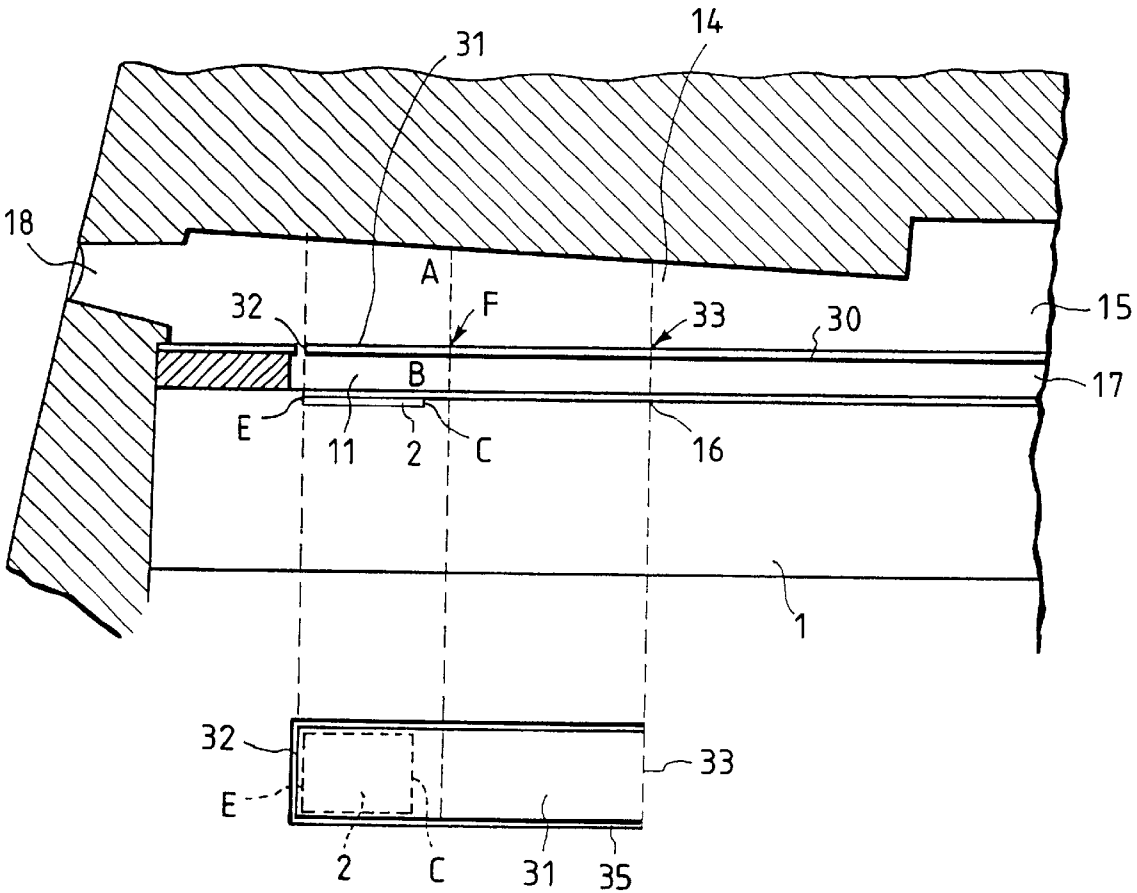
FIG. 7 is a cross-sectional view schematically showing the case where the end of the heat generating element of the liquid jet head of the second embodiment on the discharge port side is positioned equal to the free end of the movable member.

FIG. 5 to FIG. 7 are cross-sectional views which schematically illustrate the liquid jet head of the present embodiment, taken in the direction of the flow path thereof, which represents the relationship between the arrangements of the movable member and heat generating element. Here, in the description of principle, the structure of the liquid jet head of the present embodiment has already been referred to in detail. Therefore, the description thereof will be omitted.

For the present embodiment, the heat generating element 2 is arranged in a size of 40×85 μm, and the movable member, 53×220 μm.

For the present embodiment, the end C of the heat generating element 2 on the side opposite to the discharge port 18 is arranged on the free end side of the point F that divides the movable member 31 in the ratio of 2:3 from the free end. In this respect, the movable member 31 is a cantilever type flat plate formed on the separation wall 30, and the end of such movable member on the discharge port side is arranged to be the free end 32, and the end thereof on the common liquid chambers 15 and 17 sides is arranged to be the fulcrum 33 by the provision of the slit 35. The point F that divides the movable member 31 in the ratio of 2:3 from the free end means the position from the free end 32 between the free end 32 and the fulcrum 33.

Also, as shown in FIG. 5, the arrangement of the heat generating element 2 may be such that the end E of the heat generating element 2 on the discharge port side is arranged to be nearer to the discharge port side than the free end 32 of the movable member 31 or on the contrary, this arrangement may be such that as shown in FIG. 6, the free end 32 of the movable member 31 is arranged to be nearer to the discharge port side. Further, as shown in FIG. 7, the end E of the heat generating element on the discharge port side may be arranged to be directly beneath the free end 32 of the movable member 31. Also, in FIG. 5 to FIG. 7, the end C of the heat generating element 2 on the side opposite to the discharge port 18 resides on the free end side of the point F that divides the movable member 31 in the ratio of 2:3 from the free end side. However, it may be possible to position this end in agreement with such point of 2:3 division. In other words, for the present invention, the free end side of the point F that divides the movable member 31 in the ratio of 2:3 from the free end means the free end side including the point F. In accordance with the present embodiment, the pressure of the air bubble 40 is added to the ⅖ area of the movable member 31 from the free end. Therefore, as compared with the first embodiment, the balance of the pressure exerted on the movable member 31 becomes still larger on the free end side, to make it easier for the free end to be displaced. As a result, the pressure at the time of foaming and the development of the air bubble are led in the discharging direction efficiently. At the same time, the displacement of the movable member 31 is performed smoothly to enhance the durability of the movable member 31.

Also, if the heat generating element is arranged to exert the pressure of the air bubble on the movable member so that the portion of the free end that receives such pressure and the portion that does not receive it are divided approximately fifty-fifty as in the first embodiment, there are some cases where although slightly, vibration takes place on the movable member. In other words, there is a probability that harmonic vibration occurs on the movable member itself with the free end, the fulcrum, and the center being as three nodes of such vibration. In such a case, the displacing configuration of the movable member is slightly affected.

However, if the portion that receives the pressure of the air bubble and the portion that does not receive it are positioned on the free end side of the center of the movable member in the elementary relations of 2:3 as in the present embodiment, no harmonic vibration takes place easily. Therefore, the displacement condition of the movable member is stabilized to enhance the discharging efficiency stably. In this respect, even when the arrangement is not in the elementary relations, the component of harmonic vibration becomes larger than two times if the ratio between the presence and absence of pressure is large. Therefore, its influence becomes substantially smaller, and the discharging efficiency is enhanced eventually.

In this respect, the air bubble generating area of the heat generating element of the first and second embodiments is approximately 1 to 8 μm inside from the pattern edge, because the temperature distribution of the heat generating element becomes low on the edge portion thereof. With this in view, the heater end should be handled including up to 8 μm from the actual edge of the heater.

Here, also, the ends E and C of the heat generating element 2 of the first and second embodiments include the area of 1 to 8 μm inside the pattern edge.

(Embodiment 3)

Figure 8A:
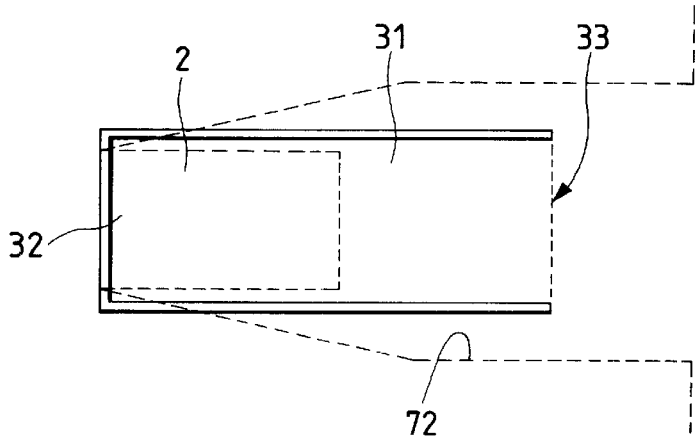
FIGS. 8A and 8B are views schematically showing a liquid jet head in accordance with the third embodiment of the present invention.
Figure 8B:
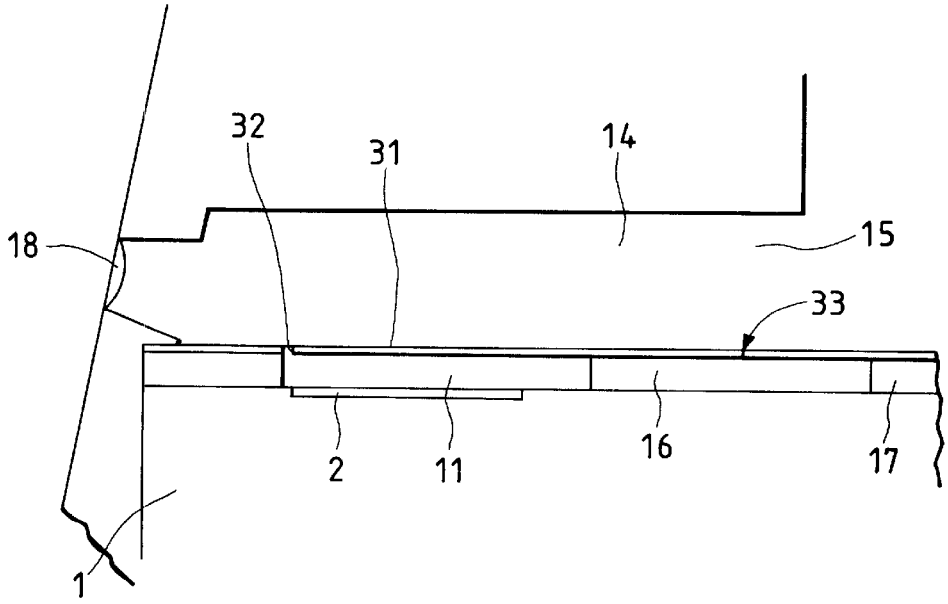

FIGS. 8A and 8B are views which schematically illustrate a liquid jet head in accordance with the present embodiment. FIG. 8A is a view showing the structure of the movable member, the heat generating element, and the liquid flow path of the head. FIG. 8B is a cross-sectional view of the head, taken in the flow direction. Here, in the description of principle, the structure of the liquid jet head of the present embodiment has already been referred to in detail. Therefore, the description thereof will be omitted.

For the liquid jet head of the present embodiment, there is arranged each of the second liquid flow paths 12 on the elemental substrate 1 having heat generating elements 2 on it to provide thermal energy for the creation of air bubbles. On the second liquid flow path, the first liquid flow path 14, which is conductively connected with the discharge port 18, is arranged. The first liquid flow path 14 is conductively connected with the first common liquid chamber 15. The second liquid flow path 16 is conductively connected with the second common liquid chamber 17.

In this respect, if the bubbling liquid and the discharging liquid are the same, one common liquid chamber may be arranged for sharable use.

For the present embodiment, the wall 72 of the second liquid flow, which becomes the side wall of the heat generating element 2, is made narrower in the form of taper in the direction of discharge port as shown in FIG. 8A. The heat generating element 2 on the side opposite to the discharge port 18 is arranged on the free end side of the center D of the movable member 31 in the flow path direction.

Now, in conjunction with FIGS. 9A and 9B, the operation of the liquid jet head of the present embodiment will be described.

Figure 9A:
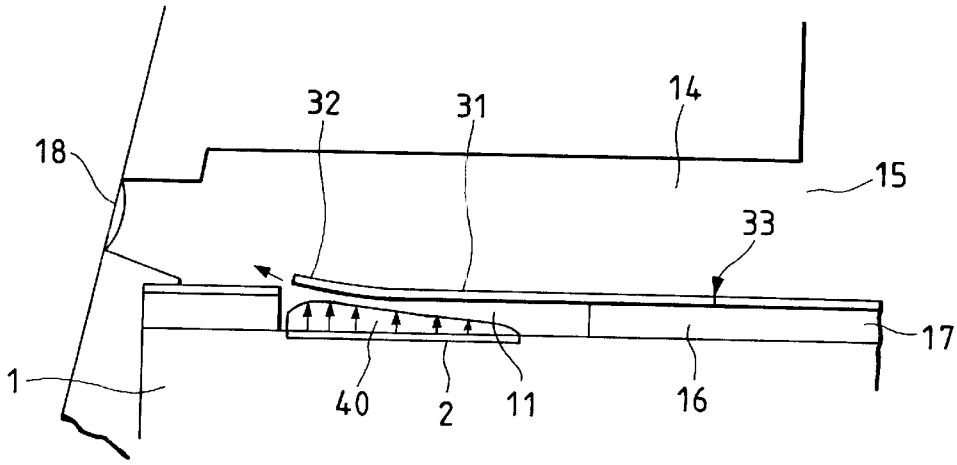
FIGS. 9A and 9B are views which illustrate the operation of the liquid jet head in accordance with the third embodiment of the present invention.

FIG. 9A shows the state of the moment voltage is applied to the heat generating element 2, and heat thus generated is transferred to liquid on the air bubble generating area 11 on the second flow path 16, hence the air bubble 40 being created in the liquid.

Here, the portion of the pressure of the air bubble created by the application of heat generated by the heat generating element 2 on the side nearer to the discharge port 18 is suppressed so that it does not expand in the side wall direction. Therefore, the development of the air bubble in the direction of the movable member is larger than the portion of the air bubble 40 residing in the side nearer to the fulcrum side of the movable member 31. Consequently, the pressure of the air bubble 40, which is propagated to the movable member 31, is caused to act greater in the area nearer to the free end 32 portion. In this way, the free end 32 begins to be displaced earlier than any other parts of the movable member 31.

Figure 9B:
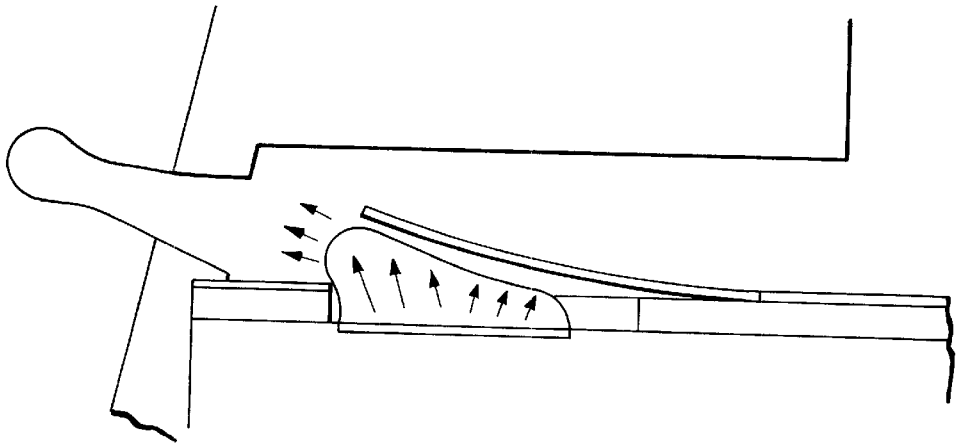

FIG. 9B shows the state subsequent to the one represented in FIG. 9A. The air bubble 40 is further developed. Along such development of the air bubble, the movable member 31 is further displaced as a whole. The air bubble 40 is developed in the discharging direction along the displacing configuration of the movable member 31, thus enhancing the discharging power and discharging efficiency stably. Particularly, in accordance with the present embodiment, the displacement is promoted by the application of higher pressure to the vicinity of the free end. As a result, the free end 32 of the movable member 31 is displaced largely to enable the air bubble 40 to reach the discharge port 18 in good condition quickly and efficiently, thus making it possible to enhance the discharging efficiency stably with respect to the overall displacement operation of the movable member 31. Also, the displacement of the movable member 31 can be performed smoothly, which contributes to enhancing the durability of the movable member 31.

(Embodiment 4)

Figure 10A:
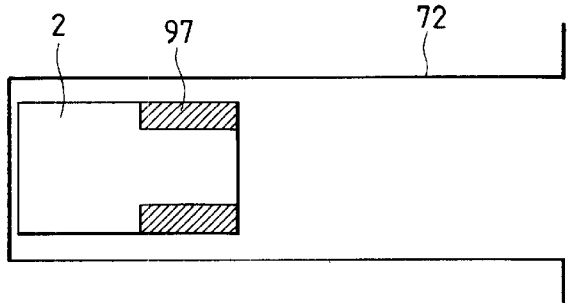
FIGS. 10A, 10B and 10C are views showing the structure of the heat generating element of a liquid jet head in accordance with the fourth embodiment of the present invention, observed from the first liquid flow side.
Figure 10B:
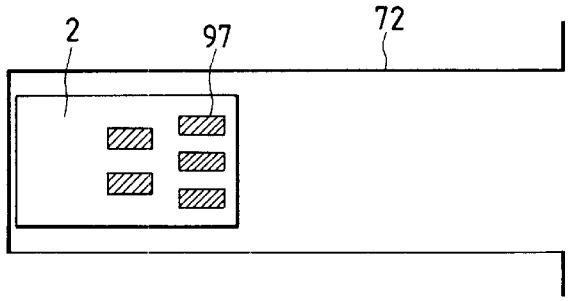
Figure 10C:
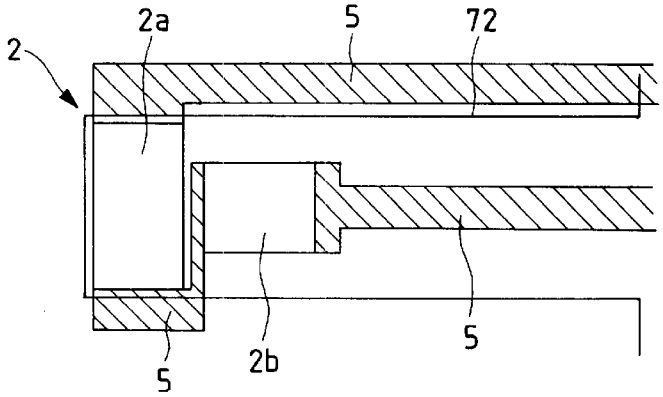

FIGS. 10A to 10C are views which illustrate the structure of the head generating element of a liquid jet head in accordance with the present embodiment, observed from the second liquid flow path side. The heat generating element of this liquid jet head is structured to apply a large pressure to the free end 32 area of the movable member 31 as in the third embodiment.

As shown in FIG. 10A, the heat generating element 2 is arranged between the walls 72 of the second liquid flow path that become the side walls.

For the head shown in FIG. 10A, on both side ends of the heat generating element 2 on the side opposite to the discharge port 18 on the surface thereof that is in contact with the second liquid flow path 16, mask patterns 97 are arranged to block the creation of air bubble 40.

For the head shown in FIG. 10B, the number of the mask patters 97 that blocks the creation of the air bubble 40 increases as the patterns are arranged further from the discharge port 18 in the surface of the heat generating element 2, which is in contact with the second liquid flow path 16.

For the head shown in FIG. 10C, the heat generating element 2 is divided into two heat generating elements 2*a* and 2*b* that generate heat at the same time. Of theses two, the area of the heat generating element on the free end side is made larger. Here, a reference numeral 5 designates the wire electrode arranged for the heat generating element 2.

Now, the description will be made of the operation of the liquid jet head of the present embodiment.

For the liquid jet heads shown in FIG. 10A and FIG. 10B, the mask patterns 97 are not arranged for each of them on the discharge port side. Also for the head shown in FIG. 10C, the heat generating element 2 is divided into two heat generating elements 2*a* and 2*b*, while the area of the one on the free end side is made larger. Therefore, the pressure of the air bubble 40, which is transferred to the movable member 31, is caused to act greater in the vicinity of the free end 32, thus enabling the free end 32 to be displaced earlier than the other portion of the movable member.

The aspect of the operation and the effect are the same as those of the third embodiment. However, in the case of the present embodiment, the distribution of pressure of the air bubble 40 can be controlled more precisely with respect to the free end 32 of the movable member 31 and others. As a result, the discharging efficiency is enhanced still more. Also, for the head shown in FIG. 10C, no mask patter 97 is arranged. The energy loss is less to that extent. The energy efficiency is improved accordingly.

(Embodiment 5)

Figure 11A:
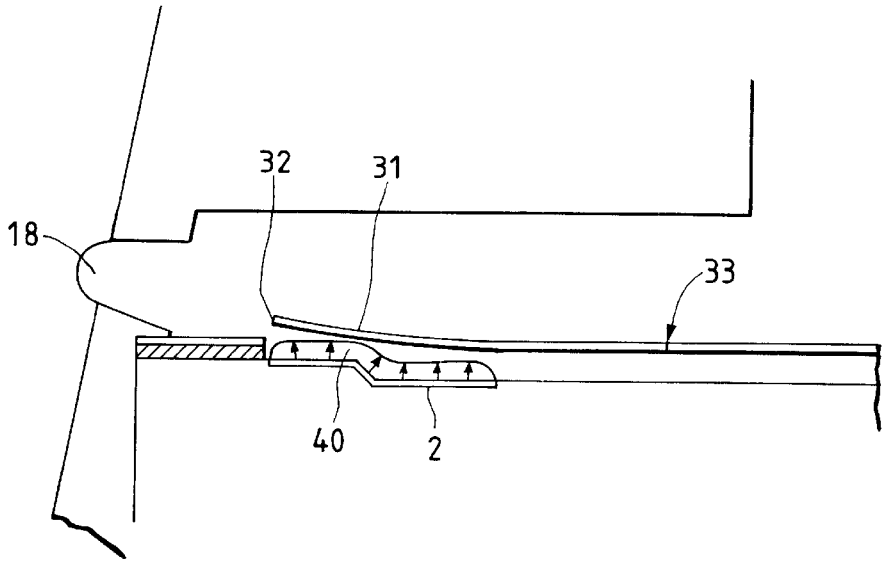
FIGS. 11A and 11B are cross-sectional views schematically showing a liquid jet head in accordance with the fifth embodiment of the present invention.
Figure 11B:
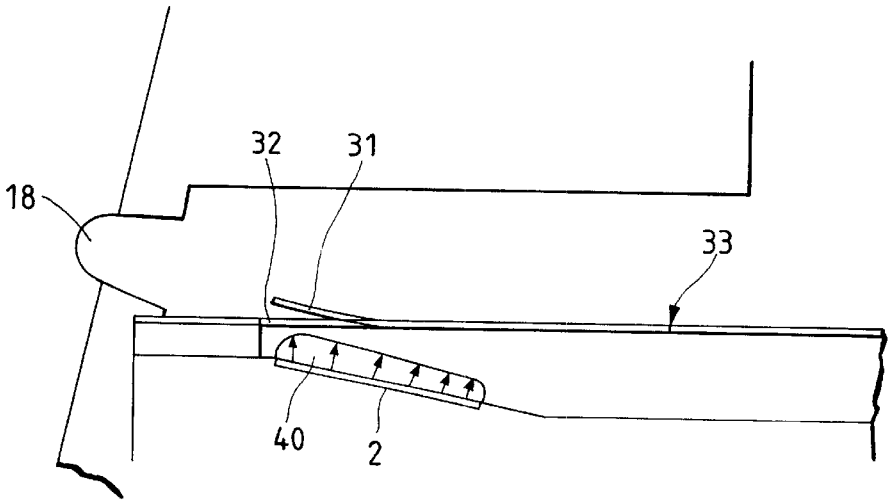

FIGS. 11A and 11B are cross-sectional views which schematically illustrate a liquid jet head in accordance with the present embodiment, which represent the structure of the liquid jet head for the application of a larger pressure to the free end 32 of the movable member 31 as in the fourth embodiment.

The heat generating element 2 of the head is structured to enable the portion of the heat generating element 2 nearer to the discharge port to approach the movable member 31 more closely in accordance with the present embodiment. In other words, for the head shown in FIG. 11A, there is arranged a step so that the distance between the heat generating element 2 and the movable member 31 is made shorter on the portion closer to the discharge port 18. Also, For the head shown in FIG. 11B, the heat generating element 2 is tapered so as to make the distance between the heat generating element 2 and the movable member 31 shorter in the portion closer to the discharge port 18. With the structure thus arranged, the pressure of the air bubble 40, which is transferred to the movable member 31, is caused to act greater as it is exerted on the portion closer to the free end 32. In this way, the free end 32 begins to be displaced earlier and quickly.

In this respect, the other aspects of operation and effect are the same as those described in the first embodiment. However, in accordance with the present embodiment, the flow resistance to the liquid supply in the second liquid flow path 16 is suppressed to make it smaller, while applying a higher pressure of the air bubble higher to the free end. In this way, the refilling characteristics are enhanced.

(Embodiment 6)

Figure 12:
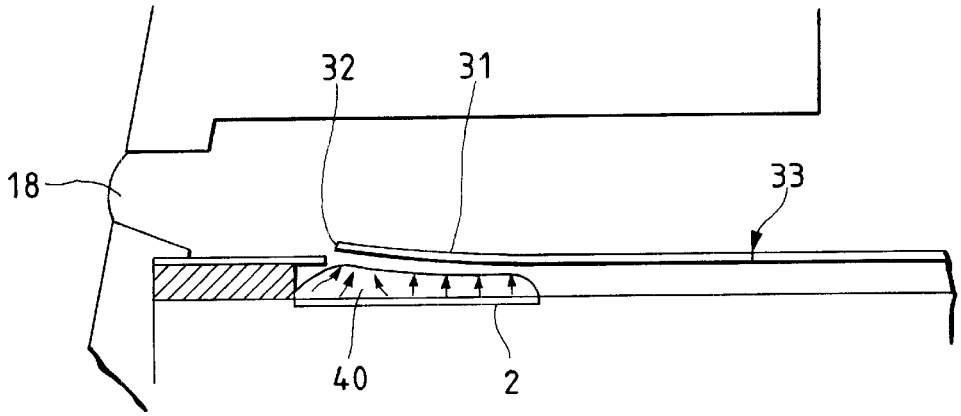
FIG. 12 is a cross-sectional view schematically showing a liquid jet head in accordance with the sixth embodiment of the present invention.

FIG. 12 is a cross-sectional view schematically showing a liquid jet head in accordance with the present embodiment, which illustrates the structure of the heat generating element of the liquid jet head that exerts a larger pressure by means of the free end 32 of the movable member 31 as in the embodiments described above.

For the present embodiment, the end of the heat generating element 2 of the head on the discharge port side is positioned nearer to the discharge port 18 than the free end 32 of the movable member 31. With the structure thus arranged, the air bubble 40 created on the end of the heat generating element 2 on the discharge port side is drawn around to act upon the free end 32. Hence, the free end 32 begins quickly to be displaced earlier. Here, the other embodiments, which have described above, may be structured in the same manner as this embodiment. The other aspects of operation and effect of the present embodiment are the same as those described in the third embodiment. With the present embodiment, however, it becomes possible to implement the simpler process of manufacture to provide the head at lower costs.

(Embodiment 7)

Figure 13:
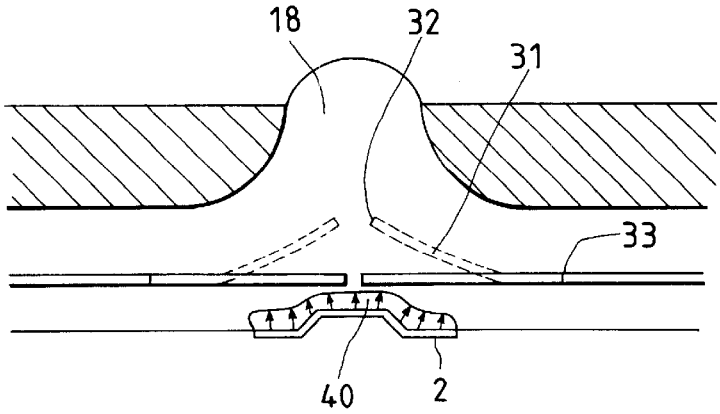
FIG. 13 is a cross-sectional view schematically showing a side mode liquid jet head in accordance with the seventh embodiment of the present invention.

FIG. 13 is a cross-sectional view schematically showing a liquid jet head of the so-called side shooter type of the present embodiment, in which the installation surfaces of the heat generating element and discharge port are substantially in parallel. FIG. 13 illustrates the structure of the heat generating element of the liquid jet head that exerts a larger pressure by means of the free end 32 of the movable member 31 as in the embodiments described above.

The present embodiment is such that the head structure of the fifth embodiment represented in FIG. 11A is arranged to be of the side shooter type. The other embodiments, which have been described above, may also be arranged to be of the side shooter type. Here, the other aspects of operations and effect are the same as those described in the third embodiment. Therefore, the description thereof will be omitted.

Now, in accordance with the embodiment 8 to the embodiment 10, the description will be made of means for making the characteristic frequency of vibration of the movable member larger than the driving frequency for use of air bubble creation.

(Embodiment 8)

FIGS. 14A to 14D are cross-sectional views which illustrate one example of a liquid jet head in accordance with the present embodiment. Here, in the description of principle, the structure of the liquid jet head of the present embodiment has already been referred to described in detail. Therefore, the description thereof will be omitted.

For the liquid jet head of the present embodiment, there is arranged each of the second liquid flow paths 12 on the elemental substrate 1 having heat generating elements 2 on it to provide thermal energy for the creation of air bubbles. On the second liquid flow path, the first liquid flow path 14, which is conductively connected with the discharge port 18, is arranged.

In this respect, the common liquid chambers may be conductively connected partly or entirely to arrange them for a sharable use if bubbling liquid and discharging liquid are the same.

For the present embodiment, the characteristic frequency of vibration of the movable member 31 is made larger than the inverse number of the cycle from the creation of air bubble to the extinction thereof.

Figure 14A:
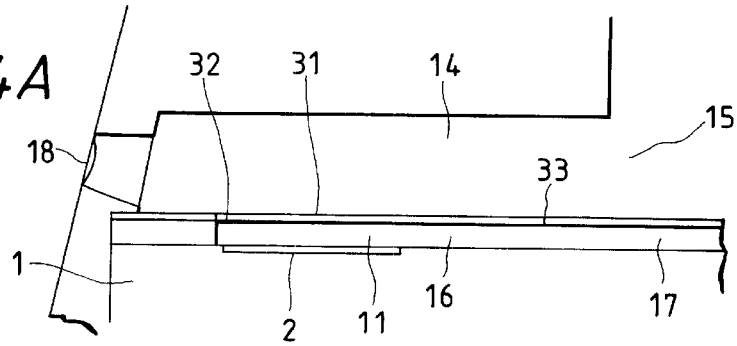
FIGS. 14A, 14B, 14C and 14D are views schematically showing a liquid jet head in accordance with the eighth embodiment of the present invention.
Figure 14B:
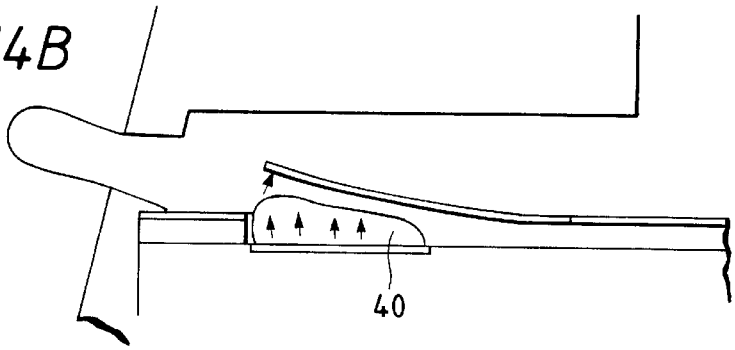
Figure 14C:
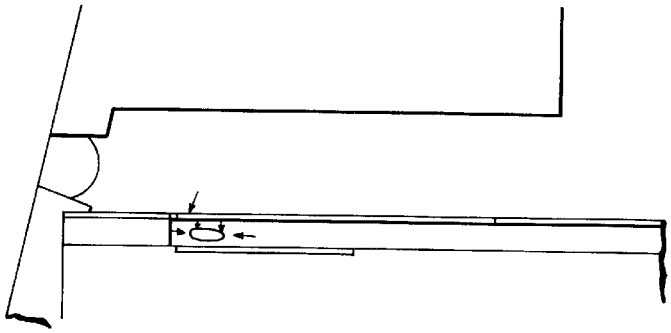

With the structure thus arranged, it is made possible for the movable member 31 to follow the cycle from the moment the driving pulse is applied to the heat generating element 2 shown in FIG. 14A to the moment the air bubble 40 disappears as shown in FIG. 14C, by means of the displacement of the movable member 40 by the creation of the air bubble 40 as shown in FIG. 14B, as well as by the elasticity of the movable member's own.

Figure 14D:
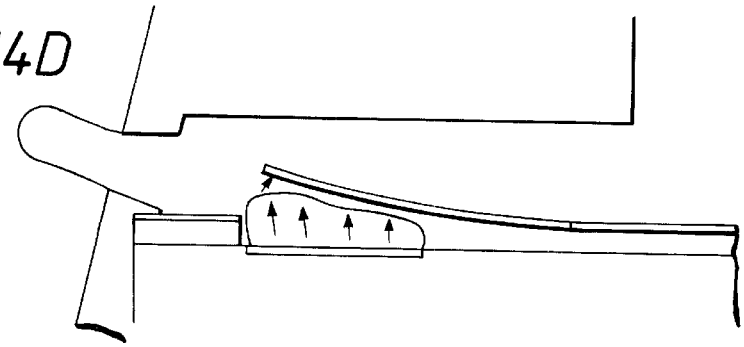

Also, as one example of the present embodiment, it is arrange to make the flow path resistance extremely small in the second liquid flow path 16 shown in FIG. 14A so that most of the liquid supply subsequent to the contraction of the air bubble is performed from the second liquid flow path. In this case, the pressure of the air bubble 40 at the time of contraction does not contribute to displacing the movable member 31 to its stationary position or it may contribute only slightly otherwise. Even in such a case, the present embodiment enables the displacement of the movable member 31 to follow by its own elasticity corresponding to the discharging operation from the creation of the air bubble 40 to the extinction thereof. As a result, for foaming in the next discharging operation as shown in FIG. 14D, the same condition is attainable as the previous discharging operation, hence obtaining the characteristics of the enhanced discharging efficiency at all times. Further, the displacement of the movable member can be performed smoothly, and the durability of the movable member is enhanced.

Also, it should be good enough if only the movable member 31 is able to return to the original position by the time the next discharging operation begins. It may be possible, therefore, to make the characteristic frequency of vibration of the movable member 31 larger than the maximum driving frequency.

As the actual example of the former, given the cycle from the creation of air bubble to the extinction thereof as 30 μS, discharging is performed using the movable member having its characteristic frequency of vibration larger than the inverse number of such cycle, which is 1/30 μS (=33 kHz). As a result, the operation of the movable member follows the development and contraction of air bubble to make it possible to improve the discharging condition, as well as to improve the refilling efficiency still more.

Here, in this case, Co or other impurities are slightly doped into Ni and treated by quenching or the like. The material thus obtained is used for the movable member described above.

As the actual example of the latter, discharging is performed using the movable member having its characteristic frequency of vibration being 7 kHz or more with respect to the discharge head whose maximum driving frequency is 6 kHz. As a result, it is possible to obtain the stabilized discharging condition even by use of the discharge head of 6 kHz, while maintaining the discharge efficiency alike.

(Embodiment 9)

FIGS. 15A to 15D are cross-sectional views which schematically illustrate a liquid jet head in accordance with the present embodiment. The structure thereof is fundamentally the same as that of the eighth embodiment. Therefore, the description thereof will be omitted.

Figure 15A:
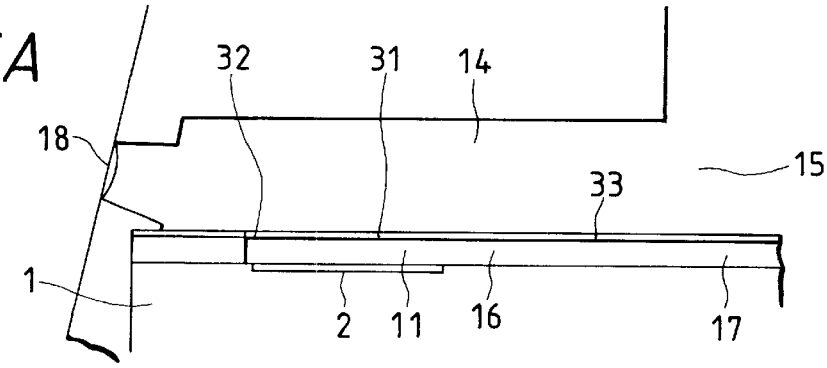
FIGS. 15A, 15B, 15C and 15D are views schematically showing a liquid jet head in accordance with the ninth embodiment of the present invention.
Figure 15B:
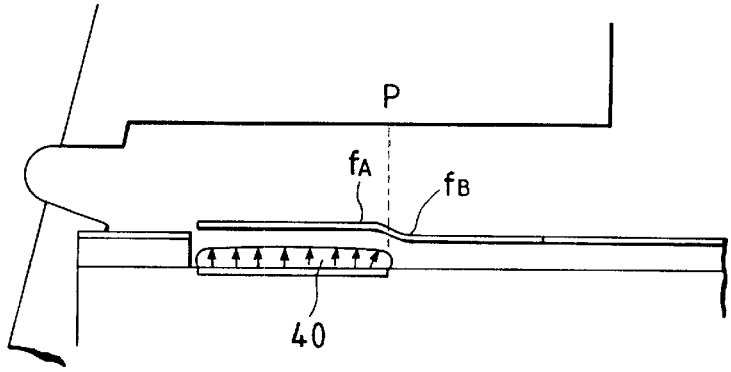

In the state shown in FIG. 15A, when driving pulse is applied to the heat generating element 2, the wave-forms $f_A$ and $f_B$ are generated from the portion P of the movable member 31 with respect to the side opposite to the discharge port of the heat generating element 2 as shown in FIG. 15B. This is because foaming power depends on the condition such as rigidity of the movable member 31 is low. This is the state that appears the moment the pressure of air bubble 40 is exerted on the movable member 31 evenly in parallel to it. This state itself does not present the best condition for leading the air bubble 40 to the discharge port 18, although the discharging efficiency is enhanced to a certain extent as compared with the conventional head in which no movable member 31 is arranged.

Figure 15C:
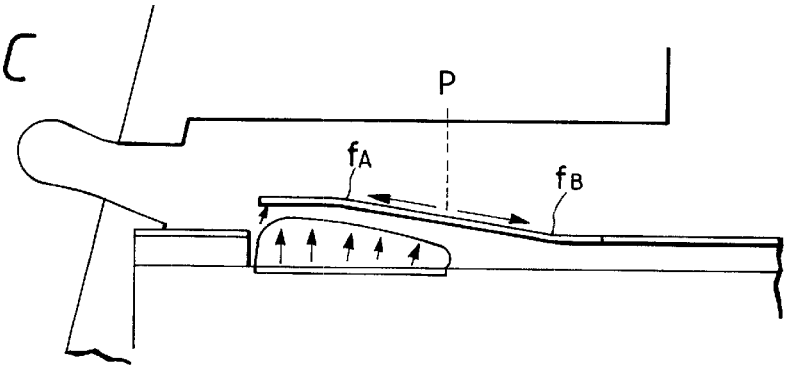

However, as shown in FIG. 15C, the waveforms $f_A$ and $f_B$ advance to the free end 32 side and the fulcrum 33 side of the movable member 31 by means of the characteristically undulated transfer provided by the movable member 31.

Figure 15D:
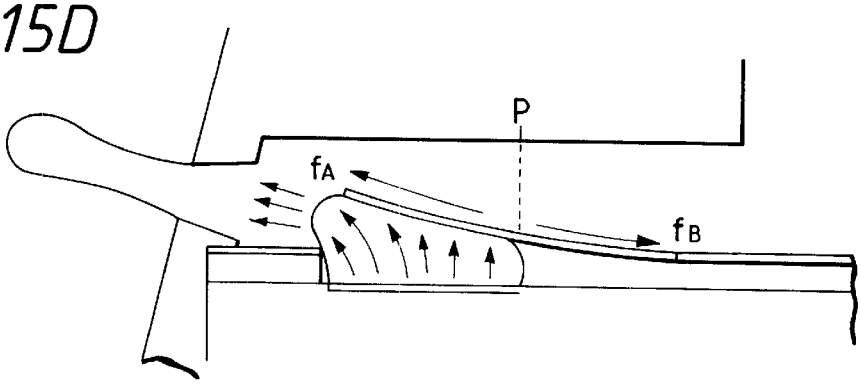

Then, as shown in FIG. 15D, if the waveforms $f_A$ and $f_B$ reach the free end 32 and the fulcrum 33 by the time the movable member 31 is displaced to its maximum, the air bubble 40 is led to the discharge port 18 by means of the movable member as a whole with the free end 32 being at its maximum displacement position, thus presenting the most effective condition.

Therefore, in order to obtain this condition until the time that the air bubble becomes the largest or until the time that the displacement of the movable member reaches its maximum, it is necessary to satisfy the following formula 1:

(the time for air bubble becoming the largest)>(the period of the undulation transfer by the movable member) or (the time for the displacement of the movable member reaching its maximum)>(the period of the undulation transfer by the movable member)

At this juncture, depending on the length of the movable member, the undulation transfer time of the movable member is obtainable by the following formula 2:

(the period of the undulation transfer by the movable member)=(the length of the movable member)/(the speed of the undulation transfer by the movable member)

In other words, it is necessary to make the undulation transfer speed of the movable member faster than the developing speed of the air bubble.

With the structure thus arranged, the stabilized discharging condition is provided, and the characteristics of the enhanced discharging efficiency is made obtainable at all times. Further, since the displacement of the movable member is performed smoothly, the durability of the movable member is enhanced.

As an actual example, given the development time for the air bubble as 15 μS to make it largest, while setting the length of the movable member at 150 μm, the resultant relationship is (15 μS)>(150 μm/15 m/s). The condition becomes appropriate, and the characteristics are enhanced stably.

(Embodiment 10)

FIGS. 16A to 16D are cross-sectional views which schematically illustrate a liquid jet head of the present embodiment. Since the fundamental structure is the same as that of the eighth embodiment, the description thereof will be omitted.

The present embodiment is fundamentally the same as the ninth embodiment. The characteristic aspect thereof is that the free end 32 of the movable member 31 is positioned more on the discharge port side than the end of the heat generating element 2 on the discharge port side.

Figure 16A:
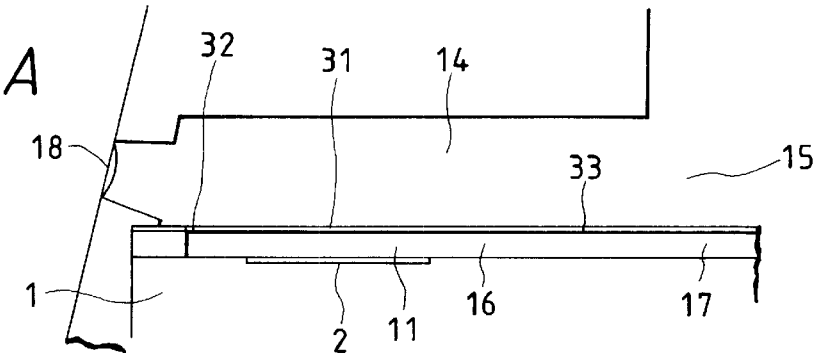
FIGS. 16A, 16B, 16C and 16D are views schematically showing a liquid jet head in accordance with the tenth embodiment of the present invention.
Figure 16B:
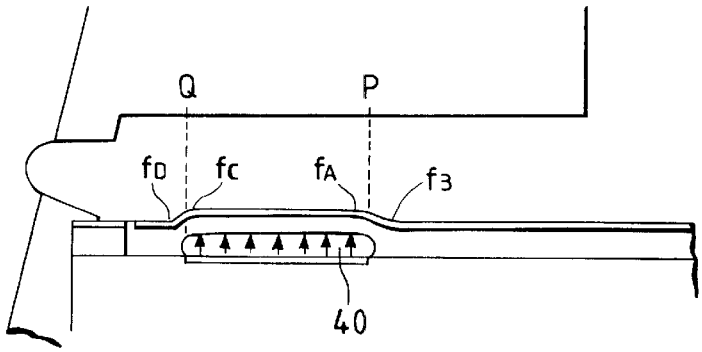

In the state shown in FIG. 16A, when driving pulse is applied to the heat generating element 2, the wave-forms $f_A$ and $f_B$ are generated from the portion P of the movable member 31 with respect to the side opposite to the discharge port of the heat generating element 2 as shown in FIG. 16B, and at the same time, the waveforms $f_C$ and $f_D$ are generated at the portion Q of the movable member 31 that corresponds to the heat generating element 2 on the discharge port side. This is because foaming power depends on the condition such as rigidity of the movable member 31 is low. This is the state appears the moment the pressure of air bubble 40 is exerted on the movable member 31 evenly in parallel to it. This state itself is not present the best condition for leading the air bubble 40 to the discharge port 18, although the discharging efficiency is enhanced to a certain extent as compared with the conventional head in which no movable member 31 is arranged.

Figure 16C:
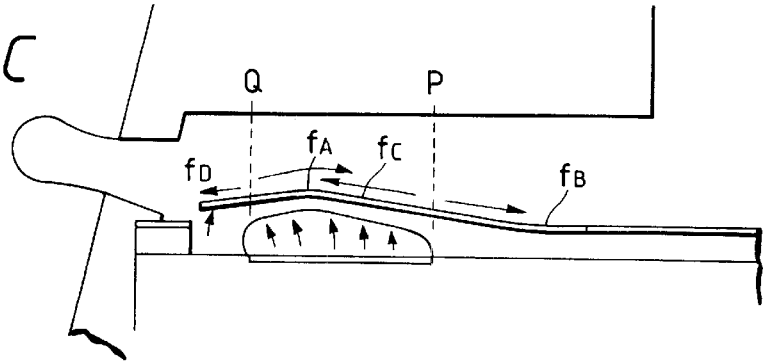

However, as shown in FIG. 16C, the waveforms $f_A$ and $f_B$ advance to the free end 32 side and the fulcrum 33 side of the movable member 31 by means of the characteristically undulated transfer provided by the movable member 31. Also, the waveforms $f_C$ and $f_D$ advance to the fulcrum 33 side and the free end 32 side.

Figure 16D:
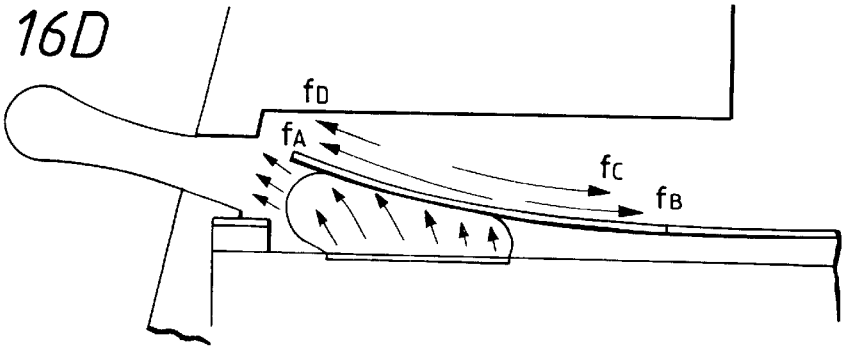

Then, as shown in FIG. 16D, if the waveforms $f_A$ and $f_B$ reach the free end 32 and the fulcrum 33, and also, the waveforms $f_C$ and $f_D$ reach the fulcrum 33 and the free end 32 by the time the movable member 31 is displaced to its maximum, the air bubble 40 is led to the discharge port 18 by means of the movable member as a whole with the free end 32 being at its maximum displacement position, thus presenting the most effective condition.

Therefore, in order to obtain this condition until the time that the air bubble becomes the largest or until the time that the displacement of the movable member reaches its maximum, it is necessary to satisfy the following formula 3:

(the time for air bubble becoming the largest)>(the period of the undulation transfer by the movable member) or (the time for the displacement of the movable member reaching its maximum)>(the period of the undulation transfer by the movable member)

At this juncture, depending on the length of the movable member, the undulation transfer time of the movable member is obtainable by the following formula 4:

(the undulation transfer time of the movable member)=(the length of the movable member)/(the speed of the undulation transfer by the movable member)

In other words, it is necessary to make the undulation transfer speed of the movable member faster than the developing speed of the air bubble.

With the structure thus arranged, it is possible to obtain the same effect as the ninth embodiment.

Now, in conjunction with the embodiments 11 to 16, the description will be made of means for promoting displacement that promotes the movement of the free end of the movable member.

(Embodiment 11)

With respect to the structures of liquid jet heads based upon the discharging principle described above, the function, which leads the propagation of pressure exerted by the creation of air bubble and the development of air bubble itself to the discharge port side by the displacement of the movable member arranged to cover the air bubble generating area, is made different depending on the configurations of movable member and the positions of arrangement thereof (the positional relationship between the air bubble generating area and the movable member). A liquid jet head of the present invention makes it possible to materialize the structure capable of leading the propagation of pressure exerted by the creation of air bubble and the development of air bubble itself to the discharge port side more efficiently and stably. More specifically, with respect to the positional relationships shown in FIG. 1 to FIG. 7 for the embodiment 1 and embodiment 2 described above, it is possible to materialize the structure capable of leading the propagation of pressure exerted by the creation of air bubble and the development of air bubble itself to the discharge port side more efficiently and stably even when the end E of the heat generating element 2 on the downstream side is positioned on the upstream side with respect to the free end 32 or, further, even when the end C of the heat generating element 2 on the upstream side is positioned on the upstream side with respect to the point D or the point F.

Hereinafter, as a structure capable of leading the propagation of pressure exerted by the creation of air bubble and the development of air bubble itself to the discharge port more efficiently and stably as described above, the examples will be shown, in which a reinforcement member is provided for a part of the movable member in order to enhance its rigidity in the displacement direction, and a shaping process is provided for a part of the movable member to enhance its rigidity, and also, the specific description will be made of such structures.

(1) The example in which a reinforcement member is provided for a part of the movable member.

Figure 17A:
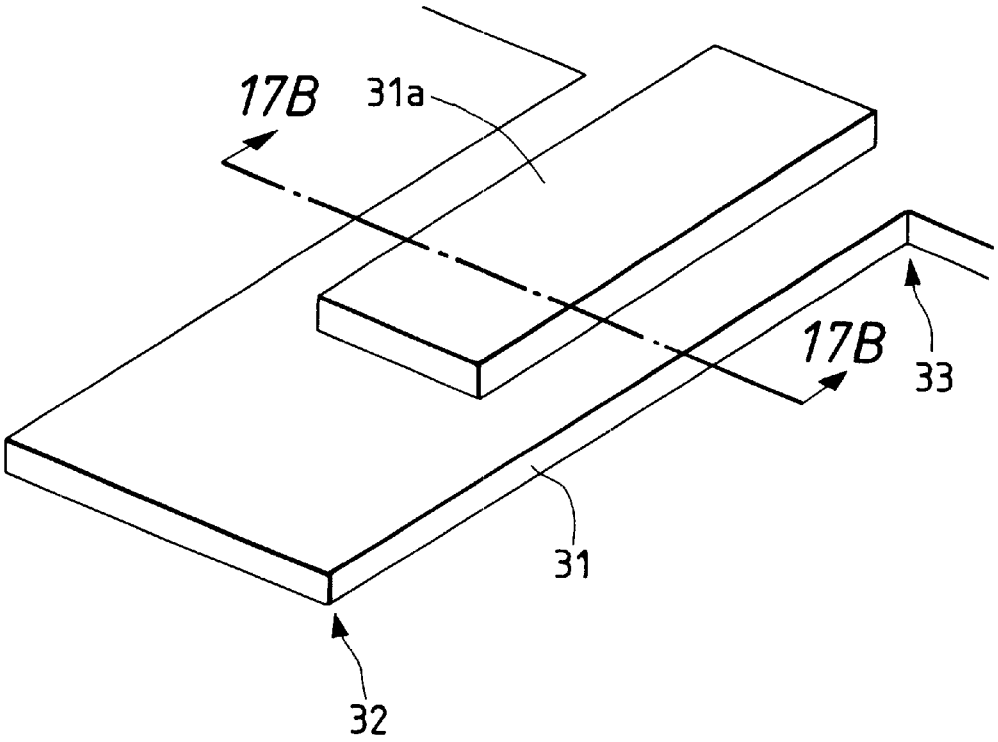
FIGS. 17A and 17B are views which illustrate the first example of the configuration of movable member of a liquid jet head in accordance with the eleventh embodiment of the present invention.
Figure 17B:
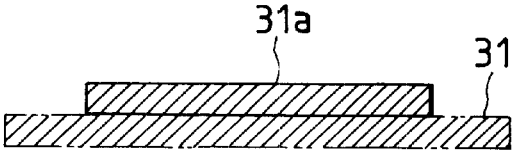

FIGS. 17A and 17B are views which illustrate a first configuration example of a liquid jet head in accordance with the present invention; FIG. 17A is a perspective view thereof; and FIG. 17B is a cross-sectional view, taken along line 17B—17B in FIG. 17A. In FIGS. 17A and 17B, a flat plate type displaceable reinforcement member 31*a* is arranged on the center of the movable member 31 in the longitudinal direction form the vicinity of the fulcrum 33. The structure is then arranged so as to enhance the strength of the movable member 31 with respect to the displacement made by the creation of air bubble. The length, width, and thickness of the reinforcement member 31*a* are determined depending on the size of the air bubble generating area, the positional relationship between this area and the heat generating element 2, and some others. Here, the length of the reinforcement member 31*a* is set so that the portion of the movable member 31 on the free end 32 side remains as it is to a certain extent, and the width of the reinforcement member is made smaller than that of the movable member 31.

Figure 18A:
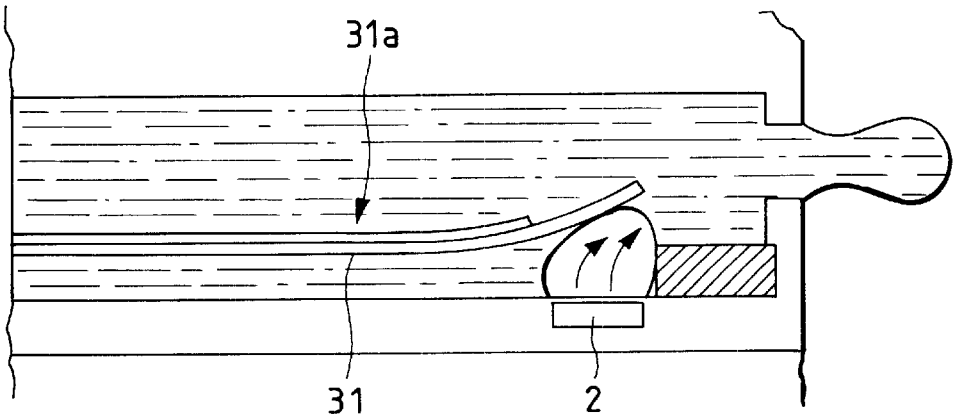
FIGS. 18A and 18B are views illustrating the liquid discharging of a liquid jet head provided with the movable member represented in FIGS. 17A and 17B.

For the movable member 31 which is reinforced by the reinforcement member 31*a* with the exception of a part on the free end 32 side, the first displacement area (the portion having a weaker rigidity on the free end side) of the movable member 31 where no reinforcement is provided with functions to lead the pressure of air bubble to the discharge port side if the size of the heat generating element is smaller as shown in FIG. 18A, and if the size of the heat generating element is larger, a second displacement area (the portion having a stronger rigidity on the fulcrum side), where the reinforcement member is provided, leads the portion of the air bubble on the upstream side to the free end side of the movable member, and then, the pressure of air bubble is led to the discharge port side by means of the first displacement area (having a weaker rigidity) on the free end side. In this way, it is made possible to cause the pressure of air bubble at the time of foaming (particularly, the pressure of the air bubble on the downstream side) to be concentrated on the free end side of the movable member more efficiently. Hence, the displacing configuration of the movable member is optimized even against a large foaming power in order to lead the air bubble in the direction of the discharge port stably.

Particularly, with the adoption of the present invention, the created air bubble has more components directed toward the discharge port in the propagation of pressure exerted thereby and the developing direction thereof on the portion near to the downstream side of the discharge port. Therefore, it is possible to make the strength weaker for the first displacement area that faces this portion. Also, the pressure development component of the created air bubble on the upstream side has more components directed toward side opposite to the discharge port, which necessitates the greater control using a stronger force. Therefore, the strength of the second displacement area that faces such portion should be made stronger. For that matter, the reinforcement member 31*a* is used to reinforce the movable member. Consequently, it should be arranged to set the strength of the first displacement area, which nearer to the discharge port, and the strength of the second displacement area, which farther away from the discharge port in the relationship of (first displacement area)<(second displacement area), and it is effective to position the boundary portion between them on the portion that faces the air bubble generating area (or the heat generating element 2) for the reasons described above, or preferably, on the area ±30%, or more preferably ±10% of the length of the portion that faces either of them from the center of such portion. Also, the reinforcement member should be provided on the area that include the fulcrum so that it may act upon the fulcrum.

Here, it may be possible to arrange three or more different displacement areas for the movable member. In such a case, given each of the displacement areas as a first displacement area, a second displacement area, a third displacement area, . . . from the discharge port side, the strength of each area is in the relationship of (first displacement area)< (second displacement area)<(third displacement area) . . . . Also, it should be effective to arrange the boundary portions between each of the displacement areas on the portions that face the air bubble generating area (or the heat generating element), respectively, as described above.

Figure 18B:
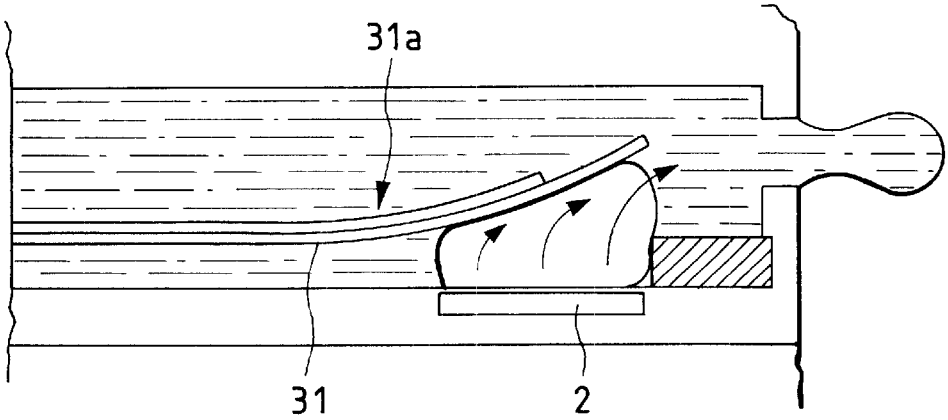
Figure 19:
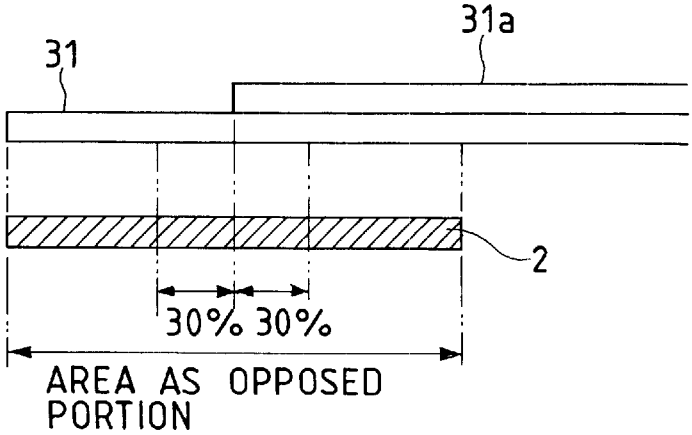
FIG. 19 is a view which shows the positional relationship between the boundary portion between the first displacement and the second displacement area.
Figure 20A:
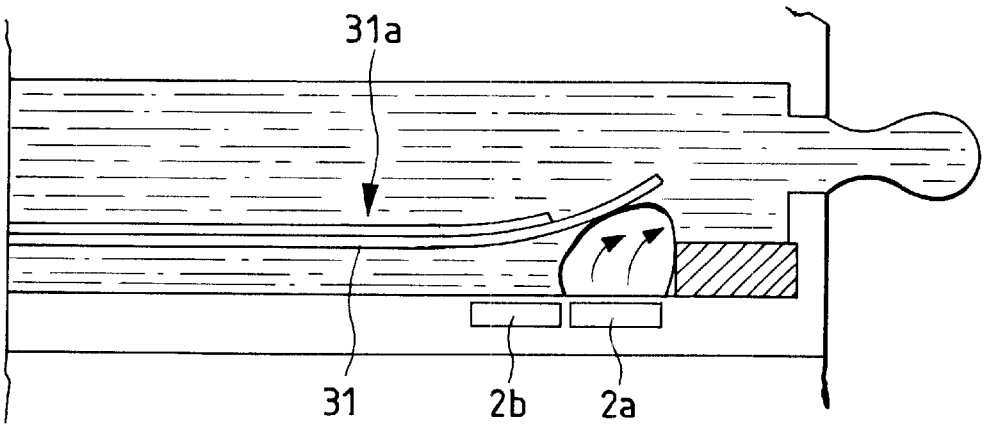
FIGS. 20A and 20B are views which illustrate the liquid discharging of a liquid jet head provided with the movable member represented in FIGS. 17A and 17B and a plurality of heat generating elements.
Figure 20B:
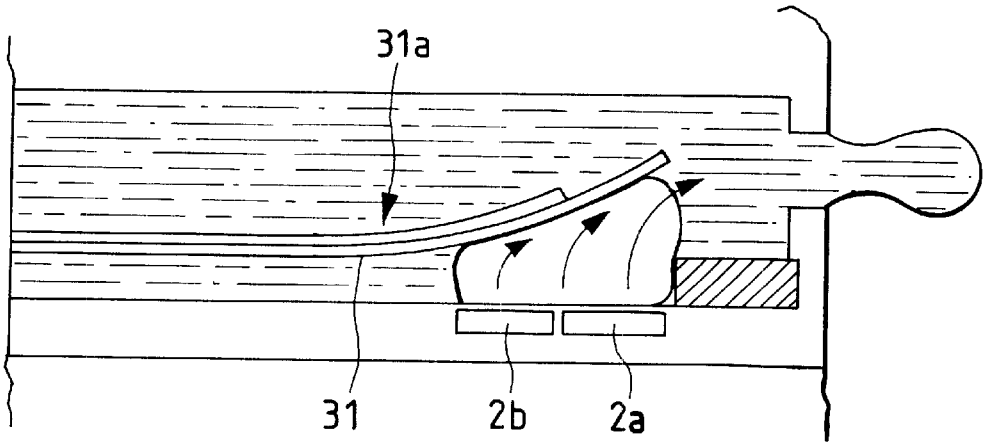

FIGS. 20A and 20B are the same as FIGS. 18A and 18B. For a part of the movable member, the reinforcement member is provided. A first displacement area and a second displacement area are provided for the movable member as a whole. For this structure, plural heat generating areas 2*a* and 2*b* are arranged to act upon the first displacement area and the second displacement area individually. This structure is formed by arranging the movable member of the present invention, which is provided with the first and second displacement areas, to face the heat generating elements on the elemental substrate. This arrangement is fundamentally the same as the one having a plurality of heaters on it as disclosed in the specification of Japanese Patent Application Laid-Open No. 7-256347. Here, therefore, the detailed description thereof will be omitted.

In FIG. 20B, heat generating energy is applied both to the heat generating elements 2*a* and 2*b*, and a large air bubble is created on the air bubble generating area. In this case, the first and second displacement areas of the movable member function to allow it to be displaced beginning with the free end side. As a result, a greater power is efficiently controlled to be led in the discharge port direction. Hence, the discharge efficiency is enhanced stably.

As described above, even for the head of a type where foaming powers are different, it is possible to displace the movable member appropriately corresponding to each of such heads. Therefore, not only the discharging efficiency is enhanced stably, but also, the controlling performance and the discharging efficiency are made superior when gradation control or the like is required.

Also, if the foaming power described above is controllable, it is possible to apply some other examples of the movable member, which will be described later.

In this respect, for the example of the reinforcement of the movable member 31 described above, the movable member 31 is reinforced by adhesively bonding the reinforcement member 31*a* to it or just by arranging the reinforcement member to be overlaid on it.

(2) The example in which a shaping process is provided for a part of the movable member to enhance its rigidity.

Figure 21A:
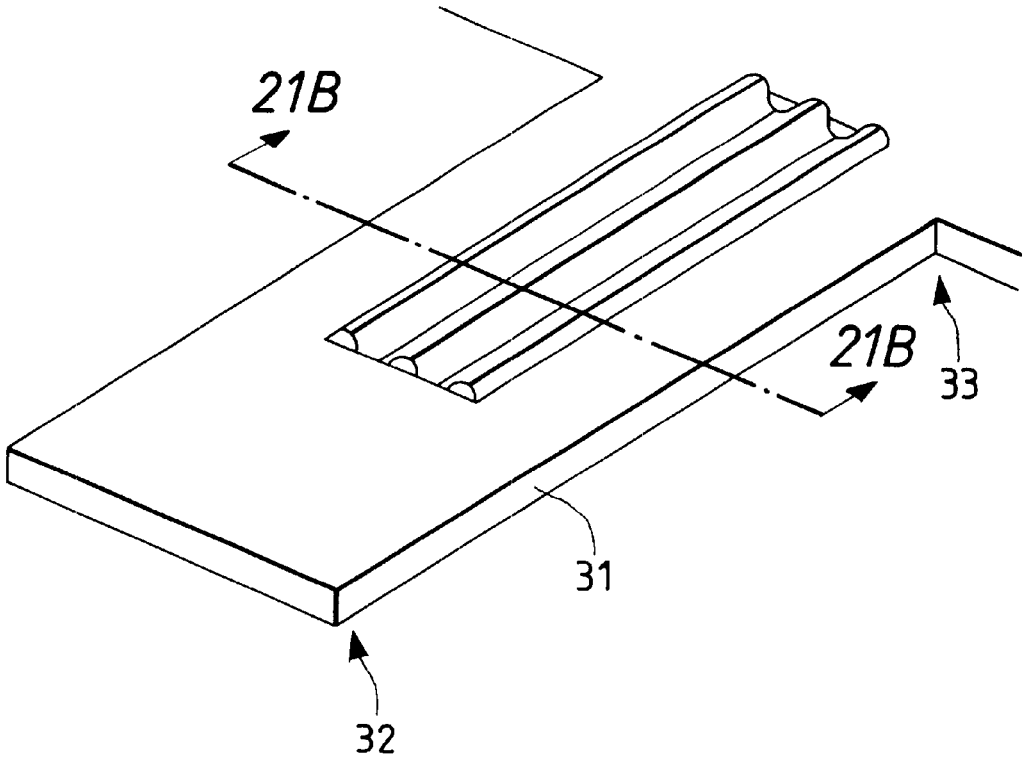
FIG. 21A is a partial perspective view which shows a movable member having a part which is processed to be corrugated to enhance its rigidity.
Figure 21B:
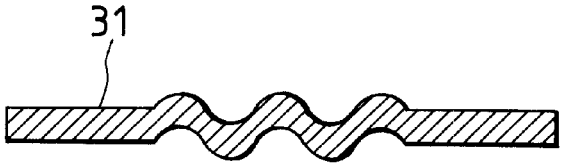
FIG. 21B is a cross-sectional view thereof, taken along line 21B—21B in FIG. 21A.
Figure 22A:
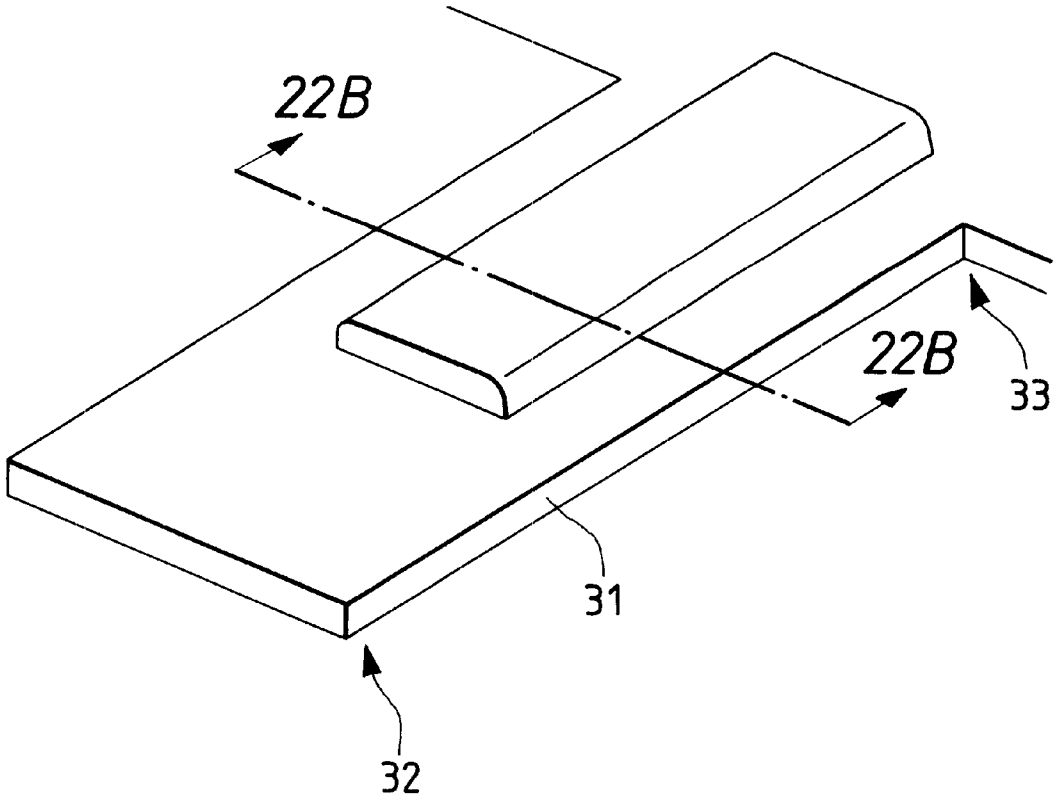
FIG. 22A is a partial perspective view which shows a movable member having a part which is processed to be recessed to enhance its rigidity.
Figure 22B:
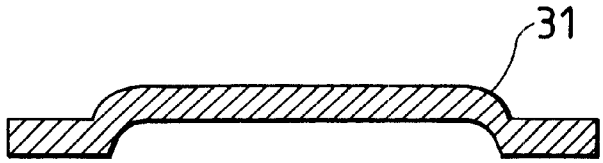
FIG. 22B is a cross-sectional view thereof, taken along line 22B—22B in FIG. 22A.
Figure 23A:
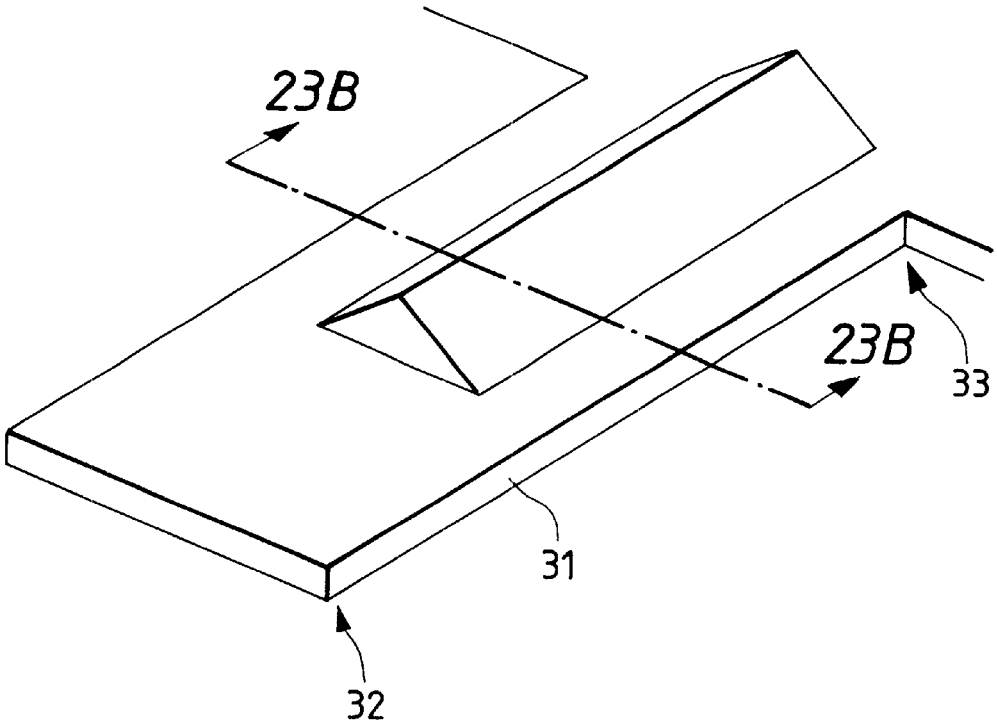
FIG. 23A is a partial perspective view which shows a movable member having a part which is processed to provide sides forming an acute angle to enhance its rigidity.
Figure 23B:
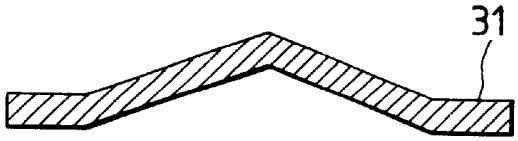
FIG. 23B is a cross-sectional view thereof, taken along line 23B—23B in FIG. 23A.
Figure 24A:
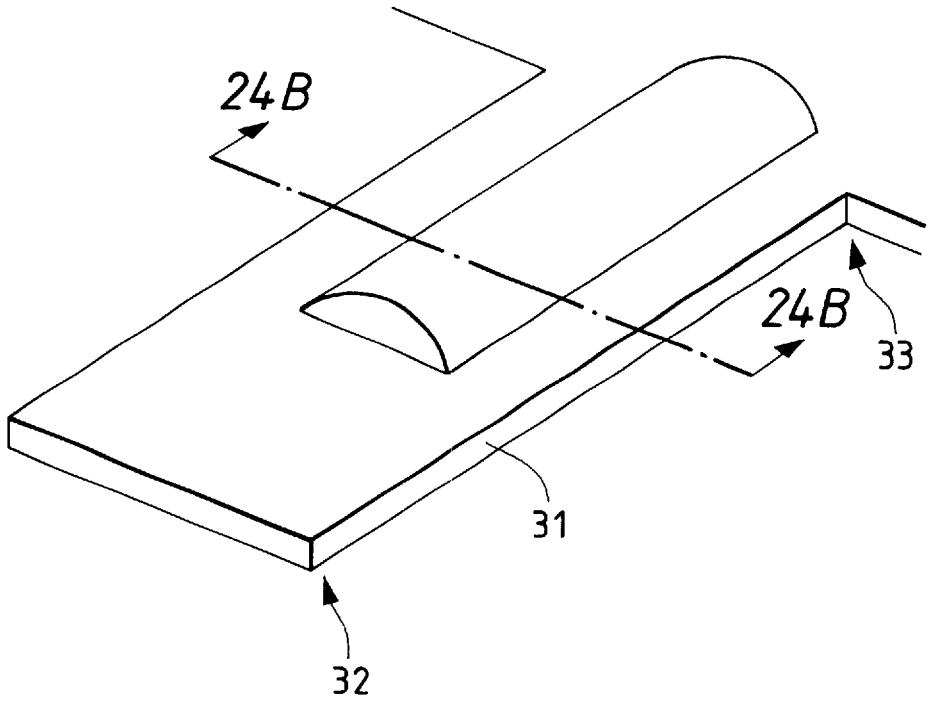
FIG. 24A is a partial perspective view which shows a movable member having a part which is processed to be curved to enhance its rigidity.
Figure 24B:
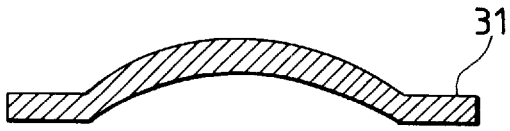
FIG. 24B is a cross-sectional view thereof, taken along line 24B—24B in FIG. 24A.

For the example described above, the thickness of the movable member 31 is partly reinforced to enhance its rigidity. However, it is also possible to obtain the same function by giving a shaping process to a part of the movable member for the partial enforcement thereof. For this example, a shaping process is provided for the central portion of the movable member 31 to enhance the rigidity of the movable member against the displacement thereof in the longitudinal direction from the vicinity of the fulcrum 33. In this way, the strength of the movable member 31 is enhanced with respect to the displacement based upon the creation of air bubble. The length and width of the processed portion are determined depending on the size of the air bubble generating area, the positional relationship between this area and the heat generating element 2, and some other factors. However, as described above, by arranging such length so that the portion of the movable member 31 on the free end 32 side remains unprocessed, it is possible to obtain the functions as represented in FIGS. 18A and 18B and FIGS. 20A and 20B. Conceivably, it is possible to form the various shapes that may enhance the rigidity as referred to in the preceding paragraph. For example, as shown in FIGS. 21A and 21B, the one whose sectional configuration is corrugated may be provided; as shown in FIGS. 22A and 22B, the one whose sectional configuration is convex may be provided; as shown in FIGS. 23A and 23B, the one whose sectional configuration is like a hill may be provided; or as shown in FIGS. 24A and 24B, the one whose sectional configuration is circular may be provided. Any one of them is capable of enhancing the rigidity of the movable member in the direction of its displacement.

For the manufacture of the movable member having such a shape as described above, plating process or electrocasting may be adopted. Here, as one example, the description will be made of a method for manufacturing a movable member having the configuration as shown in FIGS. 22A and 22B as given below.

Figure 25A:
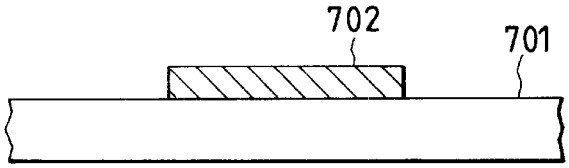
FIGS. 25A, 25B, 25C and 25D are views which illustrate the processing steps of a method for manufacturing the movable member represented in FIGS. 22A and 22B.
Figure 25B:
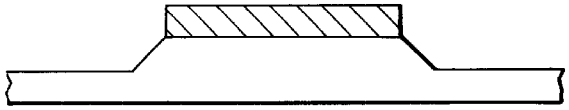
Figure 25C:
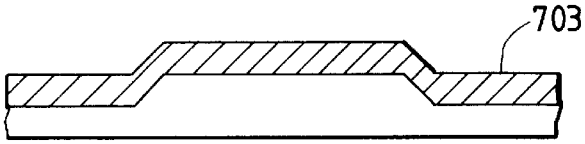
Figure 25D:
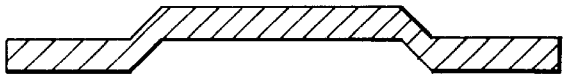

On an SUS base board 701, resist pattern 702 is formed (step shown in FIG. 25A). In continuation, this metallic board 701 is immersed in an etching solution (water solution of ferric chloride or cupric chloride) with the resist pattern 702 as masking, and then, the exposed portion is etched. After that, the resist pattern 701 is removed (step shown in FIG. 25B). Then, electric plating is given to the metallic base board 701 thus etched to form a nickel layer 603 of 2.5 $\mu$m thick, for example (step shown in FIG. 25C). In this respect, as metallic plating assistant, sulfonic nickel, stress reducer (manufactured by World Metal Co.: Zeroall), boric acid, pit prevention agent (manufactured by World Metal Co.: NP-APS), and nickel chloride are used. By the application of the steps described above, it is possible to form the movable member having each of the configurations shown in FIGS. 21A and 21B, FIGS. 23A and 23B, and FIGS. 24A and 24B.

Now, the description will be made of the specific structure of a liquid jet head using the movable member described above.

FIG. 36 is a cross-sectional view schematically showing the example of the liquid jet head having the reinforcement member arranged for a part of the movable member thereof, taken in the flow path direction. FIG. 37 is a partially broken perspective view which shows this liquid jet head.

In this respect, the details of the head structured as shown in FIGS. 36 and 37 are referred to in the paragraphs of the description of the principle. Therefore, the description thereof will be omitted.

For the movable member 31, a member or a shaping process is provided for a part thereof to enhance the rigidity of the movable member in the displacement direction as described above. The movable member is arranged to face the air bubble generating area 11 (at B in FIG. 36), which operates to be open toward the discharge port side of the first liquid flow path by foaming of bubbling liquid (indicated by arrows in FIG. 36).

As to the fulcrum 33 of the movable member 31, the arrangement of the free end 32, its arrangement relationship with the heat generating element, the same arrangement is made as shown in FIG. 1 to FIG. 4B or FIG. 5 to FIG. 7, respectively.

Now, in conjunction with FIGS. 38A and 38B, the operation of this liquid jet head will be described.

In this respect, the structure shown in FIGS. 38A and 38B is referred to in detail in the paragraphs of the description of the principle. Therefore, the description thereof will be omitted.

For this structure, no foaming pressure escapes from the three directions with the exception of the upstream side of the air bubble generating area. As a result, the pressure following the creation of air bubble is concentrated and propagated to the movable member 31, which is arranged for the discharge pressure generating portion, and the movable member is displaced from the state shown in FIG. 38A to the first liquid flow side as shown in FIG. 38B. By this operation of the movable member, the first liquid flow path 14 and the second liquid flow path 16 are conductively connected largely. Then, the pressure exerted by the creation of air bubble is mainly transferred in the direction of the discharge port of the first liquid flow path (direction A). When the pressure is thus transferred, this liquid jet head makes it possible to cause the pressure of the air bubble on its downstream side to act intensively upon the free end side of the movable member efficiently by means of the second displacement area (the portion having the stronger rigidity on the fulcrum side). Also, the air bubble is led in the direction of the discharge port efficiently and stably. Liquid is discharged from the discharge port by means of this pressure transfer and the mechanical displacement of the movable member as described earlier.

(Embodiment 12)

For the liquid jet head in accordance with the eleventh embodiment described above, the movable member is formed on the separation wall that partitions the first liquid flow path and the second liquid flow path. Then, the structure is arranged to provide a reinforcement member or reinforcement shaping for a part of such movable member to enhance its rigidity. However, as shown in FIG. 34, it may be possible to arrange the structure to provide a reinforcement member or reinforcement shaping for a part of the movable member supported by a base.

In this respect, the details of the structure shown in FIG. 34 are referred to in the paragraphs of the description of the principle. Therefore, the description thereof will be omitted.

As to the fulcrum 33 of the movable member 31, the arrangement of the free end 32, and its arrangement relationship with the heat generating element, the same arrangements are made as those described earlier in conjunction with FIG. 1 to FIGS. 4A and 4B or FIG. 5 to FIG. 7. At the initial position (first position) of the movable member 31, the movable member 31 is close to or closely in contact with the downstream wall 36 and side walls 37 of the heat generating element arranged on the downstream side and in the width direction of the heat generating element 2. Therefore, the pressure of the air bubble at the time of foaming, particularly, the pressure residing on the downstream side of the air bubble, is not allowed to escape, and the pressure acts intensively upon the free end side of the movable member. In addition to this action, the pressure of the air bubble on the downstream side is intensively led to the free end side of the movable member efficiently by means of the second displacement area (the portion having a stronger rigidity on the fulcrum side) of the movable member. Therefore, as compared with the eleventh embodiment, the air bubble is led in the discharge port direction efficiently and stably still more by the adoption of the present embodiment.

(Embodiment 13)

In each of the embodiments described above, the structure is arranged to provide an extrusion as a barrier positioned on the downstream end of the air bubble generating area with respect to the free end of the movable member, and then, to concentrate the pressure exerted by the creation of air bubble for the rapid movement of the movable member, as well as for the intensive shift of the air bubble toward the discharge port side. However, as shown in FIG. 35, it may be possible to arrange the structure so that the free end area of the movable member and both end side areas thereof do not close the air bubble generating area essentially, but allow it to be open to the discharge port area without the provision of such extrusion. In this case, the portion of the air bubble on the discharge port side, which act directly upon the droplet discharging, is regulated by the first displacement area (the portion having a weaker rigidity) of the movable member on the free end side, while giving the degree of freedom to the air bubble to be created.

In this respect, the structure shown in FIG. 35 has been referred to in detail in the paragraphs of the description of the principle. Therefore, the description thereof will be omitted.

(Embodiment 14)

Figure 26:
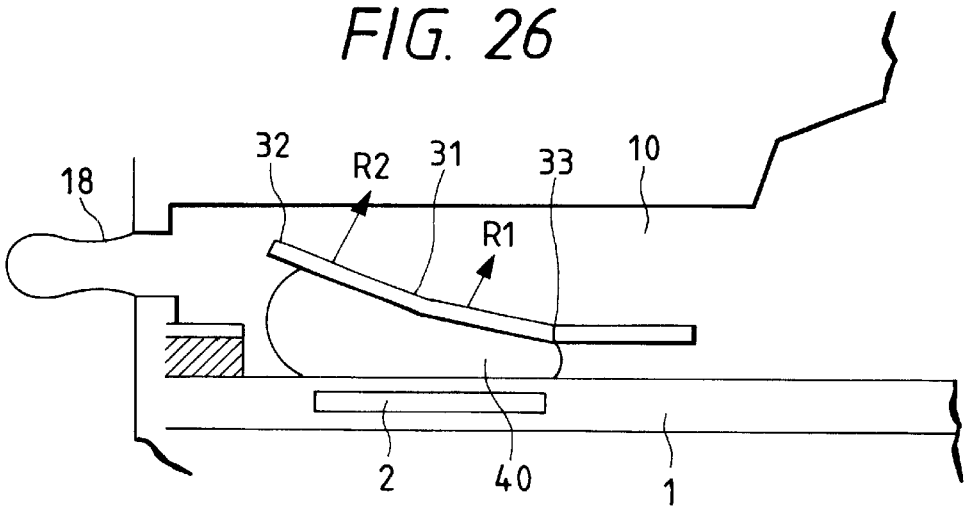
FIG. 26 is a cross-sectional view which schematically shows a liquid jet head in accordance with the fourteenth embodiment in accordance with the present invention.

It is possible to make the displacing speed of the movable member faster in the position of the free end by arranging the structure to position the free end of the movable member 31 further on the downstream side as shown in FIG. 26, and then, to enhance the generation of discharging power by the displacement of the movable member. In other words, the second displacement area (the portion having a stronger rigidity on the fulcrum side) of the movable member leads the portion of the air bubble on the upstream side to the free end side, thus making it possible for the first displacement area (the portion having a weaker rigidity on the free end side) to function more effectively to lead the pressure of the air bubble to the discharge port side.

Also, in accordance with the developing speed of the air bubble on the central portion of its pressure, the second displacement area of the movable member 31 is displaced at a displacing speed R1. However, the first displacement area, which is positioned further away from this position with respect to the fulcrum 33, is displaced at a faster speed R2. In this way, the free end 32 side acts upon liquid at a higher speed mechanically, thus contributing to shifting liquid for the enhancement of the discharging efficiency.

Also, as compared with the previous embodiments, the free end is positioned closer to the discharge port side. As a result, it becomes possible to intensively utilize the directional components of the air bubble development more stably for the performance of excellent discharging in a better condition.

(Embodiment 15)

Figure 27A:
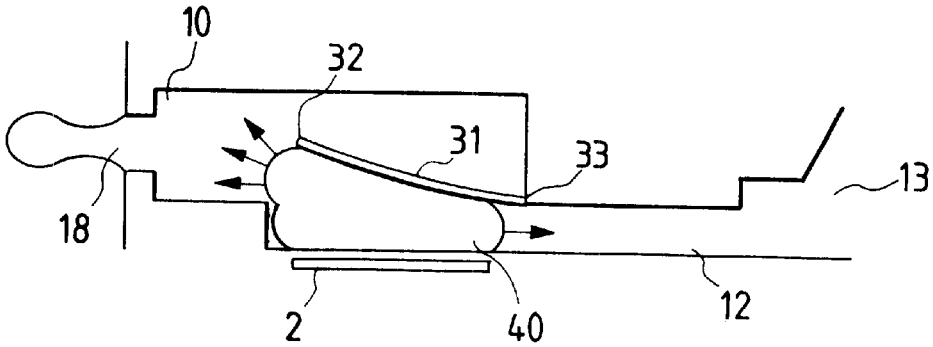
FIGS. 27A, 27B and 27C are cross-sectional views which schematically illustrate a liquid jet head (two-flow path structure) in accordance with the fifteenth embodiment in accordance with the present invention.
Figure 27B:
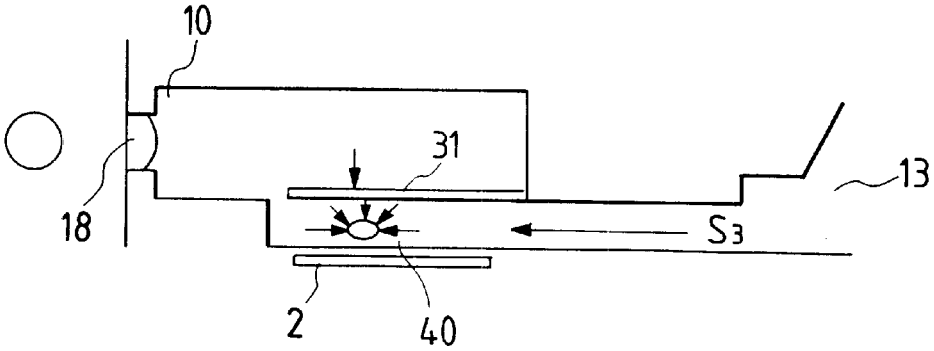
Figure 27C:
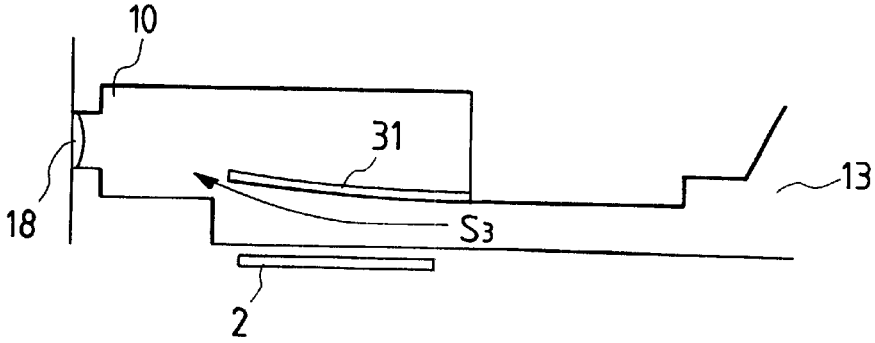

In order to attempt the simplicity of the structure, it may be possible to arrange the structure, as shown in FIGS. 27A to 27C so that the area, which is conductively connected with the discharge port directly, is not in the flow path configuration that is conductively connected with the liquid chamber side. In this case, all the liquid supply is performed from the liquid supply path 12 arranged along the surface of the movable member 31 on the foaming area side.

In the process of transit from the state where liquid is foamed by means of the heat generating element 2 (the state shown in FIG. 27A) to the state where foaming is being contracted (the state shown in FIG. 27B), the movable member 31 returns to the initial position and liquid is supplied at S3 for this liquid jet head. Then, in the state shown in FIG. 27C, the slight regression of meniscus M, which has taken place when the movable member returns to the initial position, is compulsorily refilled by means of capillary force residing in the vicinity of the discharge port 18 after defoaming.

(Embodiment 16)

Figure 28A:
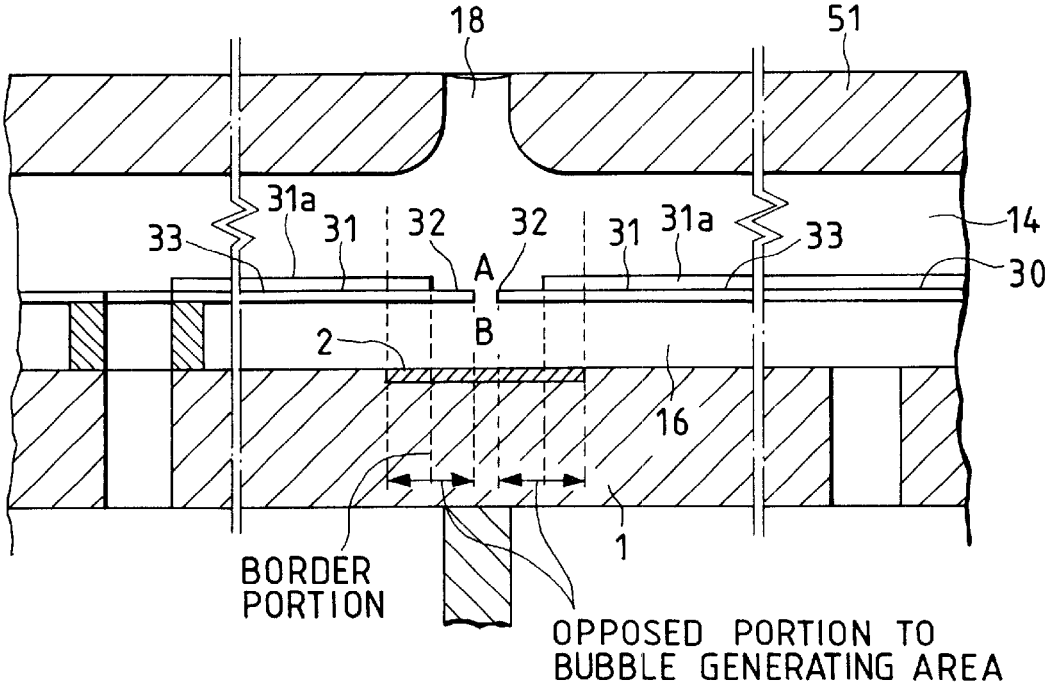
FIGS. 28A and 28B are partially broken perspective views which schematically illustrate one embodiment of a liquid jet head in accordance with the present invention.
Figure 28B:
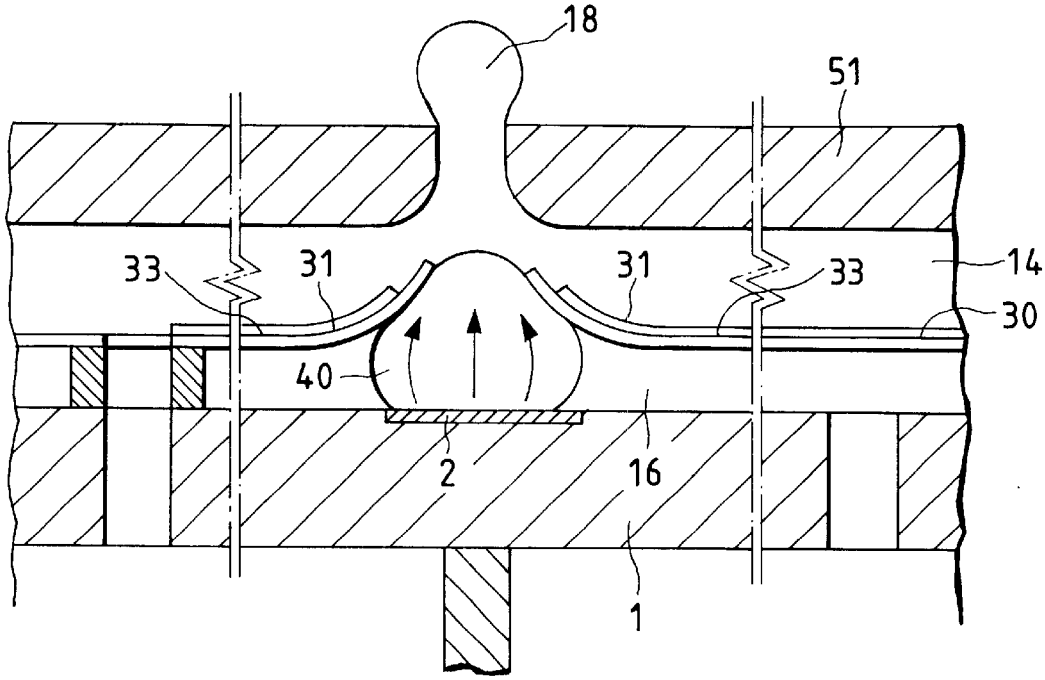

FIGS. 28A and 28B are cross-sectional views which schematically illustrate one embodiment of a liquid jet head in accordance with the present embodiment.

The liquid jet head is of the so-called side shooter type where the discharge port 18 is arranged to face the heat generating surface of the heat generating element 2 substantially in parallel with each other. Each of the heat generating elements 2 (for the present embodiment, each heat generating resistor of 48 $\mu$m×46 $\mu$m) is arranged on an elemental substrate 1 to generate thermal energy utilized for the generation of film boiling in liquid as disclosed in the specification of U.S. Pat. No. 4,723,129 to create air bubbles. The discharge port 18 is arranged for the orifice plate 51 that serves as the discharge port member.

The liquid flow path 14 is arranged between the orifice plate 51 and the elemental substrate 1 for the flow of liquid. This liquid flow path is conductively connected with the discharge port member.

In the liquid flow path 16, there are arranged two movable members 31, each in a flat plate cantilever fashion, to face the heat generating element 2. Each of the movable members is structured so that the reinforcement member or reinforcement shaping is provided for a part thereof to enhance the rigidity of each movable member as in each of the embodiments described above. For each of the movable members, given each displacement area as a first displacement area and a second displacement area from the discharge port side, respectively, the strength of each displacement area presents the relationship of (the first displacement area)<(the second displacement area). Here, it is effective to set the boundary portion between each of the displacement areas on the portion that faces the air bubble generating area (or the heat generating element 2) as referred to each of the embodiments described above. Preferably, such boundary should be in the area ±30% of the length of the portion that faces it from the center of such portion or more preferably, the area ±10% thereof. Also, the reinforcement member should be positioned on the area that includes the fulcrum so that it may act upon it.

When heat is generated from the heat generating surface of the heat generating element 2, air bubble is created in liquid. Then, the first and second displacement area of each movable member function to enable the free end side to be displaced more, thus leading the pressure of the air bubble on the downstream side and the upstream side intensively to the free end side of each movable member efficiently. Then, the air bubble is led in the discharge port direction efficiently and stably.

At the time of defoaming, each of the movable members 31 returns to the original position, and the discharge port side of the air bubble generating area is in the essentially closed state when liquid is supplied onto the heat generating element at that time. Therefore, it is possible to obtain various effects described for the previous embodiments, such as to suppress the regression of meniscus. Also, as to refilling effects, it is possible to obtain the same functions and effects as in the previous embodiments.

(Other Embodiments)

Now, the description has been made of the embodiments of the principal parts of the liquid jet head and the liquid discharging method in accordance with the present invention. Hereinafter, in conjunction with the accompanying drawings, the description will be made of the examples of modes embodying the present invention, which are preferably applicable to those embodiments described above. Here, in the description given below, either one of the embodiment of the one-flow structure and that of the two-flow structure is taken up for description. However, it is to be understood that such structure is applicable to both embodiments of one- and two-flow structures unless otherwise specifically stated. (Movable Member and Separation Wall)

Figures 39A, 39B, 39C:
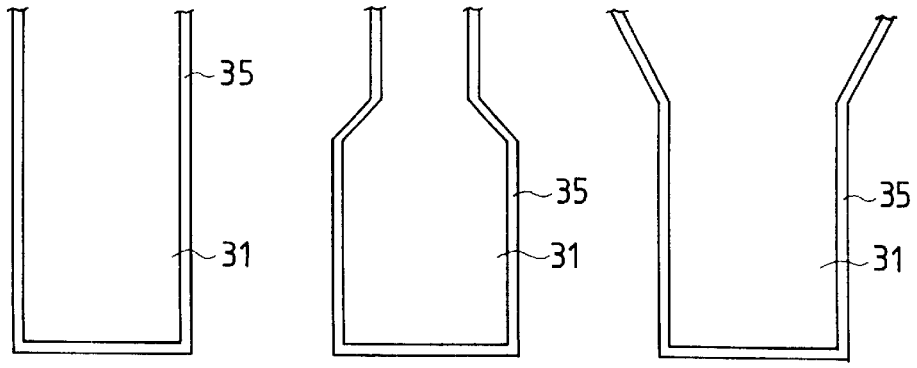
FIGS. 39A, 39B and 39C are views which illustrate the other configurations of movable members.

FIGS. 39A, 39B, and 39C are views which illustrate other configurations of the movable member 31. A reference numeral 35 designates each slit arranged for them, respectively. By means of the slit 35, each movable member 31 is formed. FIG. 39A shows an elongated rectangular configuration; FIG. 39B shows the configuration having narrower portion on the fulcrum side to facilitate the movement of the member; FIG. 39C shows the configuration having the wider portion on the fulcrum side to enhance the durability of the member. Here, it should be good enough if only the movable member is configured to facilitate its movement, but to present excellent durability.

For the previous embodiment, the flat type movable member 31 and the separation wall 30 having such movable member on it is formed by nickel of 5 $\mu$m thick. However, the material is not necessarily limited to it. As the material used to structure a movable member and a separation wall, it should be good enough if only such material has solvent resistance to bubbling liquid and discharging liquid, while having elasticity that admits of good operation as a movable member, and also, properties that enable a fine slit to be formed therefor.

For the material of the movable member, it is preferable to use highly durable metal, such as silver, nickel, gold, iron, titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or titanium or its alloys and those having them coated on its surface for obtaining resistance to ink, or resin having polyamide or other amide group, resin having polyacetal or other aldehyde group, resin having polyether ketone or other ketone group, resin having polyimide or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

For the material of the separation wall, it is preferable to use resin having good properties of resistance to heat and solvent, as well as good formability as typically represented by engineering plastics in recent years, such as polyethylene, polypropylene, polyamide, polyethylene telephthalate, melamine resin, phenol resin, epoxy resin, polybutadiene, polyurethane, polyether etherketone, polyether sulfone, polyarylate, polyimide, polysulfone, or liquid crystal polymer (LCP) and its compound or silicon dioxide, silicon nitride, nickel, gold, stainless steel or other metals, its alloys or those coated with titanium or gold.

Also, the thickness of the separation wall is determined in consideration of the properties of material, the desired configuration, and the like with a view to attaining the strength required for a separation wall, and to providing good operation as a movable member as well. However, it is preferable to make the thickness approximately 0.5 $\mu$m to 10 $\mu$m.

In this respect, the width of the slit 35 that forms the movable member 31 is set at 2 $\mu$m for the present embodiment. However, if bubbling liquid and discharging liquid are different ones, the mixture of which should be avoided, the width of the slit is arranged to be approximately equal to a gap that enable the formation of meniscus between both of the liquids, while suppressing the distributions of both liquids themselves, respectively. For example, when using liquid of 2 cp (2 centipoise) as foaming liquid, while using liquid of 100 cp as discharging liquid, it may be possible to prevent them from being mixed by means of a slit of approximately 5 μm. However, it is preferable to set it at 3 μm or less.

In accordance with the present invention, the target thickness of a movable member is (t μm). There is no intention to use any movable member whose thickness is in cm order. When the width of slit of μm order (W μm) is taken up as objectives, it is desirable to consider some variation thereof that may be brought about during the process of manufacture.

When only the free end of a movable member where a slit is formed and/or the thickness of a member that faces the side end thereof are made equal to the thickness of the movable member (see FIG. 37 or the like), it becomes possible to suppress the mixture of bubbling liquid and discharging liquid stably if the relationship between the width and the thickness of the slit is kept within the range given below in consideration of the variation that may be brought about during the process of manufacture. This is a limited condition, but from the design consideration, if the structure is arranged to satisfy the condition of $W/t \leqq 1$, it is possible to suppress the mixture of these two liquids for a long time, provided that a highly viscous ink (5 cp, 10 cp, or the like) is used with respect to a bubbling liquid whose viscosity is 3 cp or less.

As a slit that satisfies the "essentially closed state" defined for the present invention, the slit produced in an order of several μm should be preferable for more reliable performance.

(Elemental Substrate)

Now, hereunder, the description will be made of the structure of an elemental substrate having heat generating elements arranged therefor to apply heat to liquid.

Figure 40A:
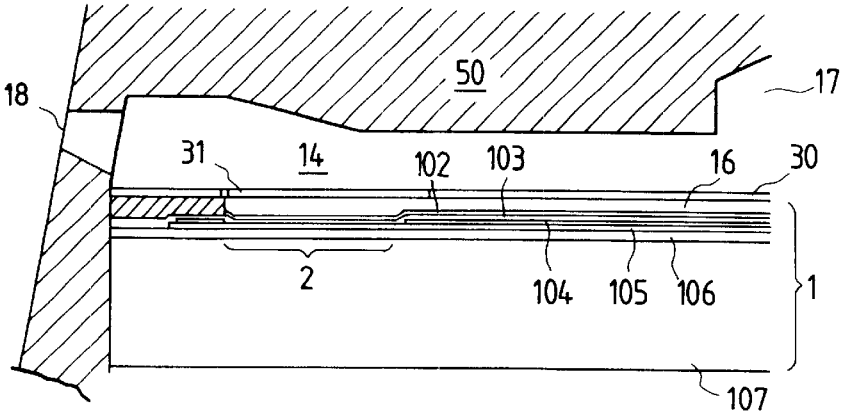
FIGS. 40A and 40B are vertically sectional views which illustrate a liquid jet head in accordance with the present invention.
Figure 40B:
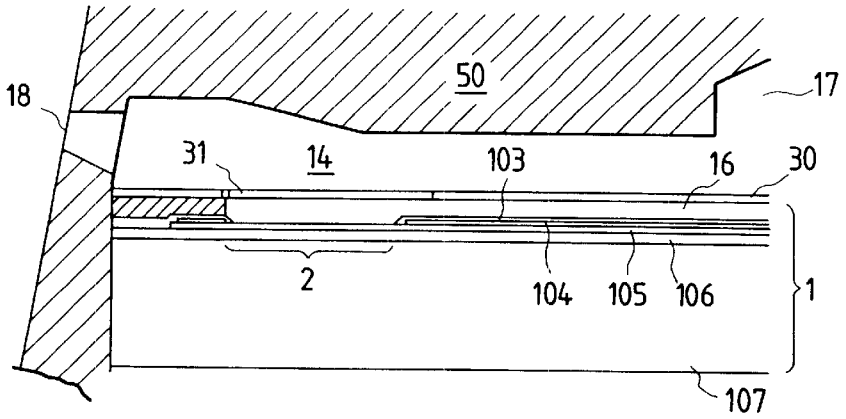
Figure 41:
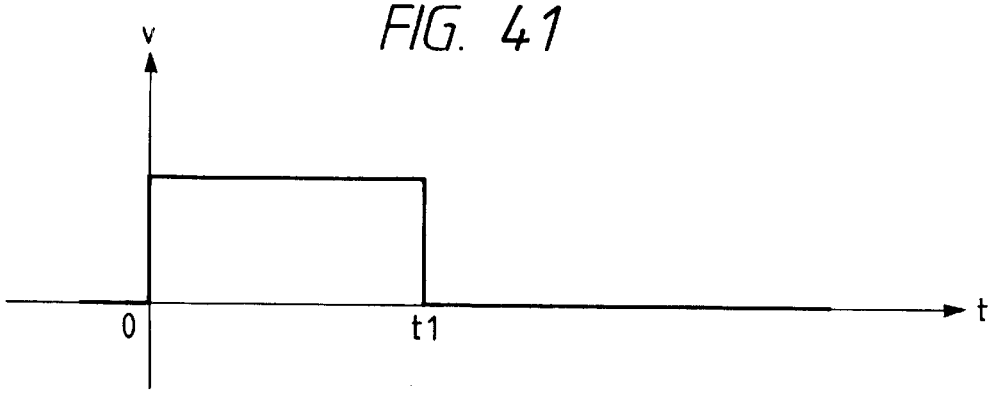
FIG. 41 is a view which schematically shows the shape of a driving pulse.

FIGS. 40A and 40B are vertically sectional views of liquid jet heads of the present invention; FIG. 40A shows a head having a protection film to be described later; and FIG. 40B shows a head having no protection film, respectively.

On the elemental substrate 1, a grooved member 50 is arranged, which is provided with the second liquid flow path 16, the separation wall 30, and the first liquid flow path 14.

For the elemental substrate 1, silicon oxide or silicon nitride film 106 is formed on a substrate 107 of silicon or the like for the purpose of insulation and heat accumulation, and on it, hafnium boride ($HfB_2$), tantalum nitride (TaN), tantalum aluminum (TaAl) or other electric resistance layer 105 (0.01 to 0.2 μm thick) aluminum wire electrodes (0.2 to 1.0 μm thick) or the like, are laminated and patterned as shown in FIG. 13. Voltage is applied to the resistance layer 105 from two wire electrodes 104 to cause current to ran on the resistance layer, thus generating heat. On the resistance layer across wire electrodes, a protection layer of silicon oxide or silicon nitride is formed in a thickness of 0.1 to 2.0 μm. Further, on it, an anti-cavitation layer of tantalum or the like is filmed (in a thickness of 0.1 to 0.6 μm). In this way, the resistance layer 105 is protected from ink or various other liquids.

Particularly, since the pressure and shock waves generated at the time of creating air bubble, and at the time of defoaming are extremely strong, the durability of the rigid and brittle oxide film is reduced significantly. Therefore, the tantalum (ta) or other metal is used as an anti-cavitation layer.

Also, it may be possible to arrange a structure that does not require the protection layer described above by arranging the combination of liquid, the structure of liquid flow path, and resistive material. FIG. 40B shows the example thereof. As the material for the resistance layer that does not require such protection layer, an alloy of iridium-tantalum-aluminum or the like may be cited.

Then, for the structure of heat generating elements adopted for each of the embodiments described above, it may be possible to provide only resistance layer (heat generating layer) between the electrodes or to include the protection layer to protect the resistance layer.

For the present embodiment, heat generating elements are used, each having heat generating unit structured by the resistive layer that generates heat in response to electric signals. However, the present invention is not limited to the use of such heat generating elements. It should be good enough if only each of the heat generating elements is capable of creating air bubbles in liquid sufficiently so as to enable liquid to be discharged. For example, the optothermal transducing elements whose heat generating unit generates heat when receiving laser beam or other light or some other heat generating elements provided with heat generating unit that generates heat when receiving high frequency.

Here, for the elemental substrate 1 described above, it may be possible to incorporate transistors, diodes, latches, shift registers and other functional elements integrally in the semiconductor manufacturing process, besides the resistance layer 105 constituting the heat generating unit and the electrothermal transducing elements structured by the wire electrodes 104 that supply electric signals to the resistive layer, in order to selectively drive the electrothermal transducing elements.

Also, in order to drive each heat generating unit of the electrothermal transducing elements arranged for the elemental substrate described above for discharging liquid, rectangular pulses as shown in FIGS. 40A and 40B are applied to the resistance layer 105 through the wire electrodes 104, thus causing the resistive layer between the wire electrodes to generate heat abruptly. For each head of the previous embodiments, electric signals are applied at 6 kHz to drive each of the heat generating element at the voltage of 24 V, with pulse width of 7 μsec, and current of 150 mA. With such operation, ink liquid is discharged from each of the discharge ports. However, the condition of the driving signals is not necessarily limited to the one described above. It should be good enough if only driving signals are such as to enable bubbling liquid to foam appropriately.

(Discharging Liquid and Foaming Liquid)

As described for the previous embodiments, the present invention makes it possible to discharge liquid with higher discharging power and discharging efficiency than the conventional liquid jet head by the adoption of the structure provided with the movable member described earlier. The speed of liquid discharge is also made higher. When the same liquid is used as foaming liquid, and also, as discharging liquid for some of the structures embodying the present invention, it is possible to use various kinds of liquids if only the liquid to be used is such that its quality is not deteriorated by the application of heat; it does not generate deposit easily on the heating elements when being heated; and it is capable of presenting reversible change of states by means of vaporization and condensation when being heated; and also, it does not cause each liquid flow path, movable member, and wall member to be deteriorated.

Of such liquids, it is possible to use ink having the composition used for the conventional bubble jet apparatus as liquid to be used for recording (recording liquid).

On the other hand, when different liquids are used as discharging liquid and forming liquid, respectively, by use of a head having the two-flow path structure of the present invention, it should be good enough to use liquid having the properties described above as foaming liquid. More specifically, the following can be named: methanol, ethanol, n-propanol, isopropanol, n-hexan, n-heptane, n-octane, toluene, xylene, ethylene dichloride, trichrolo ethylene, Freon TF, Freon BF, ethyl ether, dioxane, cyclohexane, methyl acetate, ethyl acetate, acetone, methyl ether ketone, water, and its mixtures, among others.

As discharging liquid, various kinds of liquid can be used irrespective of the presence and absence of foaming property and thermal characteristics. Also, even the liquid whose foaming capability is low to make discharging difficult by use of the conventional head; the liquid whose properties are easily changeable or deteriorated when receiving heat; or the liquid whose viscosity is high; is usable as discharging liquid.

However, as the properties of discharging liquid, it is desirable that such liquid is the one that does not hinder discharging, foaming, and the operation of the movable member or the like by the discharging liquid itself or by reaction caused by its contact with foaming liquid.

As discharging liquid for recording, it is possible to use highly viscous ink or the like. As other discharging liquids, it may be possible to cite the use of such liquid as the medicine and perfume whose properties are not strong against heat.

For the present invention, recording is performed using ink having the following composition as a recording liquid capable of being used as both discharging liquid and foaming liquid; here, with the enhanced discharging power, the discharging speed of ink becomes high, making it possible to obtain recorded image of extremely high quality brought about by the enhanced shooting accuracy of droplets: Colorant ink having a viscosity of 2 cp:

| | |
|---|---|
| (C-I. food black 2) Colorant | 3 wt % |
| diethylene glycol | 10 wt % |
| thiodiglycol | 5 wt % |
| ethanol | 5 wt % |
| water | 77 wt % |

Also, recording is performed by combining liquid having the following composition together with bubbling liquid and discharging liquid; here, as a result, it becomes possible to discharge liquid having a high viscosity of 150 cp, not to mention the one having that of ten and several cp, all in such good condition that the conventional head cannot effectuate easily, and to obtain recorded images of higher quality:

| | |
|---|---|
| Bubbling liquid 1: | |
| ethanol | 40 wt % |
| water | 60 wt % |
| Bubbling liquid 2: | |
| water | 100 wt % |
| Bubbling liquid 3: | |
| isopropyl alcohol | 10 wt % |
| water | 90 wt % |
| Discharge liquid 1; colorant ink (viscosity approximately 15 cp): | |
| carbon black | 5 wt % |

-continued

| | |
|---|---|
| styrene-acrylic acid-acrylic acid ethylepolymer (oxide 140, weight mean molecular quantity 8,000) | 1 wt % |
| monoethanol amine | 0.25 wt % |
| glycerine | 69 wt % |
| thiodiglycol | 5 wt % |
| ethanol | 3 wt % |
| water | 16.75 wt % |
| Discharge liquid 2 (viscosity 55 cp): | |
| polyethylene glycol 200 | 100 wt % |
| Discharge liquid 3 (viscosity 150 cp): | |
| polyethylene glycol 600 | 100 wt % |

Now, when using the liquid which cannot be discharged easily by means of the conventional discharging described above, the variation of discharging orientation tends to be promoted because of slower discharging speeds. As a result, the shooting accuracy of dots onto a recording sheet becomes unfavorable, making it difficult to obtain images of high quality in accordance with the conventional art. However, with the embodiments structured as described above, the air bubbles can be created sufficiently and stably by use of foaming liquid. As a result, it becomes possible to enhance the shooting accuracy of droplets and stabilize the discharging amount of ink, hence leading to the significant enhancement of the quality of recorded images.

(Structure of Head Having Two-Flow Path Structure)

Figure 42:
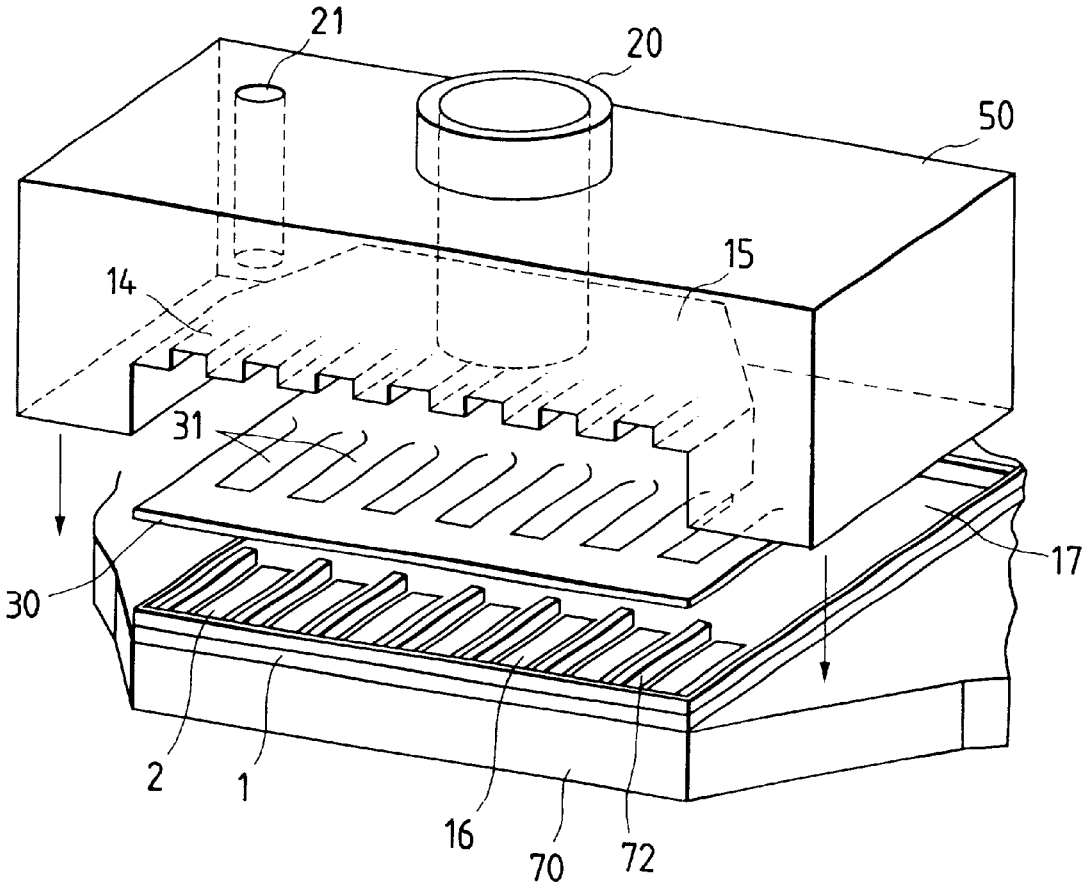
FIG. 42 is an exploded perspective view which shows a head of the present invention.

FIG. 42 is an exploded perspective view which shows the entire structure of the two-flow structure of head among the liquid jet heads of the present invention.

On the supporting element made of aluminum or the like, an elemental substrate 1 is arranged as described earlier. On the elemental substrate, the wall 16*a* of the second liquid flow path 16, and the wall 17*a* of the second common liquid chamber 17 are arranged. On these walls, the separation wall 30, which is provided with the movable member 31, is arranged. Further, on the separation wall 30, the grooved member 50 is arranged. This member is provided with a plurality of grooves that constitute the first liquid flow path 14, the first common liquid chamber 15, the supply path 20 for supplying the first liquid to the first common liquid chamber 15, and the supply path 21 for supplying the second liquid to the second common liquid chamber 17. With such structure as this, the two-flow path liquid jet head is constituted.

(Structure of Head Cartridge)

Now, the brief description will be made of the liquid jet head cartridge that mounts a liquid jet head produced in accordance with the present invention described above.

Figure 43:
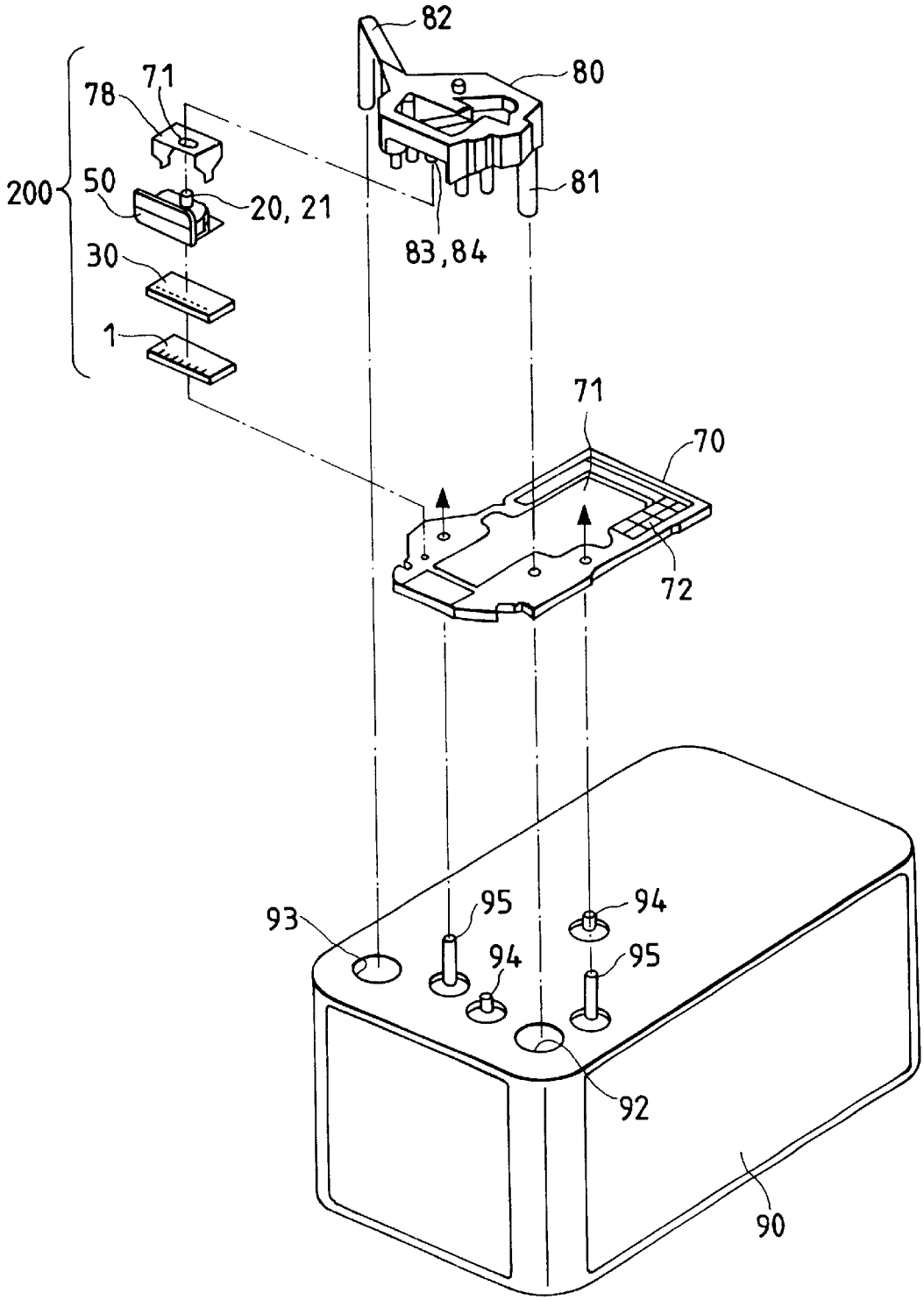
FIG. 43 is an exploded perspective view which shows a liquid jet head cartridge.

FIG. 43 is an exploded perspective view which schematically shows a liquid jet head cartridge. The liquid jet head cartridge is structured mainly by the liquid jet head unit 200 and the liquid container 90.

The liquid jet head unit 200 comprises the elemental substrate 1, the separation wall 30, the grooved member 50, the pressure spring 78, the liquid supply member 90, and the supporting element 70. A plurality of heat generating resistors (heat generating elements) are arranged in line on the elemental substrate 1. Also, a plurality of functional elements are arranged to selectively drive these heat generating resistors. Each of the bubbling liquid flow paths is formed between the elemental substrate 1 and the separation wall 30 having movable member arranged therefor. Bubbling liquid is distributed in each of the flow paths. The separation wall 30 and the grooved ceiling plate 50 are adhesively bonded to form the liquid flow path (not shown) in order to distribute the discharging liquid for discharging.

The pressure spring 78 is a member that exerts biasing force on the grooved member 50 in the direction of the elemental substrate 1. By the application of this biasing force, the elemental substrate 1, the separation wall 30, the grooved member 50, and the supporting element 70 (to be described later) are put together in good condition.

The supporting element 70 is a member to support the elemental substrate 1 and others. On the supporting element 70, there are arranged the printed-circuit board 71, which is connected with the elemental substrate 1 to supply electric signals, and also, the contact pads 72, which are connected with the apparatus side to exchange electric signals with it.

The liquid container 90 retains ink or other discharging liquid, and bubbling liquid to create air bubbles in it. On the outer side of the liquid container 90, there are arranged a positioning unit 94 to connect the liquid jet head and the liquid container, and a fixed shaft 95 for fixing them. Discharging liquid is supplied from the discharge liquid supply path 92 of the liquid container to the discharging liquid supply path 81 of the liquid supply member 80, and then, supplied to the first common liquid chamber through each of the discharging liquid supply paths 83, 71, and 21 of each member, respectively. Likewise, bubbling liquid is supplied from the supply path 93 of the liquid container to the bubbling liquid supply path 82 of the liquid supply member 80 through the supply path of the liquid supply member, and then, supplied to the second liquid chamber through each of the bubbling liquid supply paths 84, 71, and 22.

For the liquid jet head cartridge described above, the description has been made of the supply mode and the liquid container capable of performing supply even in a case where bubbling liquid and discharging liquid are different liquids. However, when the discharging liquid and bubbling liquid are the same, the supply path for bubbling liquid and that for discharging liquid, and the container are not necessarily separated.

In this respect, the liquid container may be used by refilling liquid after each liquid has been consumed. To this end, it is desirable to arrange a liquid injection port for the liquid container. Also, it may be possible to form the liquid jet head and liquid container integrally or to form them separately.

(Liquid Jet Apparatus)

Figure 44:
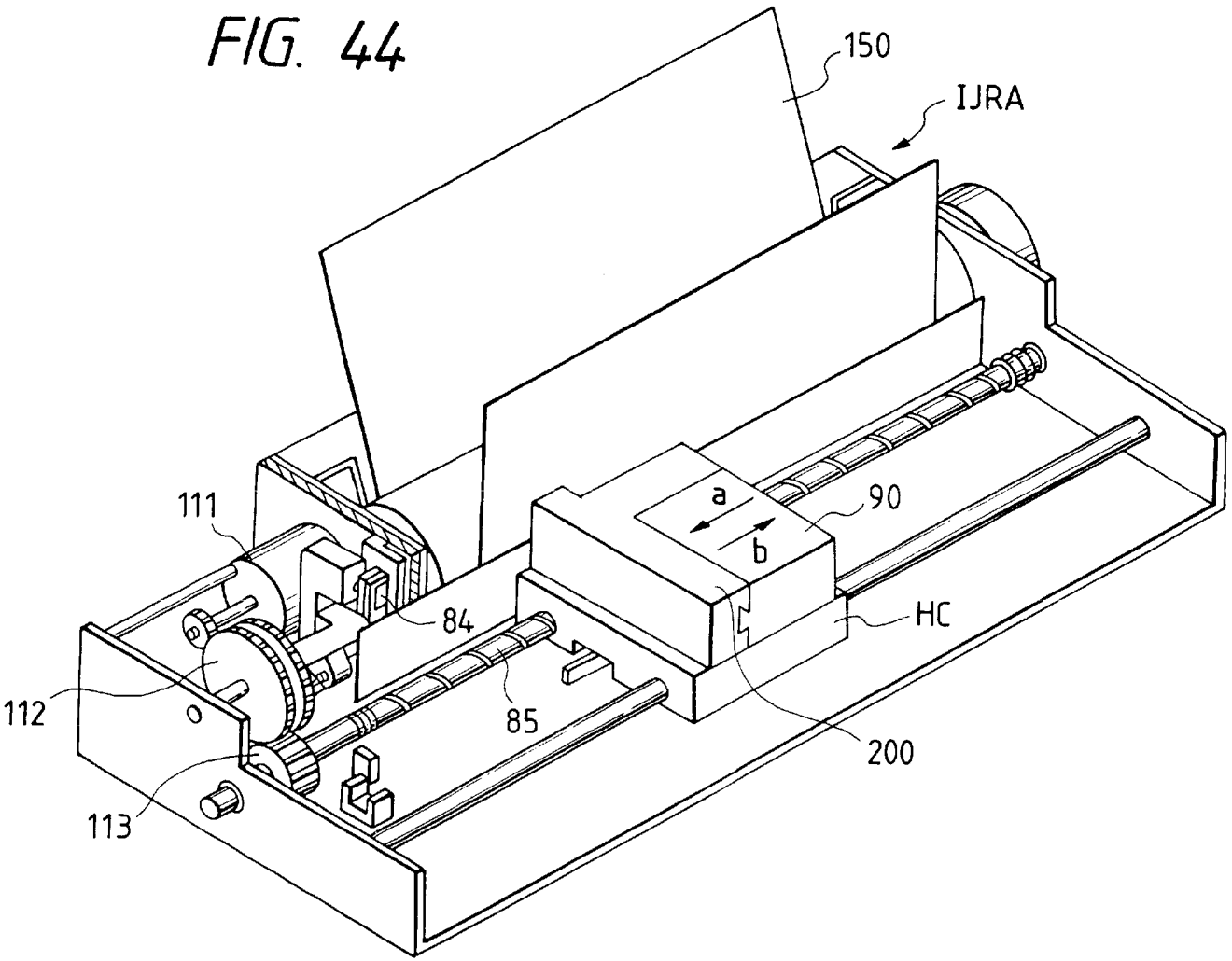
FIG. 44 is a structural view which shows a liquid jet apparatus briefly.

FIG. 44 is a view which schematically shows the liquid jet apparatus that mounts the liquid jet head described above. Here, particularly, the description will be made of an ink jet recording apparatus using ink as discharging liquid. The carriage HC of the liquid jet apparatus mounts detachably the head cartridge, which comprises a liquid tank unit 90 for containing ink and liquid jet head unit 200, and reciprocates in the width direction of a recording medium, such as recording sheet, which is carried by recording medium carrier means.

When driving signals are supplied to the liquid jet head unit on the carriage HC from driving signal supply means (not shown), recording liquid is discharged from the liquid jet head onto the recording medium in response to these signals.

Also, the recording apparatus is provided with a motor 111 as the driving source, gears 112 and 113, and carriage shaft 115 or the like to transfer the driving power from the driving source to the carriage. It is possible to obtain recorded objects having good images by discharging liquid onto various kinds of recording media by use of this recording apparatus and liquid discharging method adopted for the recording apparatus.

Figure 45:
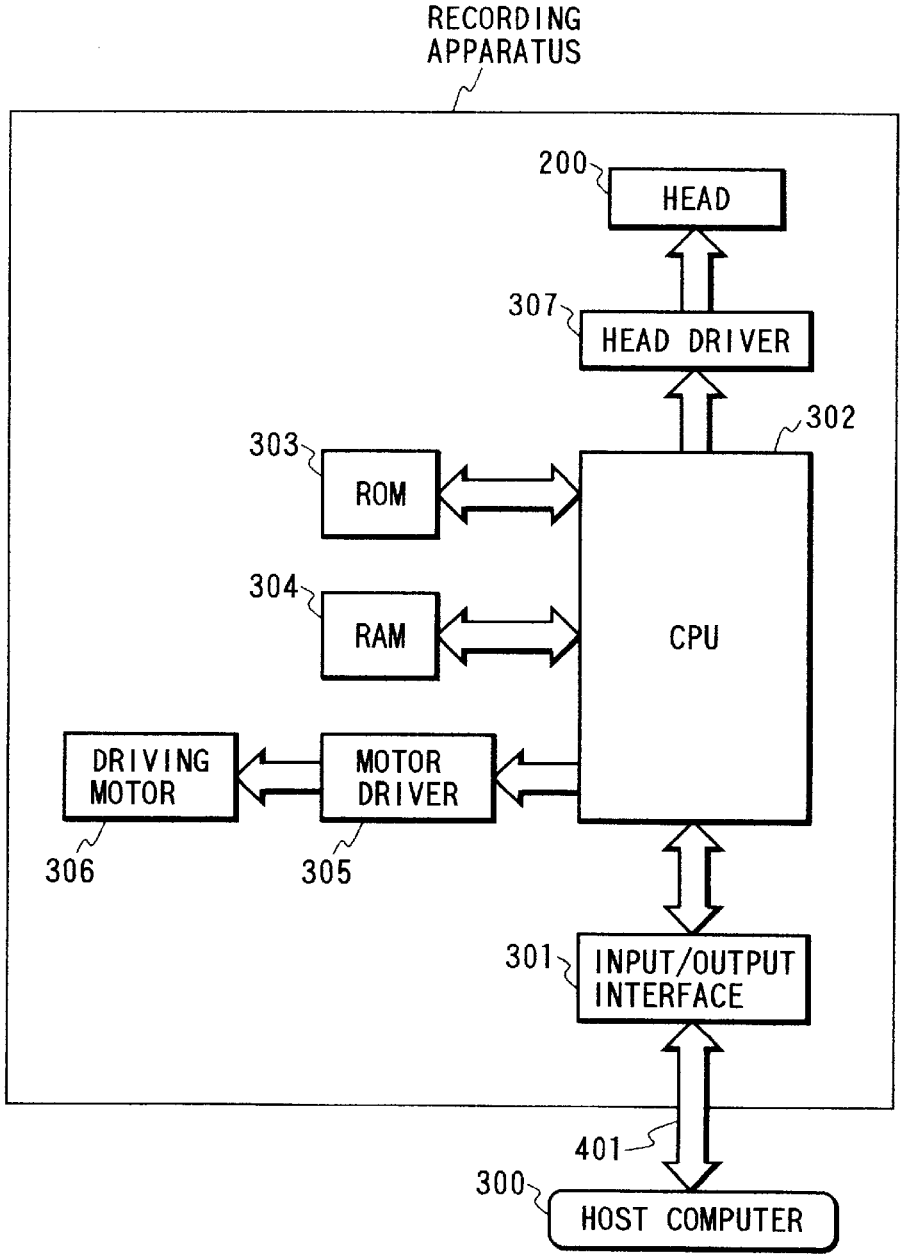
FIG. 45 is a block diagram which shows the structure of a recording apparatus.

FIG. 45 is a block diagram which shows the recording apparatus as a whole, which discharges ink for recording by the application of the liquid discharging method, and by use of the liquid jet head of the present invention.

This recording apparatus receives printing information from a host computer 300 as control signals. The printing information is provisionally stored in the input interface 301 of the recording apparatus. At the same time, the printing information is converted to the data that can be processed in the recording apparatus, thus being inputted into the CPU 302 that dually functions as means for supplying head driving signals. The CPU 302 processes the inputted data using peripheral units such as RAM 304 and others in accordance with the controlling program stored in the ROM 302, and converts them to printing data (image data).

Also, the CPU 302 produces motor driving data in order to drive the driving motor that carries the recording sheet and the recording head in synchronism with each other for recording the image data in appropriate positions on the recording sheet. The image data and driving data are transferred to the head 200 and driving motor 306 through the head driver 307 and the motor driver 305, respectively, which are driven in accordance with the controlled timing to form images.

As the recording medium usable by the recording apparatus described above for the provision of ink or other, there can be named various paper and OHP sheets, plastic materials used for compact disc, ornamental board, or the like, cloths, metallic materials such as aluminum and copper, cattle hide, pig hide, artificial leathers or other leather materials, wood, plywood, bamboo, tiles and other ceramic materials, sponge or other three-dimensional structures.

Also, as the recording apparatus described above, there can be named a printing apparatus for recording on various paper and OHP sheets, a recording apparatus for plastic use to record on compact disc and other plastic materials, a recording apparatus for recording on metallic plates, a recording apparatus for use to record on leathers, a recording apparatus for use to record on woods, a recording apparatus for use to record on ceramics, a recording apparatus for use to record on a three-dimensional net structure such as sponge. Also, a textile printing apparatus that records on cloths is included.

As discharging liquid used for these liquid jet apparatuses, it may be possible to use any one of the liquids depending on the kinds of recording media and recording condition.

(Recording System)

Now, the description will be made of one example of ink jet recording system that uses the liquid jet head of the present invention as its recording head to perform recording on a recording medium.

Figure 46:
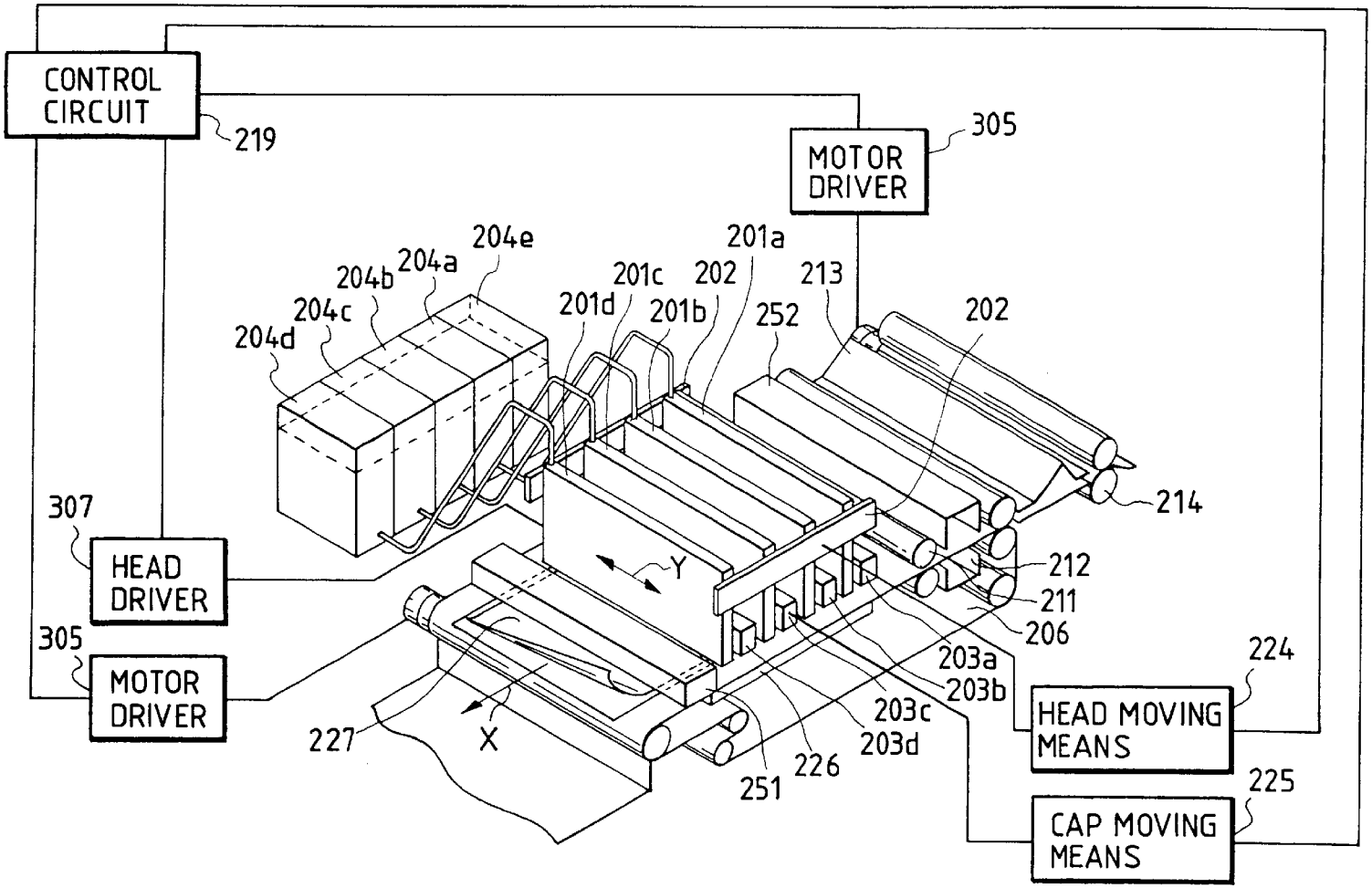
FIG. 46 is a view which shows a liquid jet recording system.
Figure 47A:
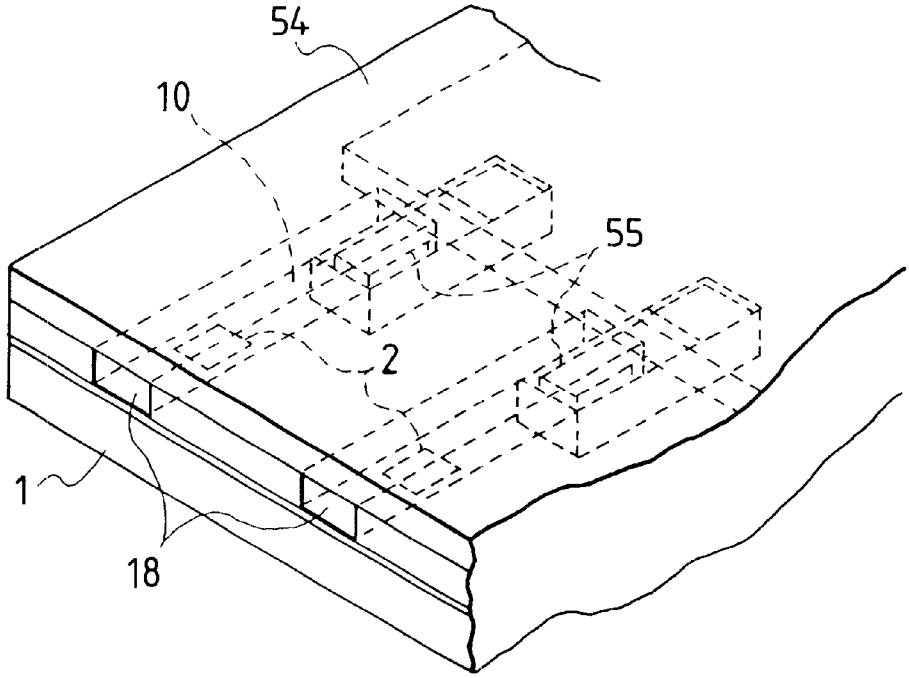
FIGS. 47A and 47B are views which illustrate the liquid flow path of the conventional liquid jet head.
Figure 47B:
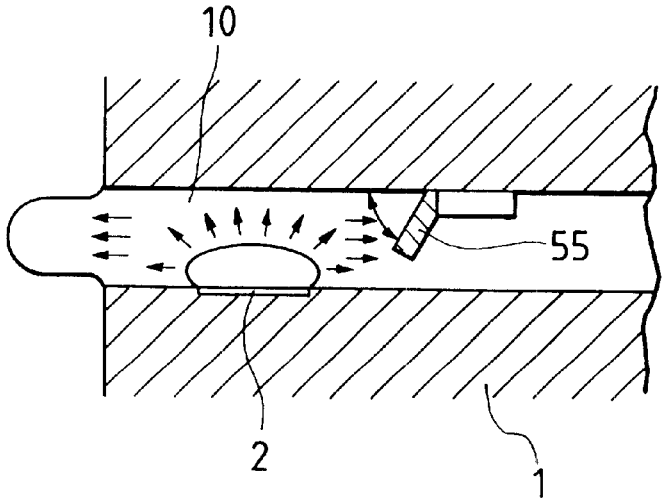

FIG. 46 is a view which schematically illustrate the structure of this ink jet recording system using the liquid jet head 201 of the present invention described above. The liquid jet head of the present embodiment is a full line type head where a plurality of discharge ports are arranged in the length that corresponds to the recordable width of a recording medium 150 at the interval (density) of 360 dpi. Four liquid jet heads 201*a*, 201*b*, 201*c*, and 201*d* are fixedly supported by the holder 202 in parallel to each other at given intervals in the direction X corresponding to four colors, yellow (Y), magenta (M), cyan (C), and black (Bk), respectively. From the head driver 307 constituting driving signal supplying means, signals are supplied to each of the liquid jet heads.

To each of the heads, four different color ink, Y, M, C, Bk, are supplied from the ink containers 204*a* to 204*d* as discharging liquid, respectively. Here, a reference numeral 204 designates the bubbling liquid container, and the structure is arranged to supply bubbling liquid to each of the liquid jet heads.

Also, below each of the liquid jet heads, head caps 203*a* to 203*d* are arranged with sponge or other ink absorbing material contained in them, which cover the discharge ports of the liquid jet heads in order to maintain each of the heads when recording operation is at rest.

Here, a reference numeral 206 designates a carrier belt which is arranged to constitute carrier means for carrying each kind of recording medium as described earlier for each of the embodiments. This carrier belt 206 is drawn around various rollers at given passage and driven by driving rollers connected with the motor driver 305.

Also, for the ink jet recording system of the present embodiment, a pre-processing device 251, and post-processing device 252 are installed on the upstream and downstream of the recording medium carrier passage to perform various processes with respect to the recording medium before and after recording.

The pre-processing and post-processing are different in the contents of the corresponding process depending on the kinds of recording media and kinds of ink. For example, with respect to recording on a medium such as metal, plastic, or ceramic, ultraviolet lays and ozone are irradiated to activate the surface of the medium used, thus improving the adhesion of ink thereto. Also, when recording on a medium, such as plastic, that easily generates static electricity, dust particles are easily attracted to the surface thereof to hinder good recording in some cases. Therefore, as the pre-processing device, an ionizer is used to remove static electricity. In this way, dust particles should be removed from the recording medium. Also, when cloths are used as a recording medium, a pre-processing may be performed to provide a substance selected from among alkali substance, water-soluble substance, synthetic polymer, water-soluble metallic salt, urea, and thiourea for recording on cloths in order to prevent stains on them, while improving its coloring rate. However, the pre-processing is not necessarily limited to those described above. It may be the process to adjust the temperature of a recording medium appropriately to a temperature suited for recording on such medium.

On the other hand, fixation process is performed as the post-processing to promote the fixation of ink by executing heating process or irradiation of ultraviolet rays, among some others, for the recording medium for which ink has been provided. Cleaning process is also performed as a post-processing to rinse off the processing agent provided for the recording medium in the pre-processing but still remaining inactive.

Here, the description has been made in assumption that a full line head is used as the liquid jet head, but the present invention is not necessarily limited to the full line head. It may be possible to apply the present invention to such a mode that the smaller liquid jet head described earlier is carried in the width direction of a recording medium for recording.

Further, it is possible to enhance the effects of the present invention by combining at least two of the embodiments described above with respect to each one of them.

Now, with respect to the first and second embodiments, the pressure of the air bubble acts upon the free end side of the movable member to lead the pressure at the time of foaming and the development of the air bubble in the discharging direction efficiently. At the same time, the displacement of the movable member is performed smoothly, thus enhancing the durability of the movable member.

With respect to the third to seventh embodiments, the structure is arranged to enable the pressure of the air bubble on the air bubble generating area to act largely upon on the portion nearer to the free end of the movable member. Hence, it is made possible to materialize the state of the movable member in which the free end of the movable member is largely displaced at the early stage of the displacement of the movable member over all the displacement operation thereof. In this way, a higher discharging efficiency and stability of discharge are attained. At the same time, the displacing configuration of the movable member is reproduced stably at all times. Consequently, the displacement operation is performed smoothly, and the durability of the movable member is also enhanced.

With respect to the eight to tenth embodiments, the displacing configuration of the movable member is brought to the ideal state by means of the characteristics of the movable member, and then, the air bubble is led in the discharging direction in such a state. Hence, the stabilized discharging condition becomes obtainable. At the same time, it is possible to obtain the characteristics of the enhanced discharging efficiency at all times. Also, the refilling efficiency and the durability of the movable member are enhanced.

With respect to the eleventh to sixteenth embodiments, it is possible to utilize the function to positively shift the development components of the air bubble on the downstream side to the free end side of the movable member more efficiently by arranging the characteristic structure of the movable member that forms on it the first displacement area, which is positioned on the free end side, having a weaker rigidity in the displacing direction of the movable member, and the second displacement area, which is positioned on the fulcrum side, having a stronger rigidity in the displacing direction of the movable member. With such arrangement, it becomes possible to enhance the discharging efficiency, the discharging pressure, and the stability still more.

Given each of the displacement areas as the first and the second displacement areas from the discharge port side, the strength of each displacement area is in a relationship of (the first displacement area) <(the second displacement area), and the structure whereby to arrange the boundary between each of the displacement areas on the portion that faces the air bubble generating area (or the heat generating element) makes it possible to allow the first and second displacement areas to function based upon the pressure exerted by the creation of air bubble. As a result, the free end side is in the state of being displaced more, hence leading the pressure of the air bubble on the downstream side intensively to the free end side of each movable member efficiently. In this way, the air bubble is led in the discharging direction efficiently and stably.

Also, if the foaming power is small, the first displacement area of the movable member functions in particular to control such small foaming power more efficiently and lead it the air bubble in the discharging direction. If a large air bubble is created on the air bubble generating area, the first and second displacement areas function to condition the free end side to be displaced large, thus making it possible to control the large power more efficiently and lead it in the discharging direction. Therefore, thermal energy is utilized more effectively.

Further, for the heads of a type having different foaming powers, respectively, it is made possible to displace each of the movable members appropriately. As a result, not only the discharging efficiency is enhanced stably, but also, the controlling performance and the discharging efficiency become superior when gradation control or the like is required.

Also, with such discharging performance having high discharging efficiency, discharging pressure, and stability, it is now possible to prevent discharging from being disabled when the apparatus is left intact for a long time at low temperatures and low humidities. If it should become disabled, the discharging operation is easily restored to the normal condition by a slight performance of recovery process, such as pre-discharges and suction recovery. In this way, it becomes possible to reduce the time required for the execution of recovery, and the loss of liquid as well. Now that the characteristics of refilling are also enhanced, the response at the time of continuous discharging, the stabilized development of air bubbles, and the stabilized formation of droplets are attainable.

Also, when using the liquid jet head of the present invention as a liquid jet recording head for use of recording, it is possible to obtain recorded images of a high quality.

Also, using the liquid jet head of the present invention it is possible to provide a liquid jet apparatus the liquid discharging efficiency of which is further enhanced, among other advantages.

What is claimed is:

1. A liquid discharging method for discharging liquid by displacing a movable member by means of a bubble, said movable member having a substantially uniform thickness and having a free end thereof facing a heat generating surface for generating heat, said heat generating surface being substantially flush with or smoothly continuous with an adjacent surface upstream of said heat generating surface, comprising the step of:

promoting a movement of said free end by means for promoting a displacement of the free end of said movable member.

2. A liquid discharging method according to claim 1, wherein a pressure of the bubble is added to a ½ area from the free end side of said movable member to provide a displacing configuration to maximize the displacement of said free end.

3. A liquid discharging method according to claim 2 for discharging liquid by displacing the movable member having the free end thereof facing the heat generating surface by means of the bubble, using a head provided with a plurality of discharge ports for discharging liquid, a plurality of heat generating surfaces for causing liquid to create bubbles, and movable members arranged to face said heat generating surfaces, each being displaceable between a first position and a second position further away from said heat generating surface than said first position, wherein said movable member is displaced from said first position to said second position by pressure exerted by a creation of said bubble on said heat generating surface, and, said bubble is caused to be expanded by displacement of said movable member more downstream than upstream toward the discharge port for discharging liquid.

4. A liquid discharging method according to claim 1, wherein a pressure of the bubble is added to a ⅖ area from the free end side of said movable member to provide a displacing configuration to maximize the displacement of said free end.

5. A liquid discharging method according to claim 1, wherein of the pressure of said bubble acting upon said movable member, the pressure acting upon the side nearer to the free end is enhanced relatively more than the pressure acting upon the side nearer to a fulcrum to make the displacement of the free end higher than any other parts of said movable member.

6. A liquid discharging method according to claim 1, using a head provided with discharge ports for discharging liquid, heat generating surfaces for causing liquid to create bubbles, and movable members arranged to face said heat generating surfaces, each being displaceable between a first position and a second position further away from said heat generating surface than said first position, said movable member being displaced from said first position to said second position by pressure exerted by the creation of said bubble on said heat generating surface, said bubble being caused to be expanded by the displacement of said movable member more downstream than upstream toward the discharge port for discharging liquid, wherein of the pressure of said bubble acting upon said movable member, the pressure acting upon the side nearer to the free end is enhanced relatively more than the pressure acting upon the side nearer to a fulcrum to make the displacement of the free end higher than any other parts of said movable member.

7. A liquid discharging method according to claim 1 for discharging liquid by the creation of air bubbles to discharge liquid from the discharge ports, comprising the following steps of:

arranging movable members, each having a fulcrum on the upstream side and the free end on the downstream side in the flow of liquid directed toward said discharge port, and a first displacement area on said free end side and a second displacement area on said fulcrum side provided with a stronger rigidity than said first displacement area with respect to the displacing direction, to face said air bubble generating area for creating said air bubble; and leading pressure in the direction of said discharge port for discharging liquid from said discharge port by displacing said movable member from a first position to a second position further away from said air bubble generating area than said first position by the pressure exerted by the creation of air bubble on said air bubble generating area.

8. A liquid discharging method according to claim 7, wherein said air bubble is expanded beyond said first position, and at the same time, said movable member is displaced to said second position.

9. A liquid discharging method according to claim 7, wherein pressure exerted by said air bubble is led in the direction of said discharge port by the displacement of said first displacement area.

10. A liquid discharging method according to claim 7, wherein pressure on the upstream side portion of said air bubble is led to the free end side of said movable member by the displacement of said second displacement area, and at the same time, pressure on the downstream side portion of said air bubble is led in the direction of said discharge port by the displacement of said first displacement area.

11. A liquid discharging method according to claim 7, wherein heat generated by the heat generating element arranged in a position to face said movable member is transferred to liquid for the generation of film boiling phenomenon in said liquid, and said air bubble is created by said film boiling phenomenon.

12. A liquid jet head for discharging liquid by displacing a movable member by means of a bubble, said movable member having a substantially uniform thickness and having a free end thereof facing a heat generating surface for generating heat, said heat generating surface being substantially flush with or smoothly continuous with an adjacent surface upstream of said heat generating surface, comprising:

means for promoting a displacement of the free end of said movable member.

13. A liquid jet head according to claim 12, wherein an end of the heat generating surface on a side opposite to the discharge port is arranged on a free end side of a center of said movable member.

14. A liquid jet head according to claim 13 for discharging liquid by displacing the movable member having the free end thereof facing the heat generating surface by means of the bubble comprising:

a plurality of discharge ports for discharging liquid;

a plurality of heat generating surfaces for causing liquid to create bubbles; and movable members arranged to face said heat generating surfaces, each being displaceable between a first position and a second position further away from said heat generating surface than said first position, wherein said movable member is displaced from said first position to said second position by pressure exerted by creation of said bubble on said heat generating surface, and, said bubble is caused to be expanded by displacement of said movable member more downstream than upstream toward the discharge port for discharging liquid.

15. A liquid jet head according to claim 14, wherein said heat generating surface utilizes a heat generating element.

16. A liquid jet head according to claim 15, wherein the end of said heat generating surface on the discharge port side is positioned nearer to the discharge port than the free end of said movable member.

17. A liquid jet head according to claim 16, wherein the end of said heat generating element includes the area 1 to 8 μm inside the pattern edge.

18. A liquid jet head according to claim 15, wherein the end of said heat generating element on the discharge port side is positioned further away from the discharge port than the free end of said movable member.

19. A liquid jet head according to claim 18, wherein the end of said heat generating element includes the area 1 to 8 μm inside the pattern edge.

20. A liquid jet head according to claim 15, wherein the end of said heat generating element on the discharge port side is positioned equal to the free end of said movable member.

21. A liquid jet head according to claim 20, wherein the end of said heat generating element includes the area 1 to 8 μm inside the pattern edge.

22. A liquid jet head according to claim 15, wherein the end of said heat generating element includes the area 1 to 8 μm inside a pattern edge.

23. A liquid jet head according to claim 12, wherein an end of the heat generating surface on a side opposite to the discharge port is arranged on a free end side of a point dividing said movable member by 2:3 from the free end thereof.

24. A liquid jet head according to claim 12, wherein of the pressure of said bubble acting upon said movable member, the pressure acting upon the side nearer to the free end is enhanced relatively more than the pressure acting upon the side nearer to a fulcrum.

25. A liquid jet head according to claim 12 provided with discharge ports for discharging liquid, heat generating surfaces for causing liquid to create bubbles, and movable members arranged to face said heat generating surfaces, each being displaceable between a first position and a second position further away from said heat generating surface than said first position, said movable member being displaced from said first position to said second position by pressure exerted by the creation of said bubble on said heat generating surface, said bubble being caused to be expanded by the displacement of said movable member more downstream than upstream toward the discharge port for discharging liquid, wherein of the pressure of said bubble acting upon said movable member, the pressure acting upon the side nearer to the free end is enhanced relatively more than the pressure acting upon the side nearer to a fulcrum to make the displacement of the free end higher than any other parts of said movable member.

26. A liquid jet head according to claim 25, wherein the side wall of said heat generating surface is narrower in a vicinity of the free end of said movable member.

27. A liquid jet head according to claim 25, wherein said heat generating surface includes a heat generating element.

28. A liquid jet head according to claim 27, wherein a part of said heat generating element on the side opposite to the discharge port is masked.

29. A liquid jet head according to claim 27, wherein the heat generating area of the heat generating element on the discharge port side is large.

30. A liquid jet head according to claim 27, wherein the discharge port side of said heat generating element is nearer to said movable member.

31. A liquid jet head according to claim 12, wherein a characteristic frequency of vibration of said movable member is made larger than an inverse number of cycle from said creation of air bubble to extinction thereof.

32. A liquid jet head according to claim 31 provided with discharge ports for discharging liquid, heat generating surfaces for causing liquid to create bubbles, and movable members arranged to face said heat generating surfaces, each being displaceable between a first position and a second position further away from said heat generating surface than said first position, wherein said movable member is displaced from said first position to said second position by pressure exerted by the creation of said bubble on said heat generating surface, and, said bubble is caused to be expanded by the displacement of said movable member more downstream than upstream in the direction toward the discharge port for discharging liquid for leading said bubble in the direction of discharge port for discharging liquid.

33. A liquid jet head according to claim 32, wherein said bubble is created by heat applied to liquid by said heat generating surface.

34. A liquid jet head according to claim 33, wherein said bubble is created on a bubble generating area of the heat generating surface.

35. A liquid discharging method for discharging using the liquid jet head according to claim 31.

36. A liquid jet head according to claim 12, wherein a characteristic frequency of vibration of said movable member is made larger than a maximum driving frequency of said liquid discharging.

37. A liquid jet head according to claim 12, wherein a speed of wave transfer of said movable member is made faster than a developing speed of the bubble.

38. A liquid jet head according to claim 37 for discharging liquid by displacing the movable member provided with the free end facing the heat generating surface by means of the bubble, wherein the speed of wave transfer of said movable member is made 10 m/s or more.

39. A liquid jet head according to claim 12 comprising:

discharge ports for discharging liquid;

heat generating surfaces for creating bubbles for discharging liquid from said discharge ports; and at least one movable member arranged to face the heat generating surface to be made displaceable between a first position and a second position further away from said heat generating surface than said first position, wherein said movable member is provided with a fulcrum on an upstream side, and the free end on a downstream side in a flow of liquid directed to the discharge port, and provided with a first displacement area on said free end side, and a second displacement area on said fulcrum side, having stronger rigidity than said first displacement area with respect to the displacing direction of said movable member, and is displaced from said first position to said second position by pressure exerted by a creation of the bubble to lead said pressure in a direction of said discharge port for discharging liquid from said discharge port.

40. A liquid jet head according to claim 39, wherein said first displacement area faces said heat generating surface.

41. A liquid jet head according to claim 39, wherein said first and second displacement areas face said heat generating surface over this area.

42. A liquid jet head according to claim 39, wherein a boundary between said first displacement area and said second displacement area resides on a portion facing a heat generating element for creating the bubble on said heat generating surface.

43. A liquid jet head according to claim 42, wherein the boundary between said first displacement area and said second displacement area resides on a center of said facing portion.

44. A liquid jet head according to claim 42, wherein the boundary between said first displacement area and said second displacement area resides on the area of ±30% of a length of said facing portion from the center of said facing portion.

45. A liquid jet head according to claim 42, wherein the boundary between said first displacement area and said second displacement area resides on the area of ±10% of a length of said facing portion from the center of said facing portion.

46. A liquid jet head according to claim 39, wherein said movable member is provided with a plurality of displacement areas having different rigidities in the displacing direction of said movable member.

47. A liquid jet head according to claim 39, wherein said movable member faces a plurality of heat generating elements for creating the bubble on said heat generating surface.

48. A liquid jet head according to claim 39, wherein said movable member is provided with a flat palate type displaceable reinforcement member from a vicinity of the fulcrum in the longitudinal direction of said movable member, and the portion having said reinforcement member is arranged as said second displacement area.

49. A liquid jet head according to claim 39, wherein said movable member is provided with a folding portion extended from a vicinity of the fulcrum in the longitudinal direction, and the portion having said folded portion is arranged as said second displacement area.

50. A liquid jet head according to claim 49, wherein said folded portion is convex or concave at a section orthogonal to said movable member in a longitudinal direction.

51. A liquid jet head according to claim 49, wherein said folded portion is undulated at a section orthogonal to said movable member.

52. A liquid jet head according to claim 49, wherein said folded portion is formed by sides extended with an acute angle in a longitudinal direction of said movable member.

53. A liquid jet head according to claim 39, wherein the heat generating element is positioned to face said movable member, and said air bubble generating area is between said movable member and said heat generating element.

54. A liquid jet head according to claim 53, wherein the free end of said movable member is positioned downstream of the area center of said heat generating element.

55. A liquid jet head according to claim 53, wherein said air bubble is created by film boiling generated in liquid by the application of heat generated by said heat generating element.

56. A liquid jet head according to claim 55, wherein all an effective foaming area of said heat generating element faces said movable member.

57. A liquid jet head according to claim 55, wherein all the surface of said heat generating element faces said movable member.

58. A liquid jet head according to claim 55, wherein all the area of said movable member is larger than the all the area of said heat generating element.

59. A liquid jet head according to claim 55, wherein the fulcrum of said movable member is positioned off the portion immediately above said heat generating element.

60. A liquid jet head according to claim 39, comprising:

a first liquid flow path conductively connected with said discharge port; and a second liquid flow path having the air bubble generating area for creating air bubble in liquid by applying heat to said liquid, wherein said movable member is structured as a part of the separation wall partitioning said first liquid flow path and said second liquid flow path.

61. A head cartridge comprising:

a liquid jet head according to claim 60; and a liquid container for retaining a first liquid to be supplied to a first liquid flow path and a second liquid to be supplied to a second liquid flow path of said liquid jet head.

62. A head cartridge comprising:

a liquid jet head according to claim 39; and a liquid container for retaining liquid to be supplied to said liquid jet head.

63. A head cartridge according to claim 62, wherein said liquid jet head and said liquid container are separable.

64. A liquid jet apparatus for recording on a recording medium, comprising:

a liquid jet head according to claim 39; and a carriage mounting said liquid jet head, and being capable of reciprocating in the direction of sub-operation.

* * * * *

UNITED STATES PATENT AND TRADEMARK OFFICE

CERTIFICATE OF CORRECTION

PATENT NO. : 6,457,816 B1
DATED : October 1, 2002
INVENTOR(S) : Hiroyuki Ishinaga et al.

It is certified that error appears in the above-identified patent and that said Letters Patent is hereby corrected as shown below:

Title page,
Item [56], References Cited, FOREIGN PATENT DOCUMENTS,
"JP 61-59914 2/1980" should read -- JP 61-5994 2/1986 --.

Column 1,
Line 20, "displacing." should read -- displacing --; and
Line 62, "a facsimile" should read -- and facsimile --.

Column 4,
Line 53, "enable" should read -- enables --.

Column 6,
Line 41, "displacement" should read -- displacement. --;
Line 51, "member" should read -- member. --; and
Line 58, "that" should read -- than --.

Column 7,
Line 39, "is to" should read -- is structured to --.

Column 8,
Line 36, "cycle" should read -- cycles --.

Column 12,
Line 5, "structure)" should read -- path structure) --.

Column 13,
Line 31, "priorly." should read -- previously. --.

Column 14,
Line 6, "smeller" should read -- smaller --;
Line 41, "is, the" should read -- is, --; and "form" should read -- from --.

Column 15,
Line 32, "make up as" should read -- make up --.

Column 16,
Line 4, "being" should read -- is --; and
Line 37, "are" should read -- is --.

UNITED STATES PATENT AND TRADEMARK OFFICE

CERTIFICATE OF CORRECTION

PATENT NO. : 6,457,816 B1
DATED : October 1, 2002
INVENTOR(S) : Hiroyuki Ishinaga et al.

It is certified that error appears in the above-identified patent and that said Letters Patent is hereby corrected as shown below:

Column 18,
Line 16, "indicated" should read -- indicates --; and
Line 45, "closely closed essentially." should read -- essentially closed. --.

Column 19,
Line 51, "anyway" should read -- any way --.

Column 26,
Line 43, "patters" should read -- patterns --; and
Line 50, "theses" should read -- these --.

Column 27,
Line 5, "patter" should read -- pattern --;
Line 21, "For" should read -- for --; and
Line 52, "described" should read -- been described --.

Column 28,
Line 44, "arrange" should read -- arranged --.

Column 30,
Line 6, "is made" should read -- are made --;
Line 37, "appears" should read -- that appears --; and
Line 39, "present" should read -- presently --.

Column 31,
Line 43, "form" should read -- from --.

Column 32,
Line 13, "with" should be deleted;
Lines 47 and 48, "which" should read -- which is --; and
Line 57, "include" should read -- includes --.

Column 38,
Line 65, "enable" should read -- enables --.

Column 39,
Line 51, "ran" should read -- run --.

UNITED STATES PATENT AND TRADEMARK OFFICE

CERTIFICATE OF CORRECTION

PATENT NO. : 6,457,816 B1
DATED : October 1, 2002
INVENTOR(S) : Hiroyuki Ishinaga et al.

It is certified that error appears in the above-identified patent and that said Letters Patent is hereby corrected as shown below:

Column 40,
Line 39, "element" should read -- elements --.

Column 41,
Line 34, "droplets: Colo-" should read -- droplets. ¶ Colo --.

Column 42,
Line 65, "member" should read -- members --.

Column 44,
Line 54, "illustrate" should read -- illustrates --.

Column 45,
Line 28, "lays" should read -- rays --.

Column 46,
Line 7, "upon on" should read -- upon --;
Line 18, "eight" should read -- eighth --; and
Line 59, "it" should be deleted --.

Column 47,
Line 23, "using" should read -- when using --.

Column 52,
Line 32, "the all" should read -- all --.

Signed and Sealed this

Ninth Day of August, 2005

JON W. DUDAS
*Director of the United States Patent and Trademark Office*